US006000657A

United States Patent [19]

Butterworth

[11] Patent Number: 6,000,657

[45] **Date of Patent: *Dec. 14, 1999**

[54] WINDING CONTROL FINGER SURFACE REWINDER WITH CORE INSERT FINGER

[75] Inventor: Tad T. Butterworth, Ashland, Wis.

[73] Assignee: C.G. Bretting Manufacturing Company, Inc., Ashland, Wis.

[ * ] Notice: This patent is subject to a terminal disclaimer.

[21] Appl. No.: 09/170,552

[22] Filed: Oct. 13, 1998

Related U.S. Application Data

[63] Continuation of application No. 08/815,146, Mar. 11, 1997, Pat. No. 5,820,064, which is a continuation-in-part of application No. 08/715,671, Sep. 18, 1996, Pat. No. 5,772,149.

[51] Int. Cl.[6] ..... B65H 19/26

[52] U.S. Cl. ..... 242/533.2; 242/521

[58] Field of Search ..... 242/533, 533.2, 242/541, 542, 542.3, 521

[56] References Cited

U.S. PATENT DOCUMENTS

| | | | |
|---|---|---|---|
| Re. 35,304 | 7/1996 | Biagiotti . | |
| 3,123,315 | 3/1964 | Couzens . | |
| 3,179,348 | 4/1965 | Nystrand et al. . | |
| 3,389,592 | 6/1968 | Bournez et al. . | |
| 3,727,853 | 4/1973 | Kinoshita | 242/533.2 |
| 3,823,887 | 7/1974 | Gerstein . | |
| 3,853,279 | 12/1974 | Gerstein . | |
| 3,856,226 | 12/1974 | Dowd, Jr. . | |
| 4,055,313 | 10/1977 | Yamaguchi et al. . | |
| 4,123,011 | 10/1978 | Kajiwara et al. . | |
| 4,238,082 | 12/1980 | Lund . | |
| 4,265,409 | 5/1981 | Cox et al. . | |
| 4,280,669 | 7/1981 | Leanna et al. . | |
| 4,327,877 | 5/1982 | Perini | 242/533.2 |
| 4,422,588 | 12/1983 | Nowisch . | |
| 4,448,363 | 5/1984 | Mukenschnabl . | |
| 4,487,377 | 12/1984 | Perini . | |

(List continued on next page.)

FOREIGN PATENT DOCUMENTS

| | | | |
|---|---|---|---|
| 9201176 | 12/1992 | Brazil . | |
| 9201177 | 12/1992 | Brazil . | |
| 0 452 284 A2 | 4/1991 | European Pat. Off. . | |
| 0 580 561 A2 | 7/1993 | European Pat. Off. . | |
| 19 35 584 | 6/1978 | Germany | 242/533.2 |
| 1033778 | 2/1975 | Italy . | |
| 1213820 | 9/1987 | Italy . | |
| 123819 | 9/1987 | Italy . | |
| 1258172 | 2/1992 | Italy . | |
| 1259660 | 7/1992 | Italy . | |

(List continued on next page.)

OTHER PUBLICATIONS

SINCRO/Fabio Perini sales brochure, circa 1994.

PCMC "Magnum" Rewinder, date unknown, pamphlet.

*Primary Examiner*—Donald P. Walsh

*Assistant Examiner*—Emmanuel M. Marcelo

*Attorney, Agent, or Firm*—Michael Best & Friedrich LLP

[57] ABSTRACT

An apparatus and method for rewinding large rolls of paper into smaller rolls, such as bathroom tissue rolls. The rewinder includes three rolls forming a winding cradle and winding control fingers operating adjacent to and in the winding cradle. Upper and lower winding rolls are spaced apart far enough to allow a core to be introduced between them by the winding control fingers. A rider roll moves relative to the winding rolls to control the diameter of the paper roll being wound. The lower winding roll is preferably equipped with two sets of winding control fingers which can orbit around the roll and introduce the core between the winding rolls, separate the web, guide the web around the core and remove the completed log from the winding cradle. Each of a plurality of winding control fingers is equipped with a core insert finger and a web separation finger so that each winding control finger can independently receive, transport and deposit a core in preparation for the winding process.

41 Claims, 41 Drawing Sheets

U.S. PATENT DOCUMENTS 4,487,378 12/1984 Kobayashi .
4,508,283 4/1985 Beisswanger .
4,529,141 7/1985 McClenathan .
4,575,018 3/1986 Ichikawa .
4,588,138 5/1986 Spencer .
4,635,867 1/1987 Kytonen .
4,695,005 9/1987 Gietman, Jr. .
4,697,755 10/1987 Kataoka .
4,721,266 1/1988 Haapanen et al. .
4,723,724 2/1988 Bradley .
4,783,015 11/1988 Shimizu .
4,798,350 1/1989 Jorgensen et al. .
4,828,195 5/1989 Hertel et al. .
4,856,725 8/1989 Bradley .
4,875,632 10/1989 Kataoka .
4,892,119 1/1990 Hugo et al. .
4,909,452 3/1990 Hertel et al. .
4,919,351 4/1990 McNeil .
4,931,130 6/1990 Biagiotti .
4,932,599 6/1990 Doerfel .
4,962,897 10/1990 Bradley .
4,988,051 1/1991 Welschlau et al. .
5,031,850 7/1991 Biagiotti ..... 242/542
5,038,647 8/1991 Biagiotti .
5,040,738 8/1991 Biagiotti ..... 242/542
5,104,055 4/1992 Buxton .
5,137,225 8/1992 Biagiotti ..... 242/542
5,150,848 9/1992 Consani .
5,150,850 9/1992 Adams .
5,226,611 7/1993 Buterworth et al. .
5,248,106 9/1993 Biagiotti ..... 242/533.2
5,249,756 10/1993 Biagiotti .
5,267,703 12/1993 Biagiotti .
5,271,137 12/1993 Schultz .
5,285,977 2/1994 Biagiotti .
5,312,059 5/1994 Membrino .
5,335,871 8/1994 Fissmann et al. .
5,344,091 9/1994 Molison .
5,357,833 10/1994 Biagiotti .
5,368,252 11/1994 Biagiotti .
5,368,253 11/1994 Hartley, Jr. .
5,370,335 12/1994 Vigneau .
5,383,622 1/1995 Moody .
5,387,284 2/1995 Moody .
5,402,960 4/1995 Oliver et al. .
5,407,509 4/1995 Ishizu et al. .
5,409,178 4/1995 Stauber .
5,453,070 9/1995 Moody .
5,467,936 11/1995 Moody .
5,492,287 2/1996 Raudaskoski et al. .
5,497,959 3/1996 Johnson et al. .
5,505,402 4/1996 Vigneau .
5,505,405 4/1996 Vigneau .
5,509,336 4/1996 Biagiotti .
5,513,478 5/1996 Abt .
5,518,200 5/1996 Kaji et al. .
5,518,490 5/1996 Ziegelhoffer .
5,522,292 6/1996 Biagiotti .
5,524,677 6/1996 Summey, III .
5,538,199 7/1996 Biagiotti .
5,542,622 8/1996 Biagiotti .
5,544,841 8/1996 Didier et al. .
5,577,684 11/1996 Dropczynski et al. ..... 242/533.2
5,603,467 2/1997 Perini et al. ..... 242/533.2
5,620,151 4/1997 Ueyama et al. .
5,632,456 5/1997 Kruger .
5,639,045 6/1997 Dorfel .
5,639,046 6/1997 Bigiotti .

FOREIGN PATENT DOCUMENTS 1 435 525 5/1976 United Kingdom .
2 105 688 3/1983 United Kingdom .
2150536 7/1985 United Kingdom .
WO 94/21545 9/1994 WIPO ..... 242/542
WO 94/29205 12/1994 WIPO .
WO 95/10472 4/1995 WIPO .
WO 95/34498 12/1995 WIPO .
WO 96/32350 10/1996 WIPO .

WINDING CONTROL FINGER SURFACE REWINDER

REWINDER WITH SINGLE WINDING CONTROL FINGER SYSTEM

REWINDER WITH SINGLE WINDING CONTROL FINGER SYSTEM

REWINDER WITH SINGLE WINDING CONTROL FINGER SYSTEM

REWINDER WITH SINGLE WINDING CONTROL FINGER SYSTEM

REWINDER WITH SINGLE WINDING CONTROL FINGER SYSTEM

WINDING CONTROL FINGER REWINDER FOR CORELESS PRODUCT

WINDING CONTROL FINGER SURFACE REWINDER WITH CORE INSERT FINGER

This application is a continuation of application Ser. No. 08/815,146, filed on Mar. 11, 1997, now U.S. Pat. No. 5,820,064; which is a CIP of application Ser. No. 08/715,671, filed on Sep. 18, 1996, now U.S. Pat. No. 5,772,149.

BACKGROUND

This invention relates generally to the field of paper converting, and more particularly to carefully controlling rewinding of a web of material from a large diameter roll into "logs" at very high speeds. The logs preferably comprise relatively small diameter rolls of paper that are subsequently cut into numerous short axial segments, resulting ultimately in rolls of bathroom tissue, kitchen towels or the like.

The highly competitive paper consumer product market requires manufacturers' rewinding processes to be highly automated and highly efficient at extremely high rewinding speeds. While some prior art rewinders have satisfactorily rewound high density products at average speeds, virtually every prior art device has difficulty rewinding low density product at average or high speeds. In most prior art rewinders, the low density products become unstable at higher speeds, decreasing product quality and sometimes ejecting the product from the rewinder.

Another difficulty with past continuous running surface rewinders has been the lack of efficient high speed separation of the web and the transfer of the leading edge of the separated web to the next core or mandrel at the completion of each log. Many systems for separation and transfer have been employed, but none have positively separated the web and transferred the leading edge at desired speeds. Further, prior reminders have typically not been able to precisely control sheet counts and product length on the rolls.

It is therefore an object of the invention to provide an improved rewinder method and apparatus.

It is a further object of the invention to provide a novel rewinder method and apparatus that positively separates a material web.

It is another object of the invention to provide an improved rewinder method and apparatus that transfers a leading edge of a separated web to a core, mandrel or log formation process in a well controlled manner at high speed.

It is a still further object of the invention to provide a novel rewinder method and apparatus that increases rewinding speed while maintaining or improving product quality compared to prior art devices.

It is yet another object of the invention to provide an improved rewinder method and apparatus that increases rewinding speed while maintaining or improving cored and coreless product quality.

It is a further object of the invention to provide an improved rewinder method and apparatus that positively interacts with cores, mandrels or other winding initiation devices to prevent misfeeding and misalignment.

It is another object of the invention to provide an improved rewinder method and apparatus that reduces the complexity and increases production capacity of rewinding machines.

It is still another object of the invention to provide an apparatus and method which further decreases acceleration rates required for operation.

It is yet another object of the invention to decrease the number of parts and components to manufacture and maintain.

It is still another object of the invention to provide a less expensive apparatus and method for rewinding.

The present invention provides a more positive system of separation and transfer than typical prior art devices and requires fewer moving parts as well. Highly preferred embodiments of the present invention include winding control fingers which can be located adjacent the lower winding roll. Preferably, one or more winding control fingers, each having at least one core insert finger, insert a core or mandrel upon which material is wound, separate the material web and remove logs from a rewinding station.

Other advantages and features of the invention, together with the organization and manner of operation thereof, will become apparent from the following detailed description when taken in conjunction with the accompanying drawings, wherein like elements have like numerals throughout the drawings.

Figure 1:
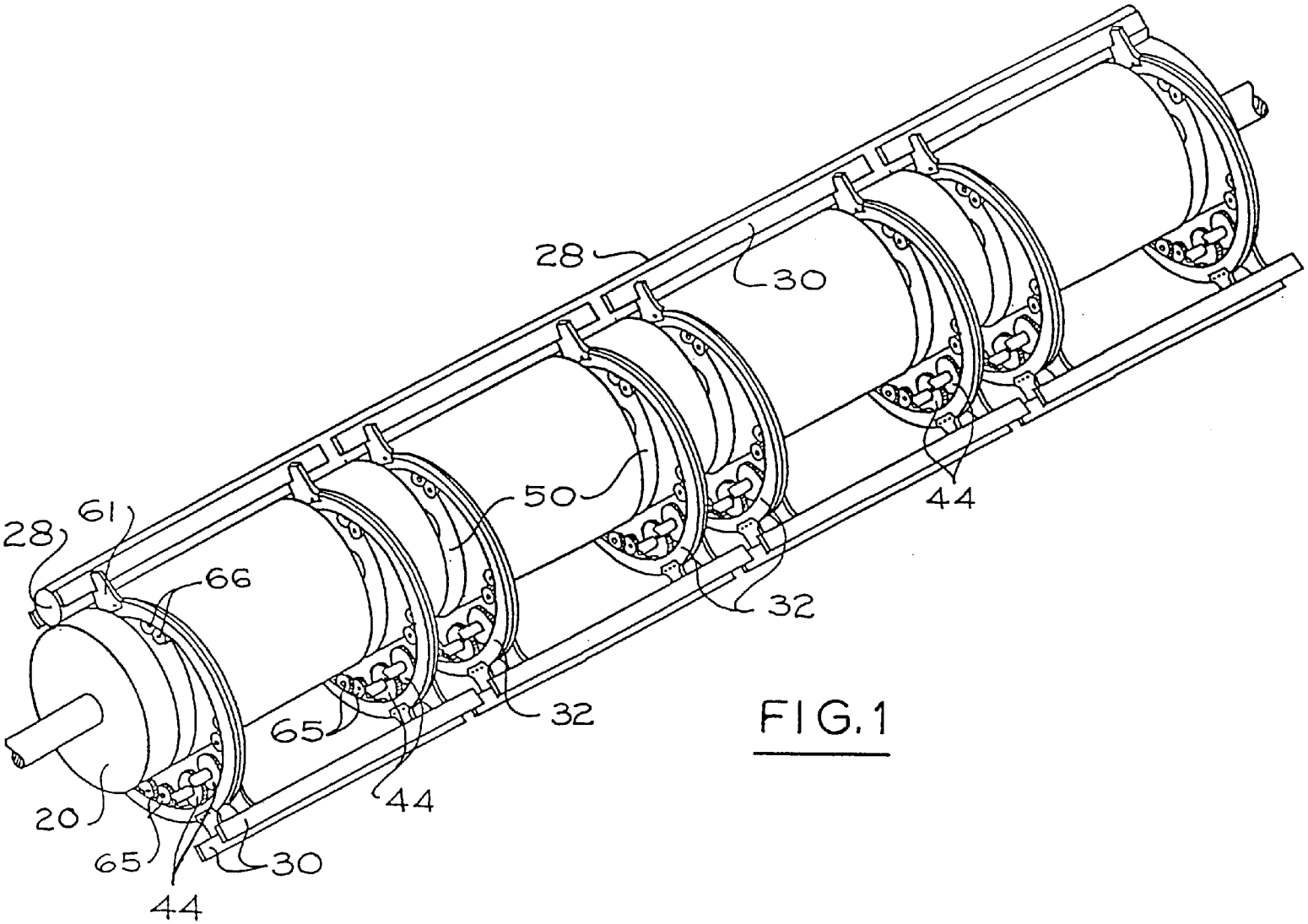
FIG. 1 shows a perspective view of a portion of a rewinder constructed in accordance with one preferred embodiment of the invention.

Certain reference characters used during the following discussion and thoughout this text are not shown on each and every figure. They have been omitted for the sake of clarity, but may be found in substantially identical locations in earlier mentioned figures and discriptions relating thereto.

DETAILED DESCRIPTION OF PREFERRED EMBODIMENTS

Figure 2:
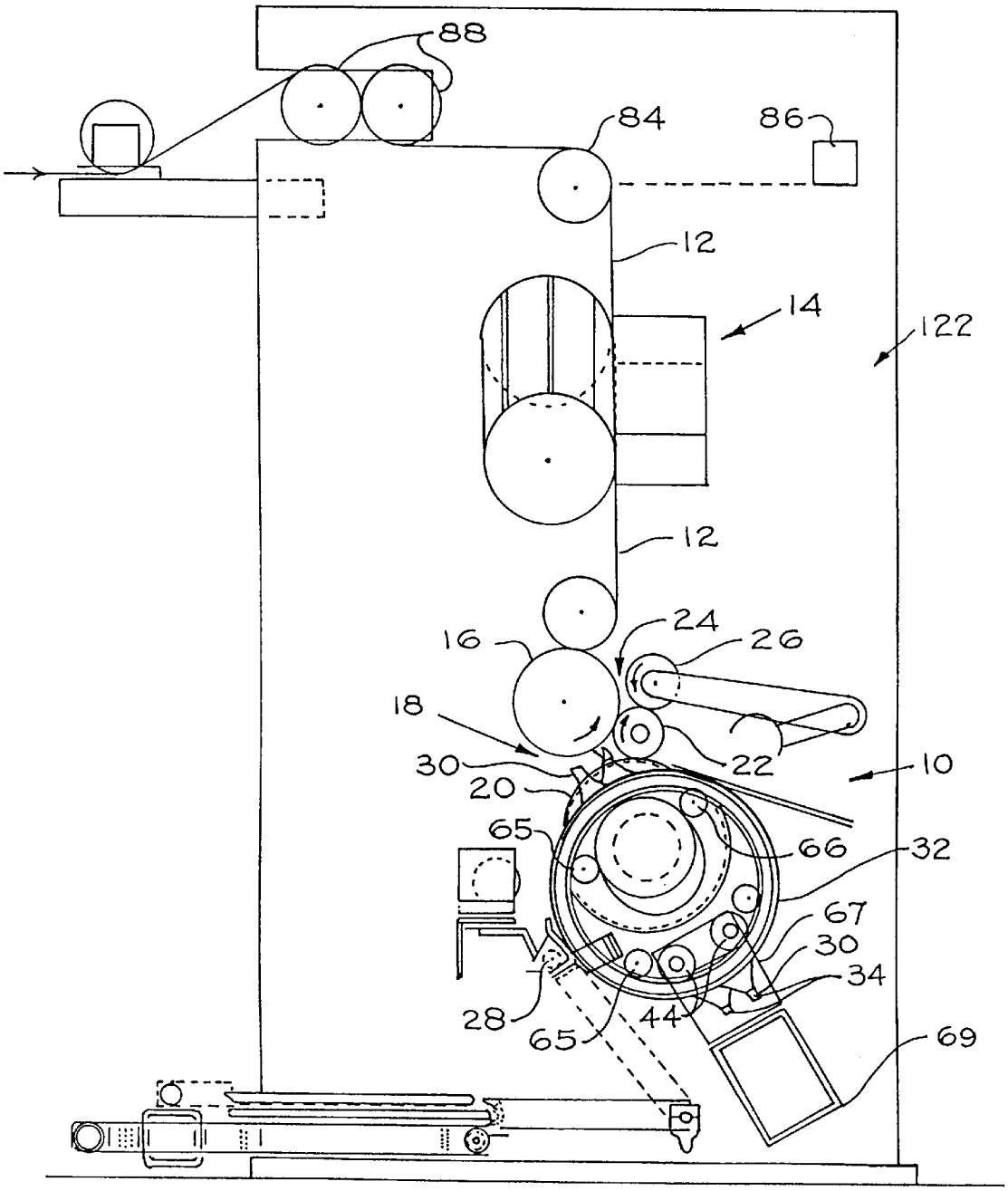
FIG. 2 illustrates a side view of the rewinder, a portion of which is shown in FIG. 1.
Figure 3A:
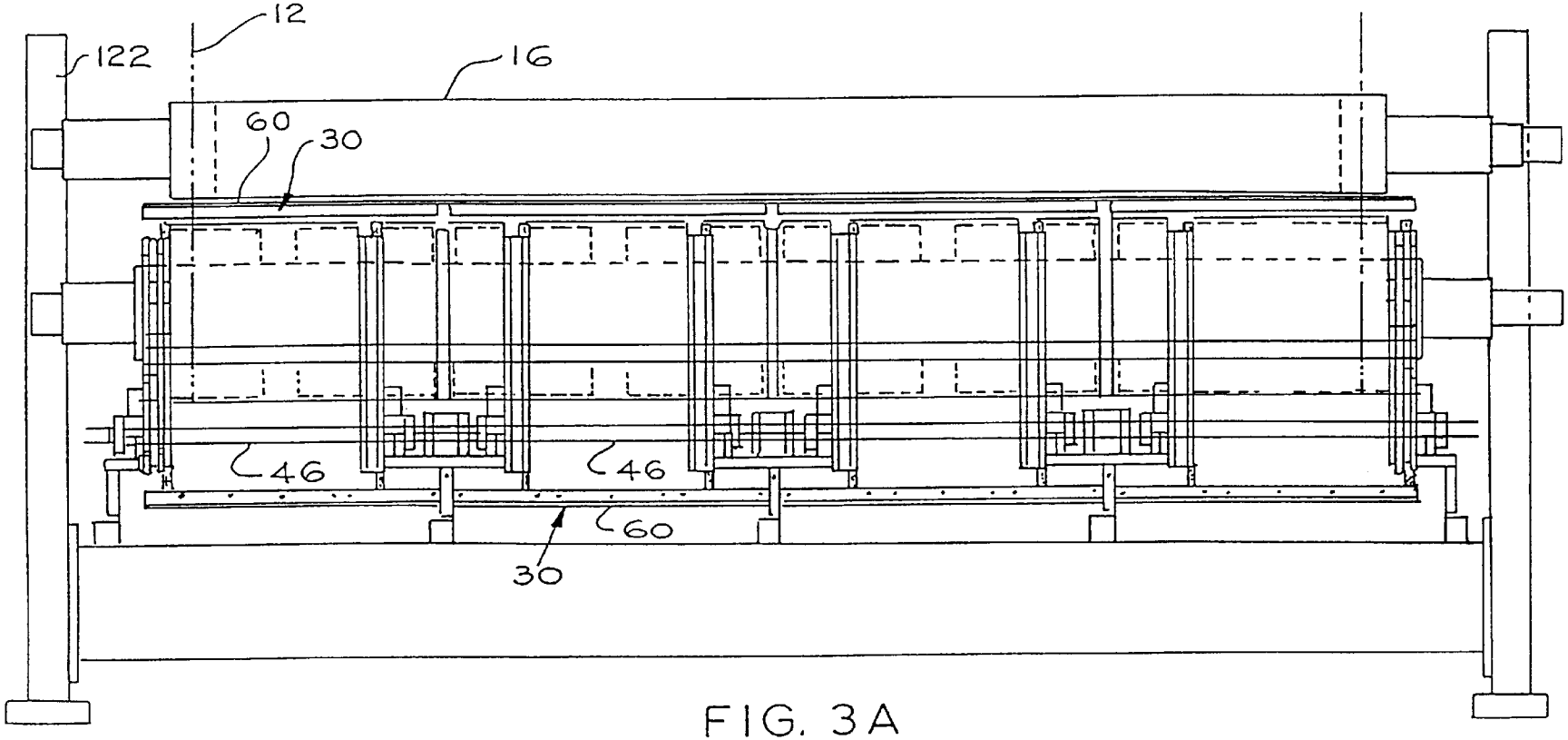
FIG. 3A shows a top view of the rewinder shown in FIGS. 1 and 2.

Referring to the Figures, and more particularly to FIGS. 1 and 2, a rewinder constructed in accordance with one preferred embodiment of the invention is shown at 10. The rewinder 10 includes a number of stations at which various functions are performed. In one preferred embodiment, a web 12 of material is perforated transversely at a perforation station 14 and then is directed to an upper winding roll 16. While a variety of materials can be rewound satisfactorily using the present invention, a paper web 12 is described herein for illustrative purposes. The web 12 passes around the upper winding roll 16 and through a throat 18 formed between the upper winding roll 16 and a lower winding roll 20. Paper logs 22 are preferably wound in a cradle 24 between the upper winding roll 16, the lower winding roll 20, and a rider roll 26 as is known in the art, although the invention also offers advantages in other rewinding processes. The rider roll 26 is movable from a position close to the winding rolls 16, 20 when the log 22 is small to a position away from the winding rolls 16, 20 as the diameter of the log 22 increases. While roll structures are illustrated and described herein, belts and other mechanisms can also be used satisfactorily without departing from the invention.

Referring now to FIGS. 1–10, a plurality of winding control fingers 30 cooperate to control insertion of cores 28, separation of the web 12 and removal of the log 22 processes in the rewinder 10. While the embodiments illustrated in FIGS. 1–10 use cores 28, it will be apparent that the present invention is useful for winding coreless products using mandrels or other winding initiation devices as well.

A variety of independent and joined configurations of winding control fingers 30 can be used, although two sets 34 of two control fingers 30 are shown in accordance with one preferred embodiment of the invention. In this embodiment, the winding control fingers 30 run the length of the lower winding roll 20 with some short interruptions and orbit adjacent the lower winding roll 20. Alternatively, the winding control fingers 30 can orbit adjacent the upper winding roll 16 and contact the lower winding roll 20 or the rider roll 26. The winding control fingers 30 are supported by a series of rings 32 comprising steel or other durable material. Composite or plastic materials such as nylon and polymolybdenum sulfide material available from Midland Plastics located in Brookfield, Wis. can be used in the rings 32 to lessen drive loading and provide quicker control response. Each ring 32 can include an internal V-shaped track 38 and internal gear teeth 40 (shown in FIG. 4A), although a variety of mounting configurations for the rings 32 or other suitable support structures can be used. The track 38 supports each ring 32, preferably on a set of V-shaped wheels 42 as shown in FIGS. 4C–F. The internal gear teeth 40 mate with one or more drive gears 44 which drive the ring 32 in a conventional manner.

Figure 3C:
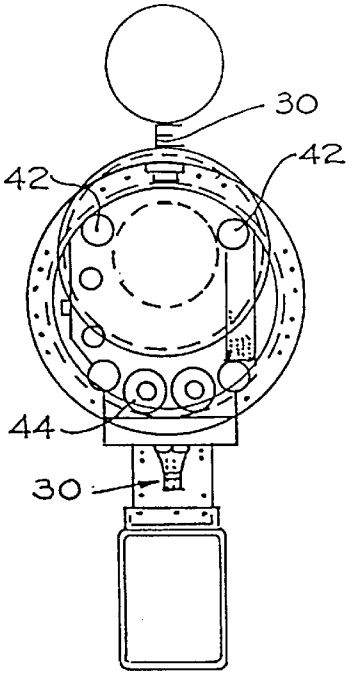
FIG. 3C shows a front elevation view of the winding control fingers supported by ring guide wheels and rotatably driven by a ring drive gear mechanism.
Figure 3B:
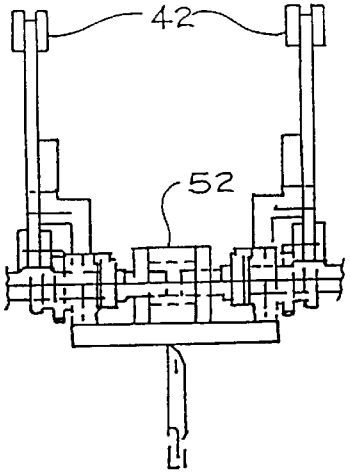
FIG. 3B illustrates a top view of the ring gear drive mechanism and ring support shown in FIGS. 1, 2 and 3A.
Figure 4B:
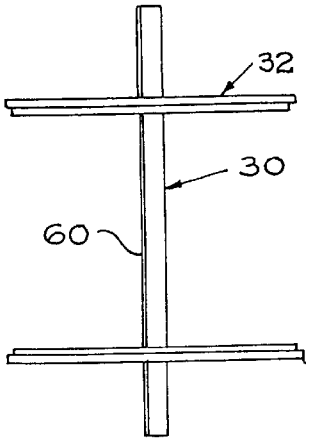
FIG. 4B illustrates a top view of the winding control fingers and ring structure generally shown in FIGS. 1–4A.
Figure 4F:
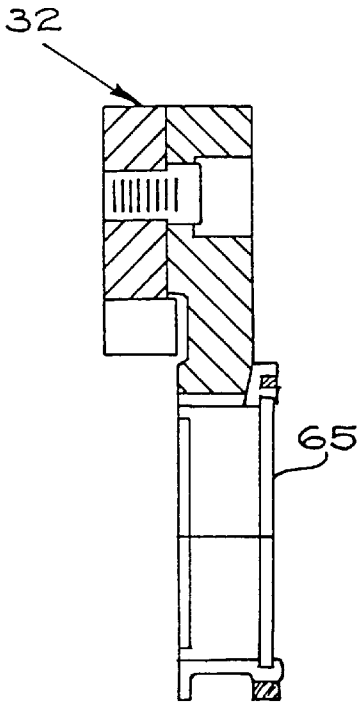
FIG. 4F illustrates a cross-sectional view of a pulley arrangement useful for supporting the ring structure.
Figure 4E:
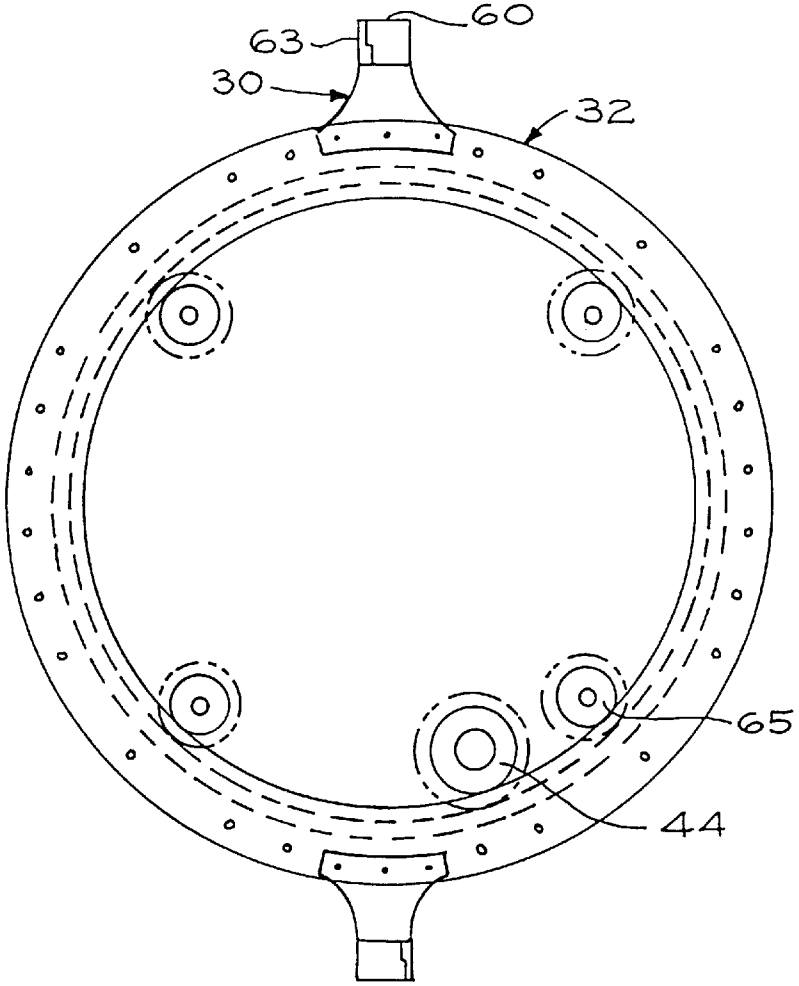
FIG. 4E shows an enlarged side view of the winding control fingers, ring structure and ring support and drive mechanism shown in FIGS. 1–3 and 4A–D.
Figure 4D:
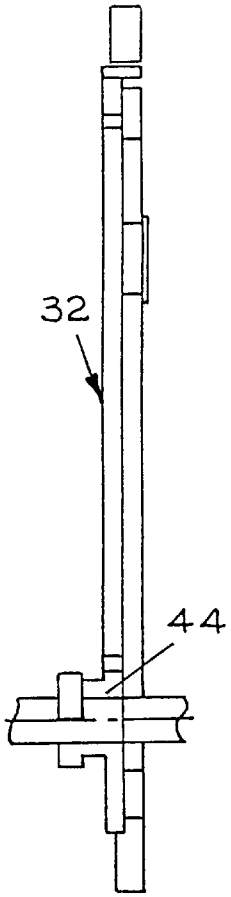
FIG. 4D illustrates a cross-sectional view of the winding control fingers and ring support mechanism.

In another preferred embodiment, the rings 32 are divided into two sets 34, each set 34 having its own drive shaft 46 and each set 34 supporting two winding control fingers 30 mounted approximately 180 degrees apart on the rings 32. The rings 32 are preferably located in grooves 50 (best illustrated in FIG. 1) in the lower winding roll 20 in the cradle 24 where logs 22 are wound and emerge from the grooves 50 outside the cradle 24. Each of the two independent ring drive systems can drive the rings 32 in either direction and keep accurate position control throughout the winding process. A variety of conventional drives can be used, but preferably each set 34 is separately driven by its own servo motor 52 as shown in FIG. 3B. Alternatively, each winding control finger 30 can be separately driven by a servo motor 52 or other conventional drive mechanism.

Figure 5:
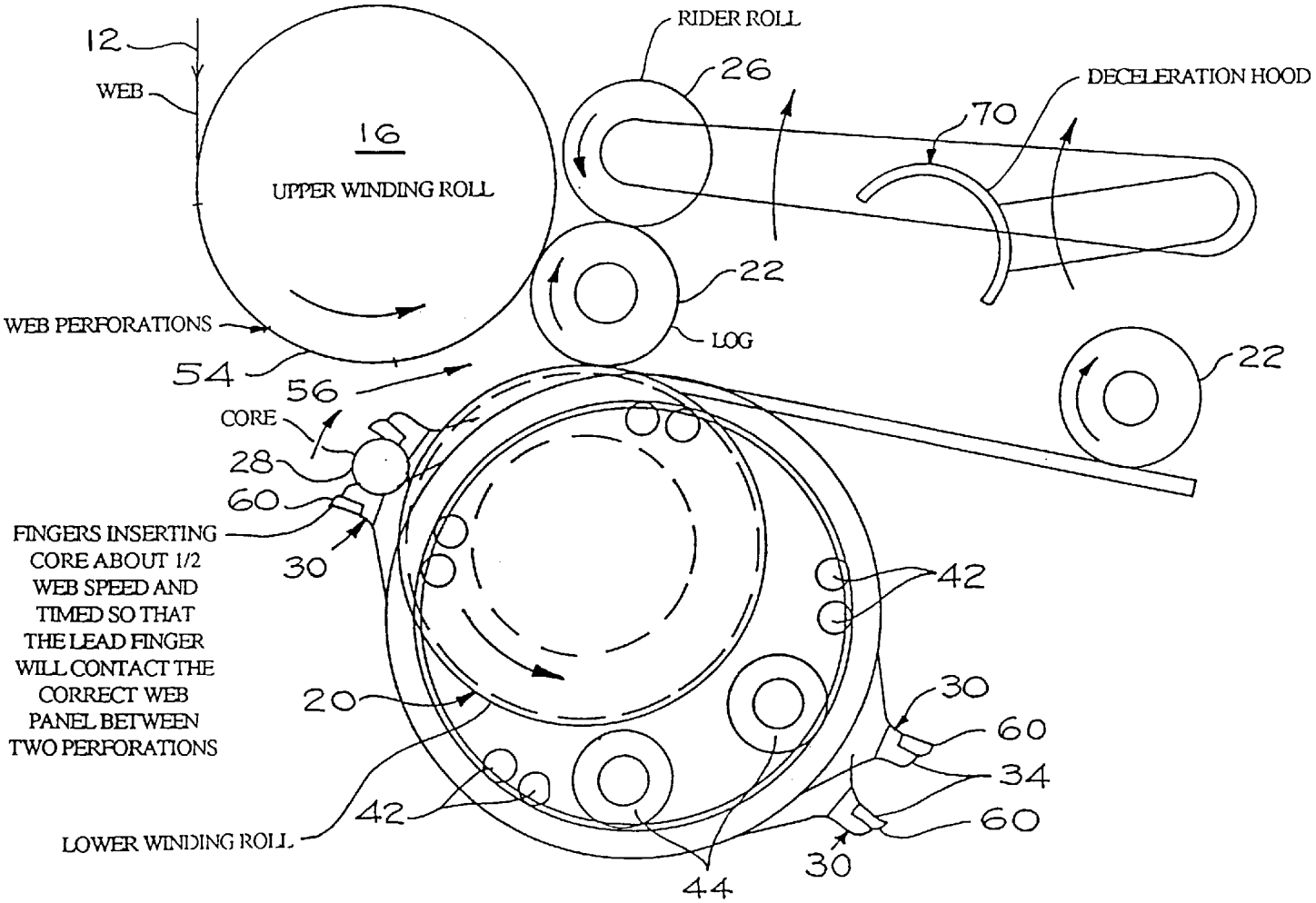
FIG. 5 illustrates an enlarged side view of the rewinder shown in FIGS. 1–4 prior to web separation.

Referring now to FIG. 5, a log 22 is shown nearing completion of winding in the cradle 24 formed between the two winding rolls 16, 20 and the rider roll 26. A core 28 is held in place between two winding control fingers 30, preferably by lightly squeezing the core 28 with the winding control fingers 30. The winding control fingers 30 accelerate the core 28 toward a nip 56 in the throat 18 preferably located at the point where the upper winding roll 16 and the lower winding roll 20 are closest to one another. The winding control fingers 30 and the core 28 preferably reach a speed somewhat less than the speed of the circumference 54 of upper winding roll 16.

Figure 4A:
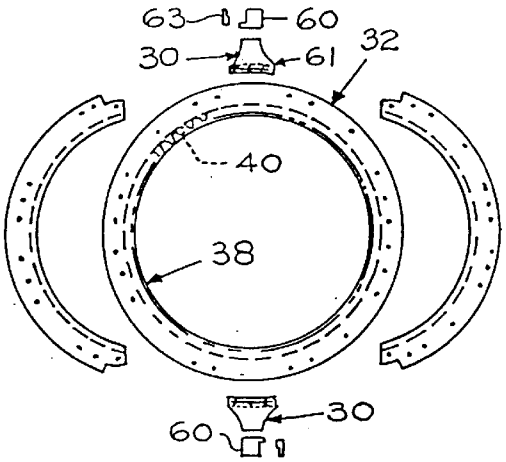
FIG. 4A shows an exploded side view of the winding control fingers and ring structure generally shown in FIGS. 1–3.
Figure 4C:
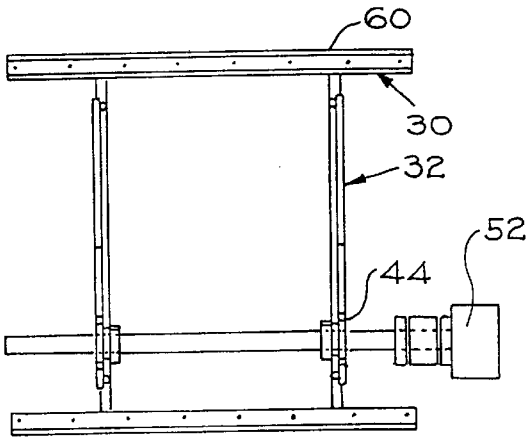
FIG. 4C shows a front view of the winding control fingers and ring support mechanism.
Figure 6:
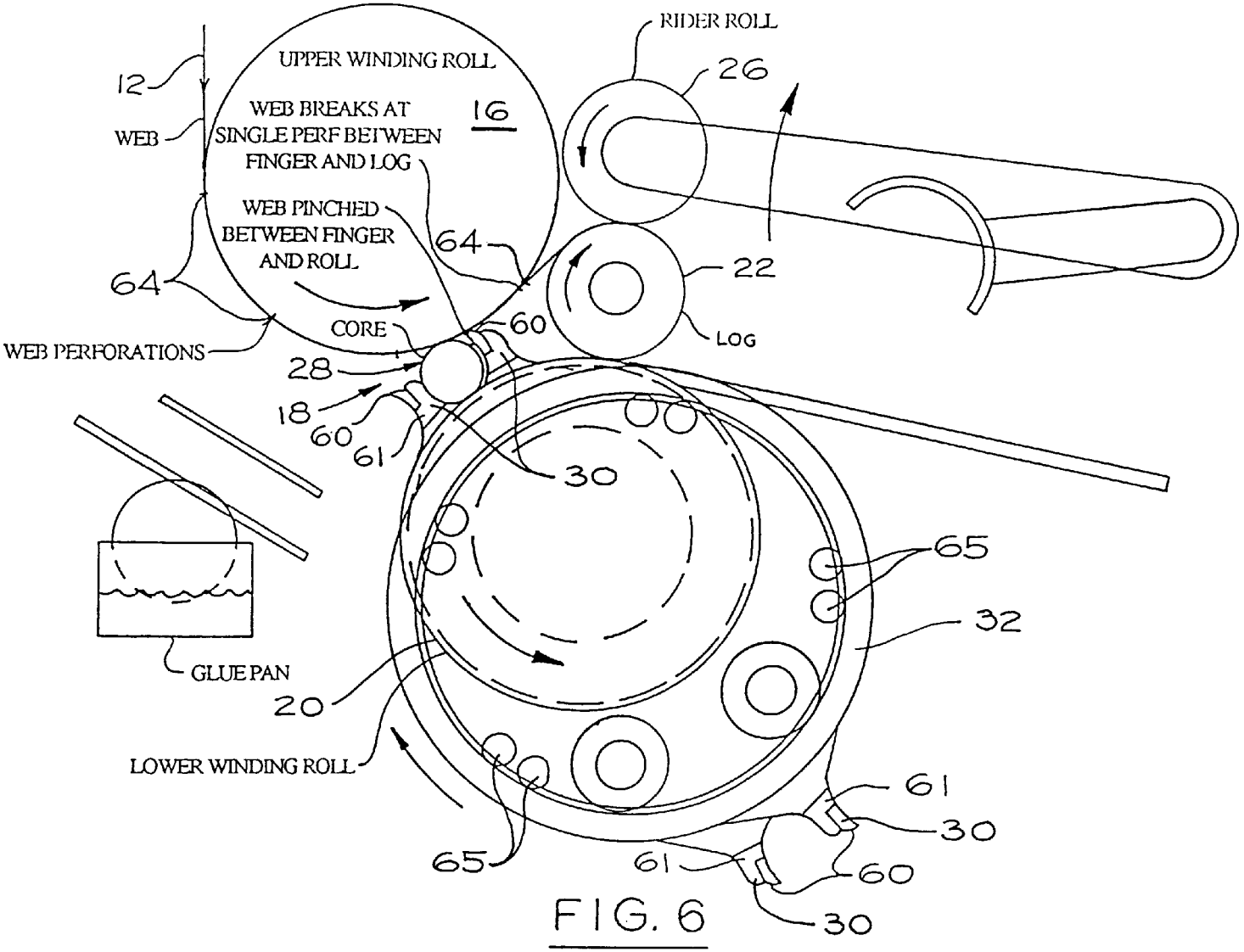
FIG. 6 shows an enlarged side view of the rewinder shown in FIGS. 1–5 during web separation.

Referring now to FIG. 6, a resilient tip 60 on the winding control finger 30 ahead of the core 28 pinches the web 12 between the winding control finger 30 and the upper winding roll 16 at the nip 56 between the two winding rolls 16, 20. The tip 60 can comprise a variety of resilient or rigid materials and be mounted to a base of the winding control finger 30 in various ways. Preferably, the tip 60 comprises polyurethane having a durometer of between sixty and one hundred, and is held adjacent a metal base 61 with a metal tab 63 as best shown in FIG. 4A. Alternatively, the tip 60 can be conventionally mounted directly to the base 61 or even serve as the entire winding control finger 30, provided a sufficiently durable material is used. In another preferred embodiment, the tip 60 is spring mounted to provide resilience. The preferred resilient nature of the tip 60 enables tolerances for the interference between the upper winding roll 16 and the tip 60 to be looser while maintaining product quality and performance.

The interference between the upper roll 16 and the tip 60 can be adjusted in a variety of ways. One preferred adjustment method includes resiliently mounting the rings 32 to compensate for the rings 32 not being perfectly round. Preferably, two support rollers 65 which do not bear a majority of the weight of the ring 32 are resiliently mounted, while one or more primary load bearing support rollers 66 are fixed. While a variety of ring system supports can be used to mount the support rollers 65, 66, preferably a yoke-shaped ring system support 67 is used as shown in FIG. 2. Alternatively, a control system can adjust the interference by varying the ring 32 location in various ways such as moving one or more of the support rollers 65, 66 or a base 69 supporting the support rollers 65, 66. This system can automatically or manually adjust the interference (primarily radially) to compensate for wear of the tips 60.

The winding control finger 30 is preferably timed to contact the web 12 at a position between perforations 64. At the point of contact with the winding control finger 30, the web 12 slows to the winding control finger 30 speed, and slips on the upper winding roll 16 due to the high coefficient of friction between the winding control finger 30 and the web 12. Tension in the web 12 between the winding control finger 30 and the log 22 increases above the tensile strength of the perforation 64 in the web 12. Because the winding control finger 30 is so close to the log 22 when the winding control finger 30 contacts the web 12, only one perforation 64 exists between the winding control finger 30 and the nip 56 between the log 22 and the rider roll 26. This single perforation 64 in this area of high tension assures that the web 12 will separate on the desired perforation 64 as compared to winders that must locate several perforations 64 in this area. This highly controlled separation of the web 12 assures that each log 22 has the desired number of sheets, substantially reducing costs of surplus sheets commonly required by prior art devices.

The width of the nip 56 between the winding rolls 16, 20 is preferably set just smaller than the diameter of the core 28 so that the core 28 contacts both winding rolls 16, 20 just as the leading winding control finger 30 pinches the web 12 against the upper winding roll 16. At this point, the core 28 is trapped on all sides with winding rolls 16,20 above and below the core 28 and winding control fingers 30 ahead and behind the core 28.

By trapping the core 28 on all four sides as the core 28 first contacts the surface of the winding rolls 16, 20, the core 28 is positioned straight and in-line with the winding rolls 16, 20 even if the core 28 was not straight to begin with. This solves a problem with prior art rewinders which commonly start the core 28 misaligned due to a lack of control on the fourth side of the core 28.

Slack in the web 12 develops in the small space between the winding control finger 30 ahead of the core 28 and at the core 28 itself. The slack is created because the core 28 is now rotating between the upper and lower winding rolls 16, 20 and driving the web 12 at the surface speed of the upper winding roll 16, and the winding control finger 30 is reducing the speed of the web 12 just in front of the core 28. The slack web 12 is now forced to follow the only path open to it, which is down toward the lower winding roll 20 between the core 28 and the winding control finger 30.

Figure 7:
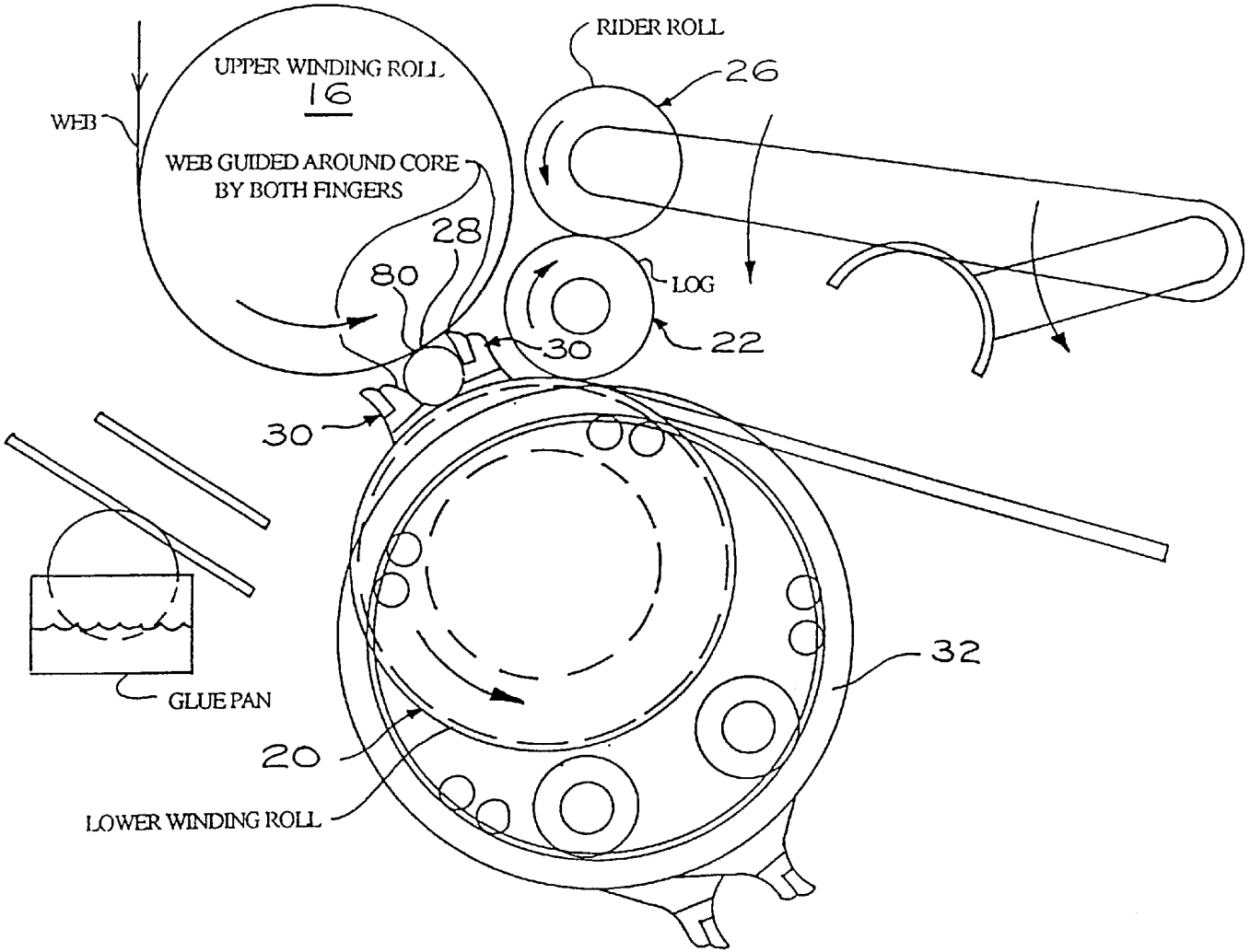
FIG. 7 illustrates an enlarged side view of the rewinder shown in FIGS. 1–6 just after web separation.

Referring now to FIG. 7, when the slack web 12 contacts the lower winding roll 20, its rotation forces the web 12 back between the core 28 and the lower winding roll 20. The winding control finger 30 ahead of the core 28 is now moving past the narrowest point in the throat 18. Contact between the tip 60 of the winding control finger 30 and the upper winding roll 16 now ceases and the end of the web 12 can now be pulled back under the core 28. As the web 12 passes back between the core 28 and the lower winding roll 20, it will contact the winding control finger 30 following the core 28 and be directed back up toward the area between the core 28 and the upper winding roll 16 to start the winding process. This process of starting the web 12 around the core 28 is made more reliable by the way the core 28 is trapped by the winding control fingers 30 and the way the winding control fingers 30 guide the web 12 around the core 28. The present invention will work without transfer adhesive 80 on the core 28. However, a higher maximum rewinding speed can be achieved by depositing a line of conventional adhesive 80 along the length of the core 28, rings of adhesive 80 on the circumference of the core 28 or other conventional adhesive configurations.

Figure 8:
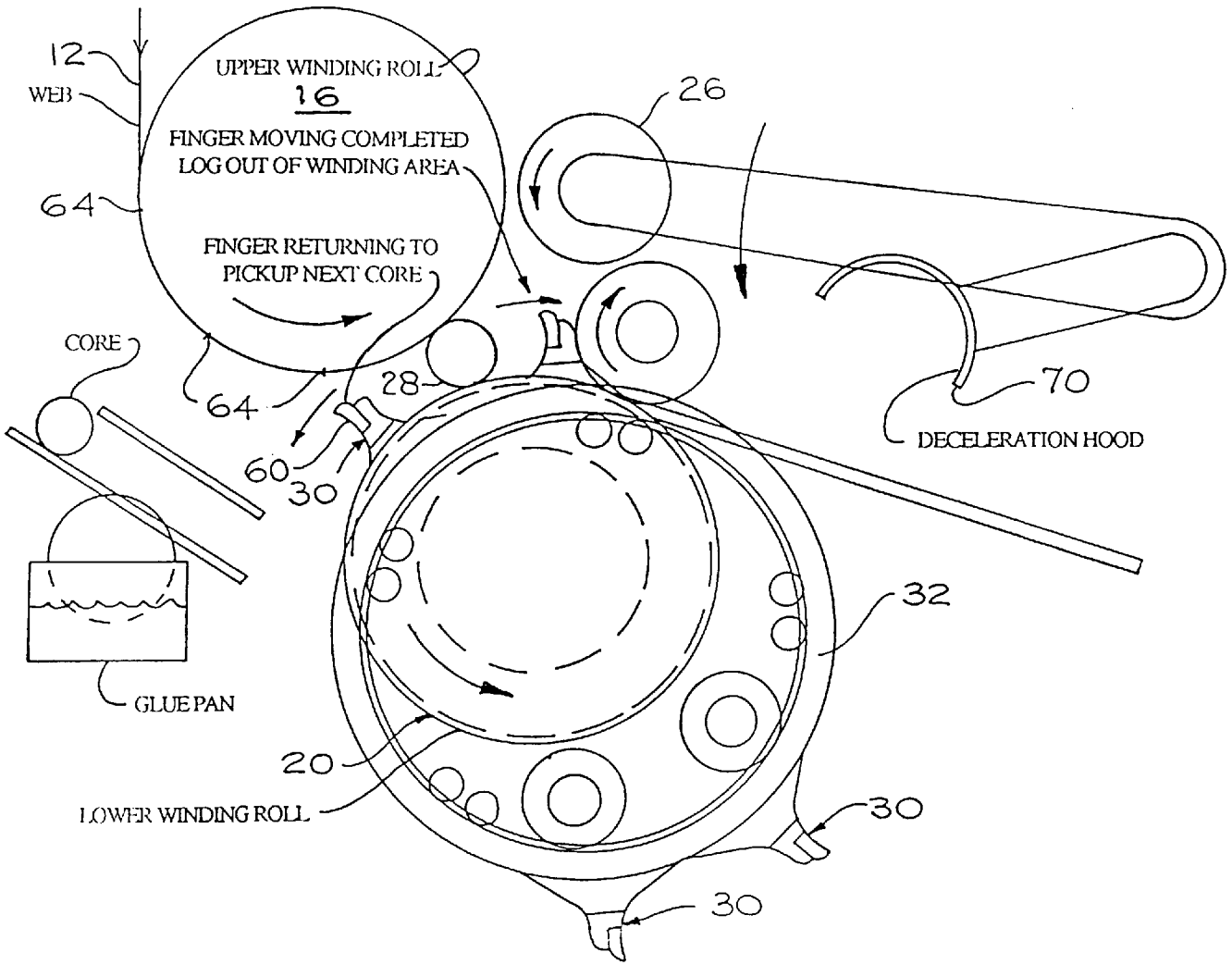
FIG. 8 shows an enlarged side view of the rewinder shown in FIGS. 1–7 after a new log has started rewinding and a wound log is being removed from the rewinding station by a winding control finger.

Referring now to FIG. 8, it is common practice in bathroom tissue and kitchen towel winding to run product as soft (low density) as possible at as high a speed as possible. The soft log 22 rotating at a high speed is unstable and its behavior is unpredictable when released from a conventional three-roll winding cradle. In prior rewinders, the maximum speed that the soft products can run is often limited by this unpredictable behavior of the log 22 as it exits the rewinder 10. In the present invention, this control problem is solved by the winding control finger 30 which is positively located between the new core 28 and the completed log 22. The winding control finger 30 continues through the throat 18 between the winding rolls 16, 20, contacts the completed log 22 and then guides the completed log 22 out of the three-roll cradle 24 and into a suitable conventional deceleration device 70.

Around this point in time, the web 12 is wrapping the new core 28 in the throat 18 between the winding rolls 16, 20 and the diameter of the new log 22 is increasing. To prevent crushing the core 28, the lower winding roll 20 can be slowed down momentarily to move the core 28 through the throat 18 between the winding rolls 16, 20 toward the cradle 24. Because the winding control finger 30 moves the completed log 22 out of the three-roll cradle 24 rapidly, the rider roll 26 can quickly move down toward the log 22 emerging from the throat 18 between the winding rolls 16, 20 (see FIG. 9). This minimizes the time the log 22 is balancing between the upper winding roll 16 and lower winding roll 20 by quickly getting the log 22 into the three-roll cradle 24. By reducing the time the log 22 is balanced between winding rolls 16, 20 and increasing the time the log 22 is in the three-roll cradle 24, the log 22 is better controlled and the speed change in the lower winding roll 20 is less critical than in previous rewinders.

Figure 9:
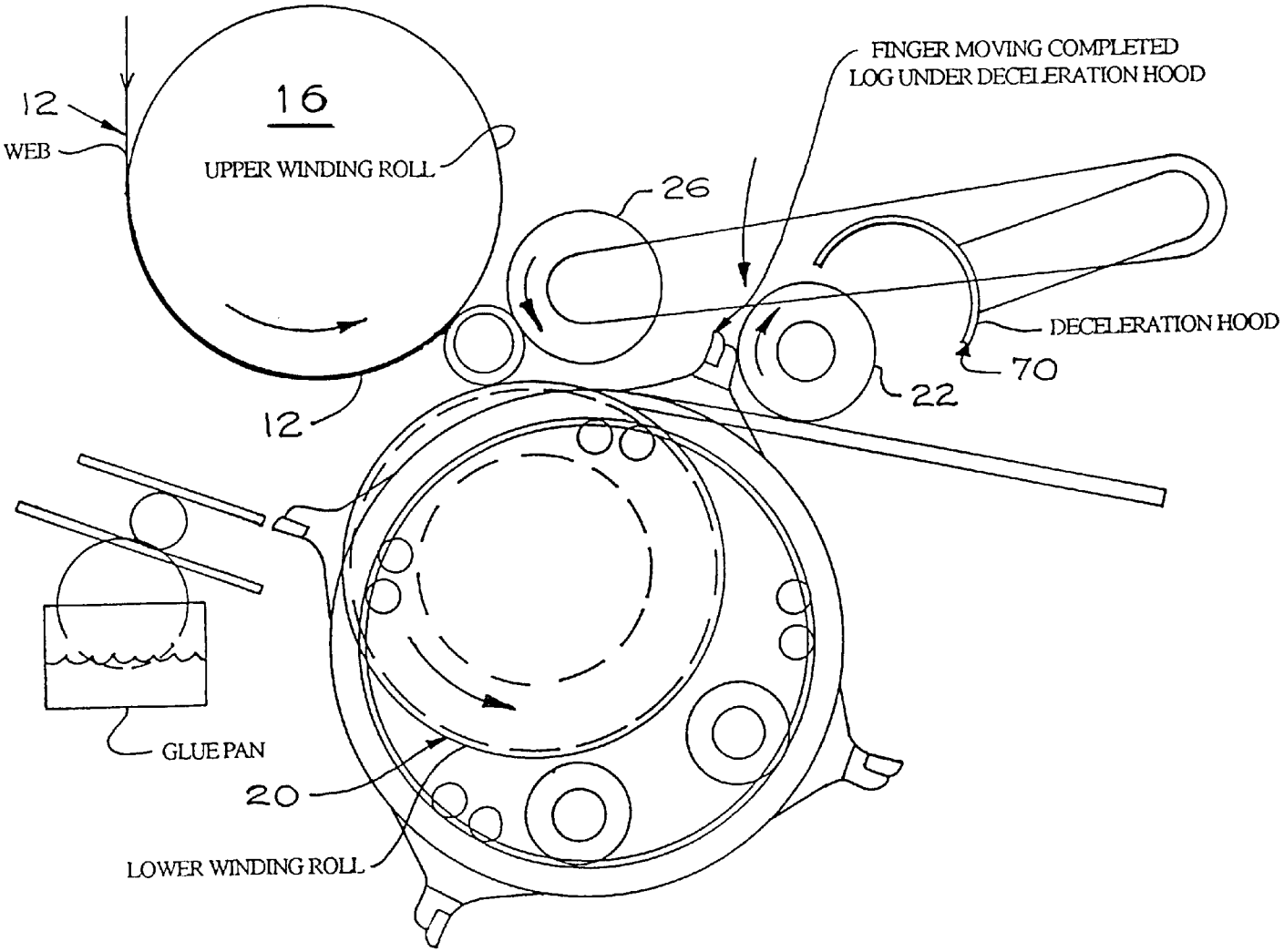
FIG. 9 illustrates an enlarged side view of the rewinder shown in FIGS. 1–8 rewinding the new log and moving the wound log under a deceleration hood with a winding control finger.
Figure 10:
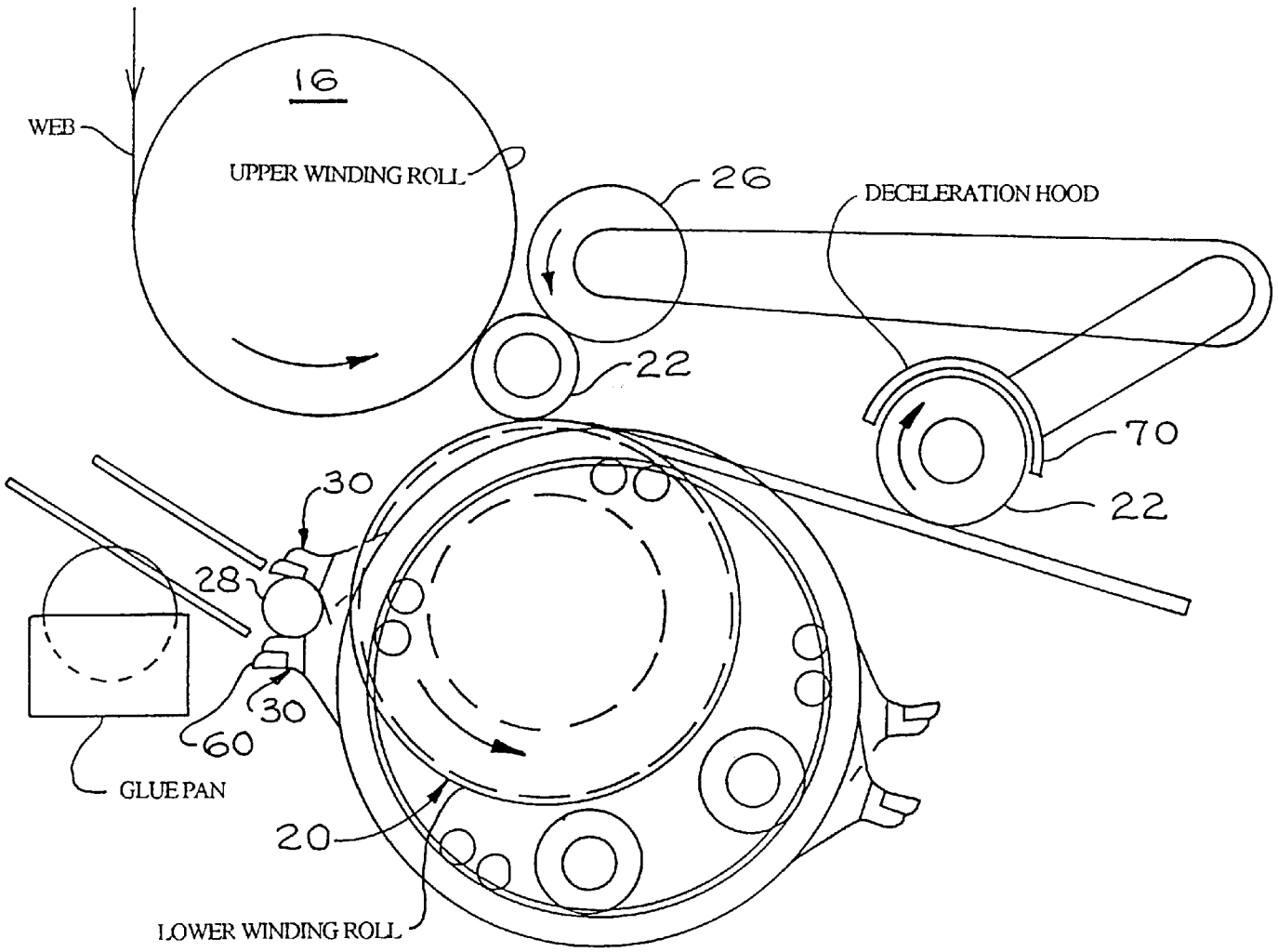
FIG. 10 shows an enlarged side view of the rewinder shown in FIGS. 1–9 preparing a new core for rewinding, winding a log and decelerating a wound log in a step of the process just prior to the step shown in FIG. 5.
Figure 11:
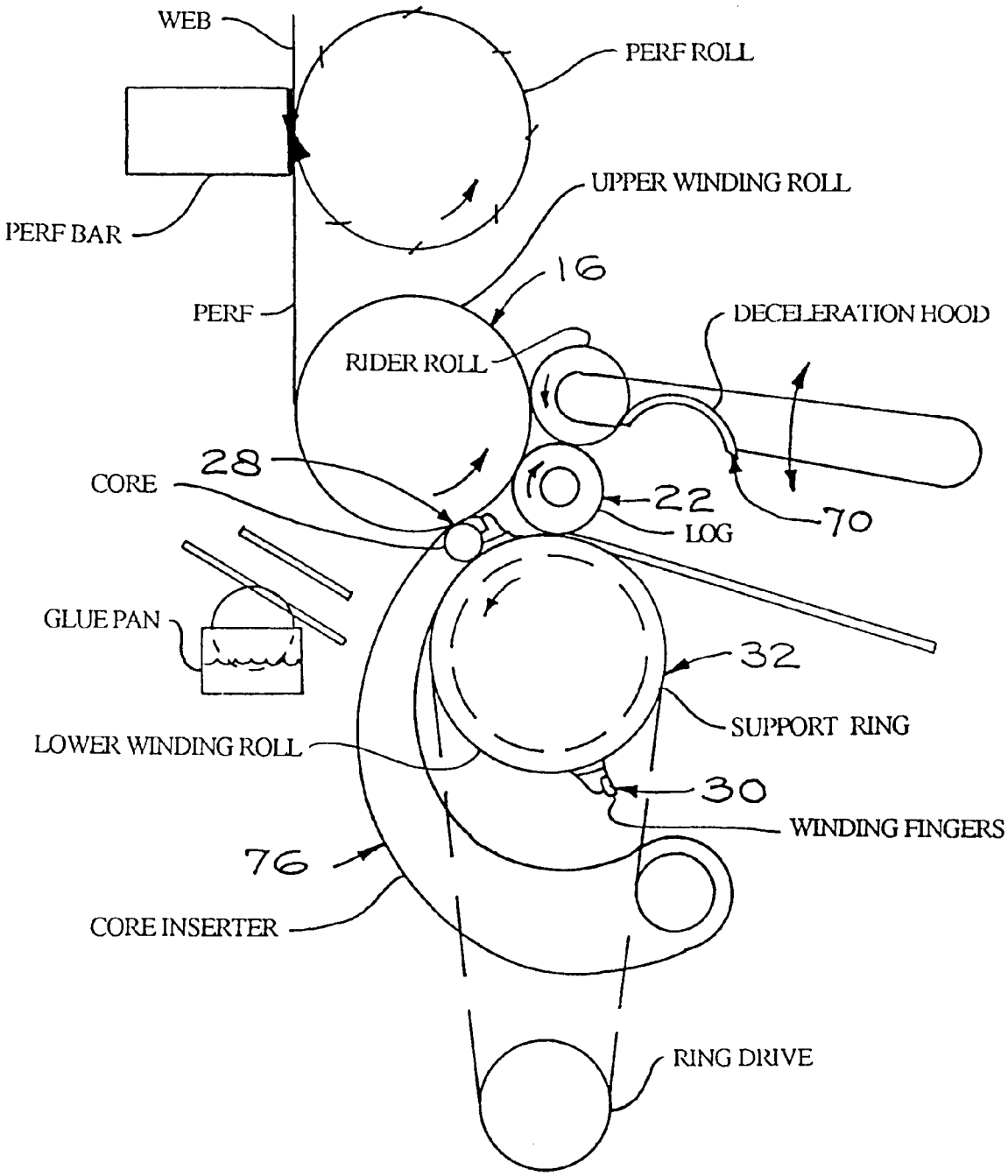
FIG. 11 illustrates a side view of an alternative embodiment of the invention using one winding control finger to separate the web and a core insertion device inserting cores.
Figure 12:
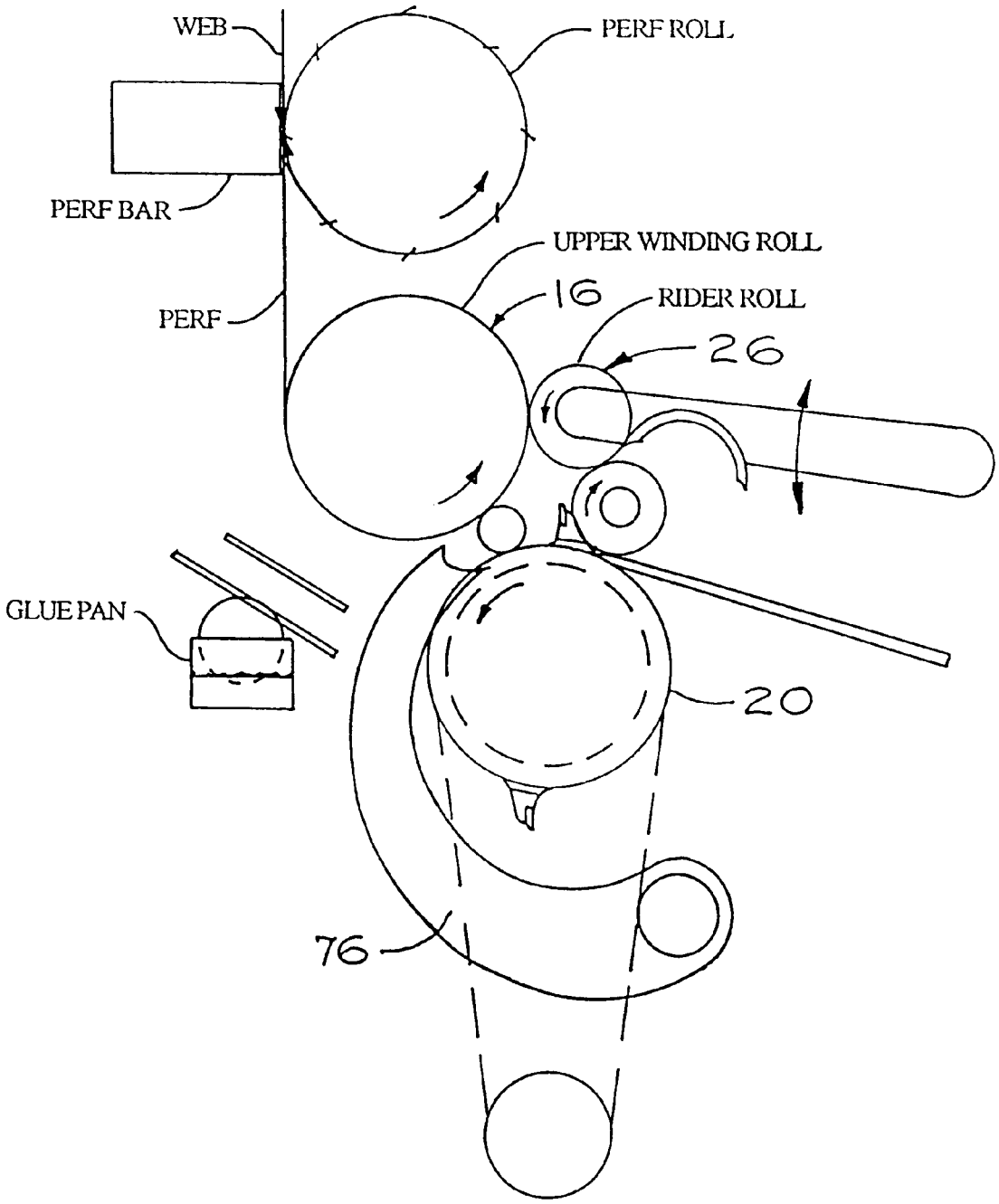
FIG. 12 shows a side view of the rewinder shown in FIG. 11 after core insertion.
Figure 13:
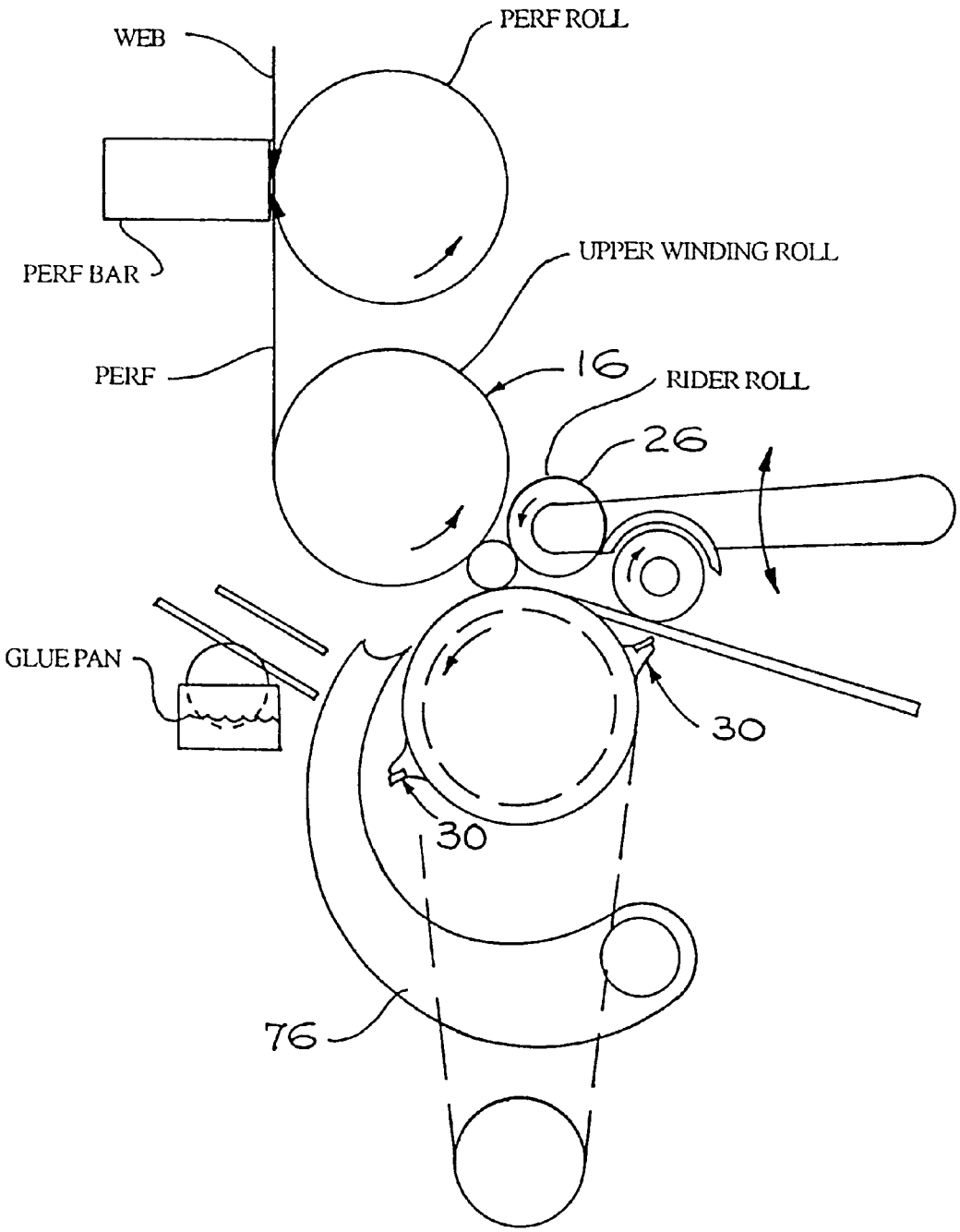
FIG. 13 illustrates a side view of the rewinder shown in FIGS. 11 and 12 after rewinding has started on the new core.
Figure 14:
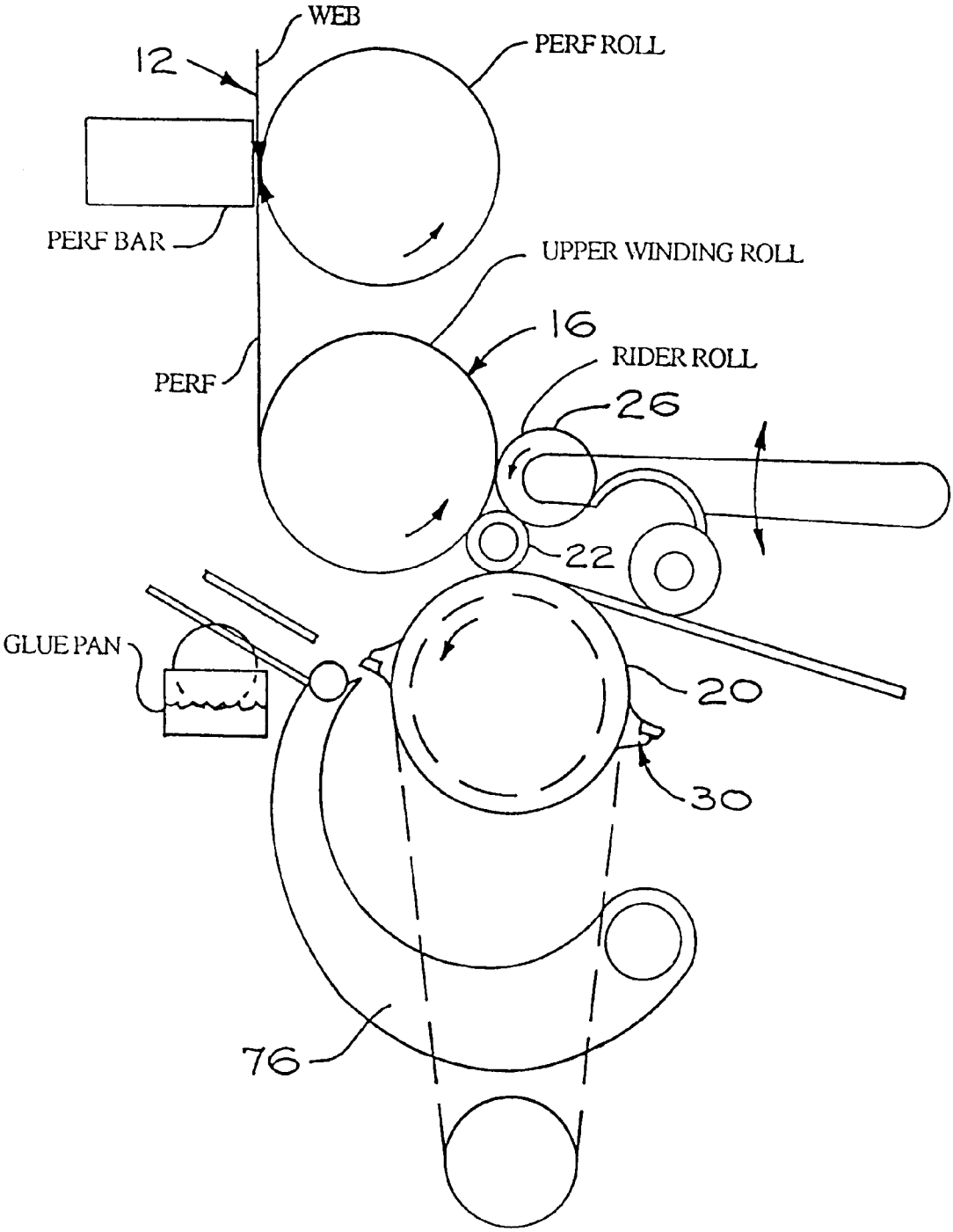
FIG. 14 shows a side view of the release of a wound log from the rewinder shown in FIGS. 11–13.
Figure 15:
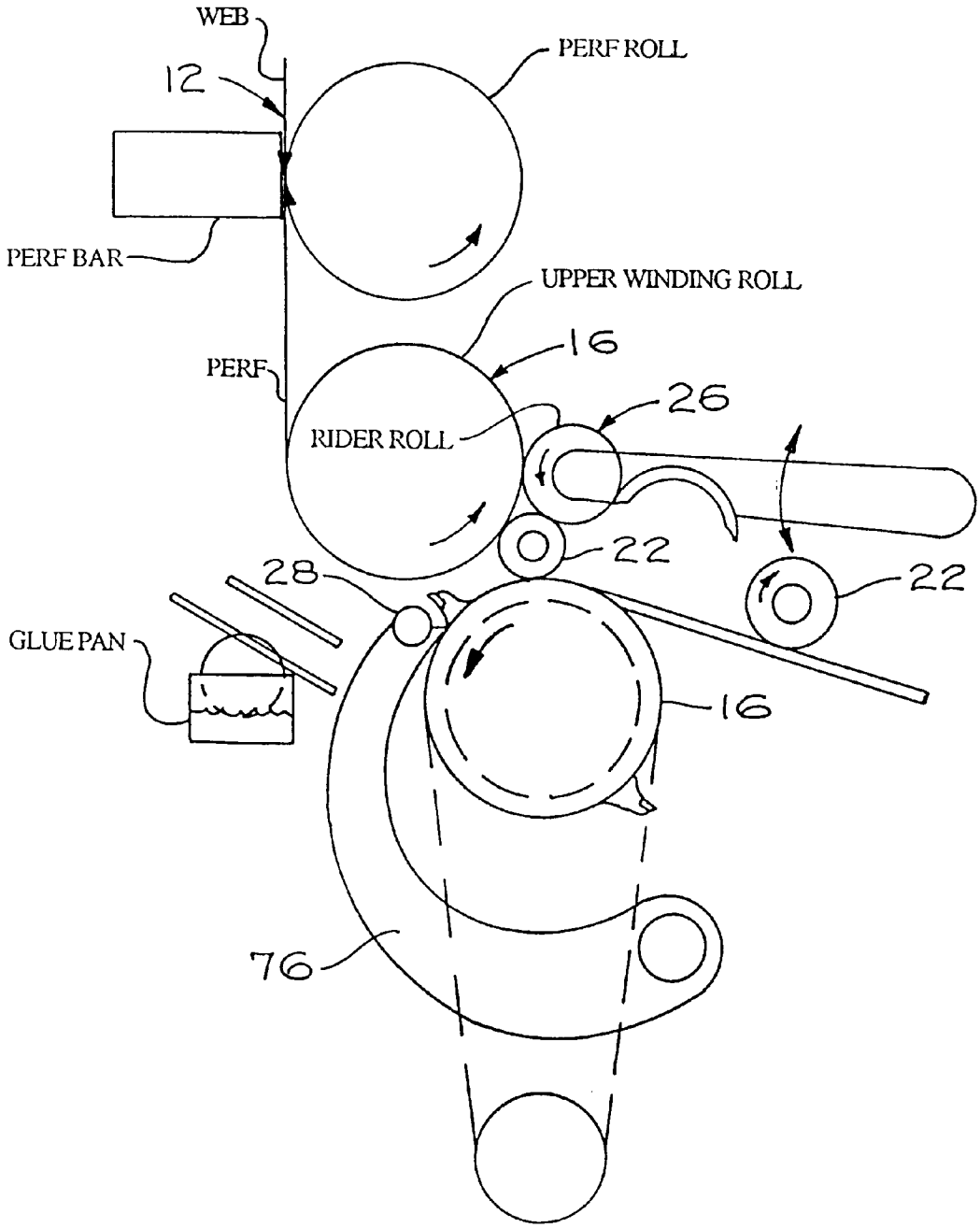
FIG. 15 illustrates a side view of the rewinder shown in FIGS. 11–14 in a step of the process just prior to the step shown in FIG. 11.

The winding control finger 30 that was behind the core 28 in FIG. 7 preferably has reversed direction in FIG. 8 and has moved down to the point at which a new core 28 is picked up as shown in FIGS. 9 and 10. Alternatively, another winding control finger 30 can pick up a new core 28.

Referring now to FIG. 10, the winding control finger 30 which was guiding the completed log 22 to the deceleration device 70 has completed its cycle in the winding process. The winding control finger 30 continues to move until the winding control finger 30 mounted about 180 degrees from the first on the same support ring 32 is in place at the core pick-up point to receive the next core 28. When the core 28 arrives, two sets of winding control fingers 30 squeeze the core 30 and move the core 30 toward the nip 56 between the winding rolls 16, 20 which completes the steps of the process. After this step, the process can continue starting with the step shown in FIG. 5.

Another preferred embodiment of the invention includes a rewinder 10 with a single set of winding control fingers 30 and a core insert arm 76 as shown in FIGS. 11–15. The embodiment has the advantage of half the number of winding control fingers 30 and rings 32, but requires a separate core insert mechanism which is more complex than the winding control finger systems.

Figure 16:
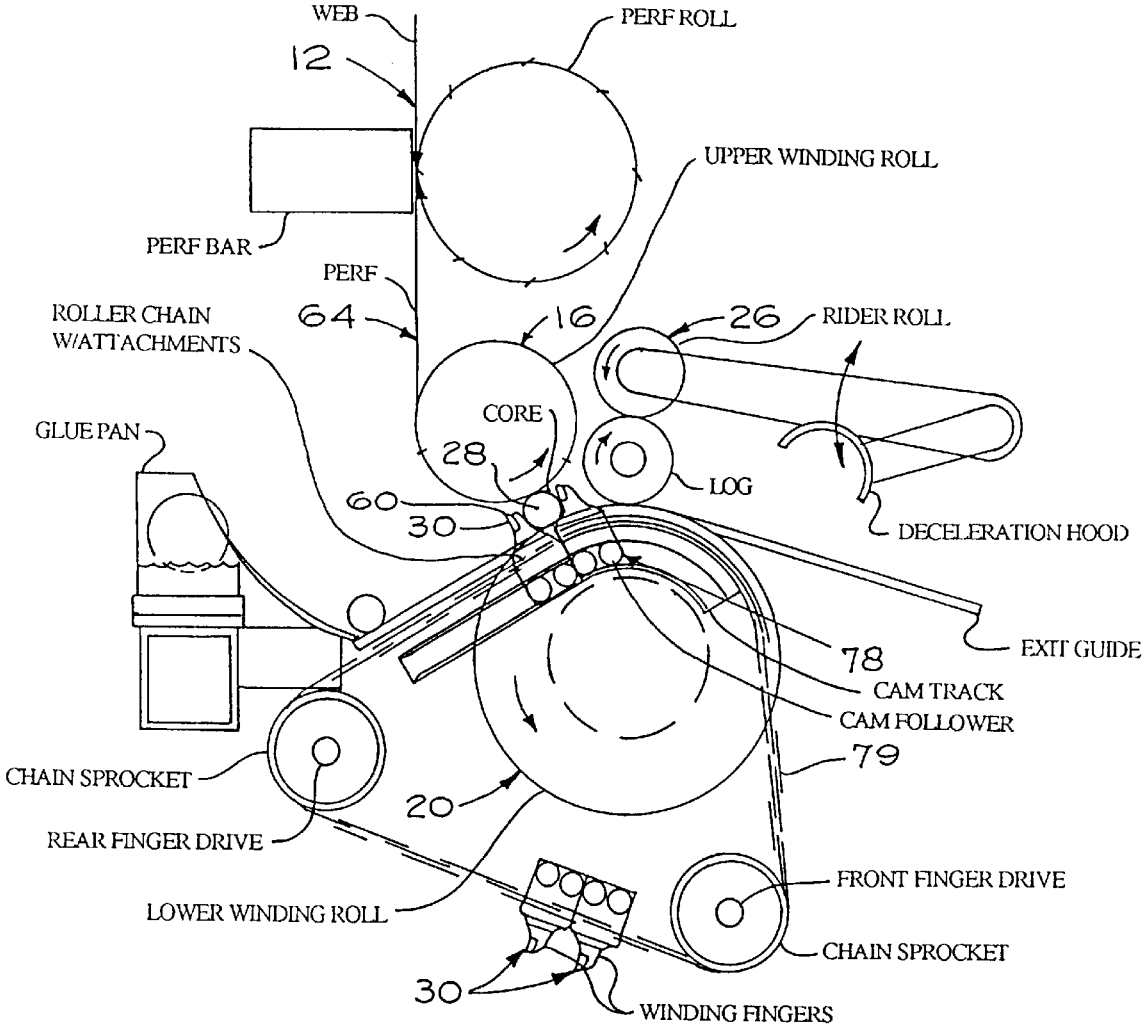
FIG. 16 shows another alternative embodiment of the invention using roller chain to carry winding control fingers.

FIG. 16 shows a rewinder 10 with a system of winding control fingers 30 mounted on a cam follower 78 and driven by roller chains 79. This concept has the advantage over the ring-based design of ease of installation and removal of the winding control finger system, but the significant disadvantage of high maintenance associated with the chains 79 and cam followers 78.

In another preferred embodiment of the invention, an idler roll 84 above the upper winding roll 16 irons the web 12 down onto the upper winding roll 16 as shown in FIG. 2. The idler roll 84 is useful at high speeds to drive air out from between the web 12 and the upper winding roll 16. The idler roll 84 can also be used to sense tension in the web 12. The web tension signal can feed a tension control system 86 which adjusts the speed of a set of pull rolls 88 which are located above the conventional perforation station 14.

Other preferred embodiments of the invention include an upper winding roll 16 that is reduced in diameter to reduce the distance the core 28 needs to move as it passes through the nip 56 between the rolls 16, 20. The lower winding roll 20 can be increased in diameter to provide more room in the grooves 50 that the rings 32 ride in. This room is useful to allow the lower winding roll 20 to adjust to a larger range of core diameters without exposing the rings 32 in the cradle 24. The rings 32 were made larger to provide room for the ring support system 67.

A variety of methods and apparatus for supplying and gluing cores 28 can be used, although one method and apparatus is shown for illustrative purposes. The illustrated design significantly reduces the number of core handling parts common to these systems by using the winding control finger 30 to perform multiple functions.

In accordance with another preferred embodiment of the invention shown in FIGS. 17–20, the winding control finger rewinder 10 can be used to rewind coreless products reliably at high speeds. The rewinder 10 uses a number of mandrels 100 which cycle through the rewinder 10 and are returned by a mandrel handling system 102 to the starting point.

Figure 17A:
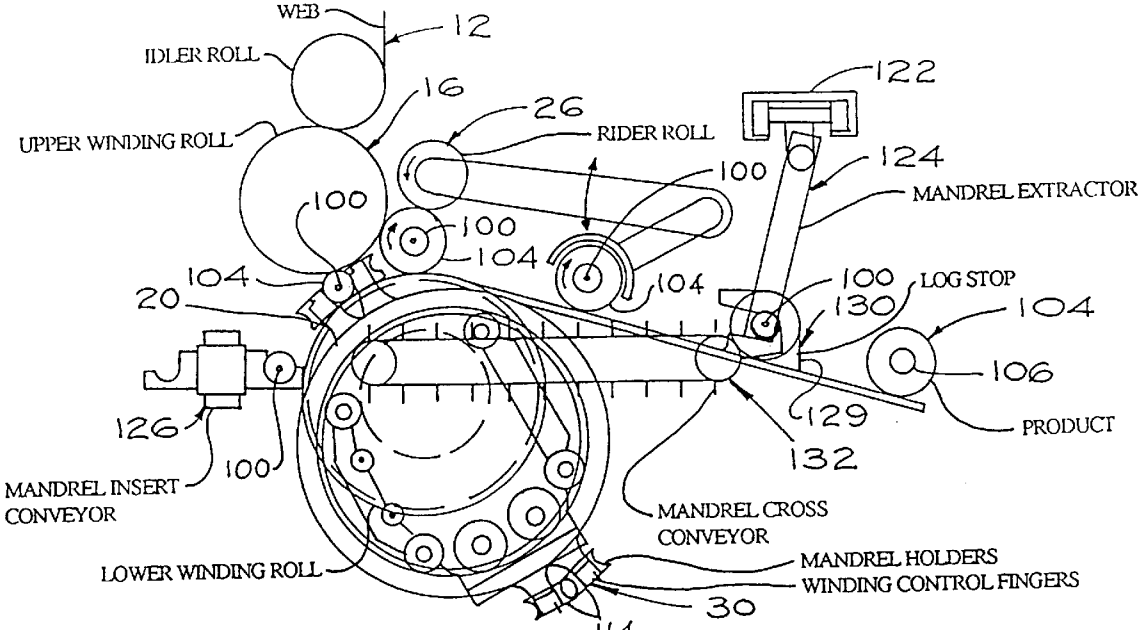
FIG. 17A illustrates a side view of an alternative embodiment of the invention for producing a coreless product.
Figure 17B:
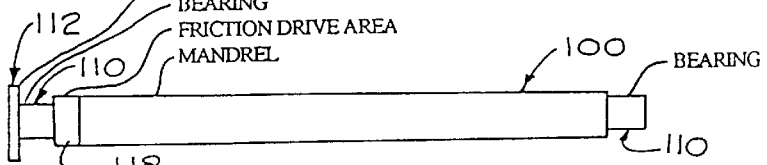
FIG. 17B shows a front view of a mandrel useful in this alternative embodiment.
Figure 17C:
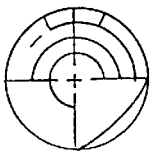
FIG. 17C illustrates an end view of the mandrel shown in FIG. 17B.

The coreless product 104 is wound on one of the mandrels 100 and then the mandrel 100 is removed from the center of the coreless product 104, leaving a hole 106 at the center. The center hole 106 ensures cordless product 104 compatibility with conventional wound product dispensers. Each mandrel 100 preferably includes a bearing 110 on each end as shown in FIG. 17B. The outside diameter of the bearings 110 is preferably less than the diameter of the mandrel 100. One end of the mandrel 100 preferably includes a flange 112 that is larger in diameter than the mandrel 100. The flange 112 is used to pull the mandrel 100 out of the coreless product 104.

The winding control fingers 30 include a mandrel bearing support 114 on each end. The mandrel bearing supports 114 interact with each other to trap the bearings 110 on the mandrel 100 and support the mandrel 100 with a small gap between the mandrel 100 and the winding control fingers 30. The nip 56 between the upper and lower winding rolls 16, 20 is dimensioned slightly larger than the diameter of the mandrel 100. The bearing supports 114 on the winding control fingers 30 also guide the mandrel 100 through the nip 56 centered between the winding rolls 16, 20. The mandrel 100 preferably includes a friction drive area 118 near the flange 112 (see FIG. 17B) that contacts the lower winding roll 20 just before the nip 56 and drives the mandrel 100 during mandrel insertion.

The tip 60 of the lead winding control finger 30 separates the web 12 as described previously for other preferred embodiments of the invention. The web 12 is trapped between the two winding rolls 16, 20 and the two winding control fingers 30. As the web 12 collects behind the lead winding control finger 30, it contacts the spinning mandrel 100 and wraps the mandrel 100 to start the winding process. The remainder of the winding process is similar to that of the rewinder 10 with a core 28 at the center.

The coreless product 104 stops at the mandrel extraction area 120 after leaving the deceleration device 70 of the rewinder 10. The mandrel 100 is pulled out of the coreless product 104 and outside of a machine frame 122 by a mandrel extractor 124. Once outside the frame 122, the mandrel 100 is picked up by a cross conveyor 132 that moves the mandrel 100 back to the area upstream of the lower winding roll 20. At this point, the mandrel 100 is moved back inside the frame 122 by the mandrel insert conveyor 126. The mandrel insert conveyor 126 holds the mandrel 100 in place for the winding control fingers 30 to pick up the mandrel 100 for insertion, completing the process for one mandrel 100. The rewinder 10 preferably uses five mandrels 100 at different stages in the winding process at all times.

Figure 18:
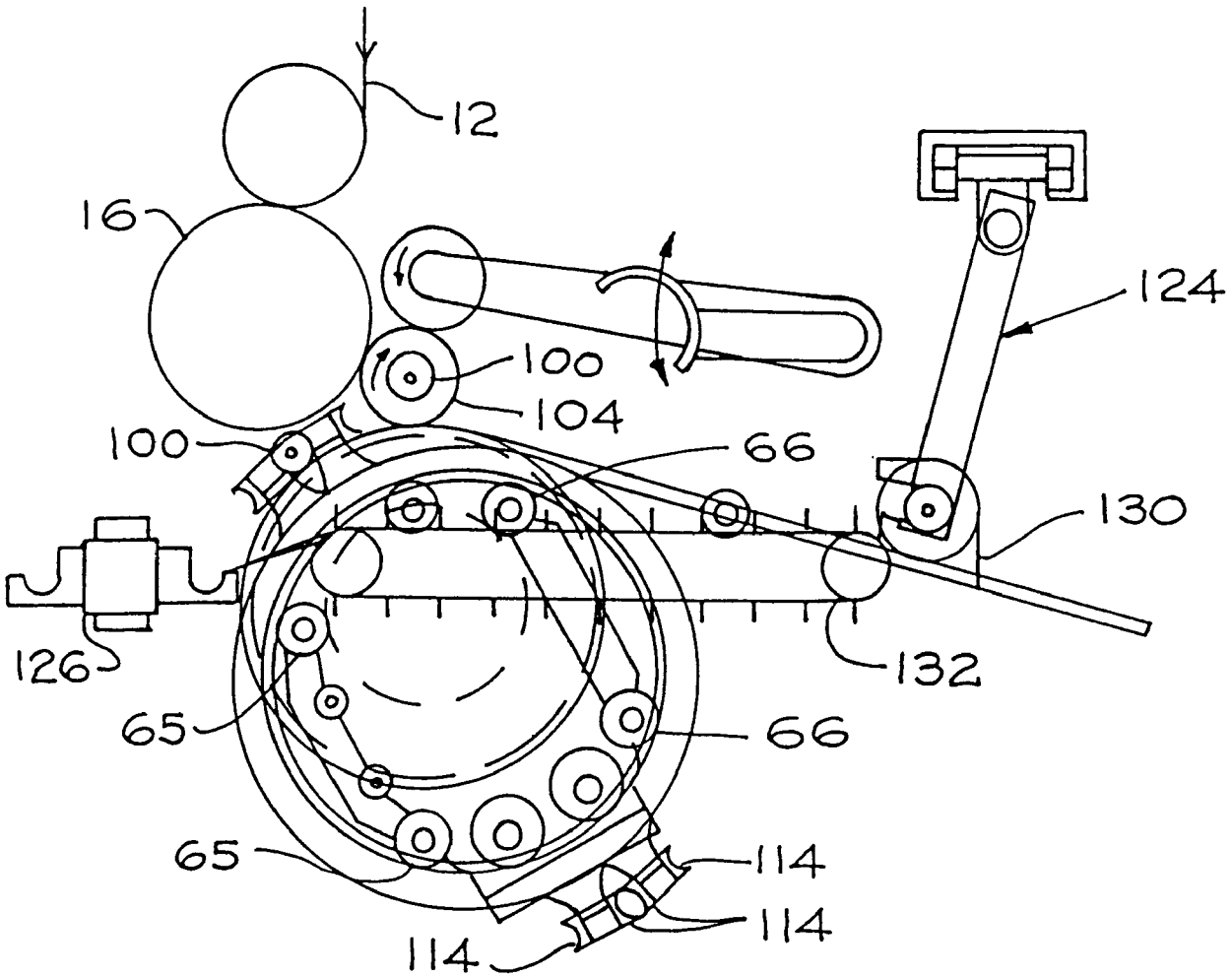
FIG. 18 shows a side view of the rewinder shown in FIG. 17 after mandrel insertion.

Referring to FIG. 18, one coreless product 104 is completing the winding process between the upper winding roll 16, the lower winding roll 20 and the rider roll 26. A mandrel 100 is about to be inserted into the nip 56 between the upper and lower winding rolls 16, 20 by the winding control fingers 30. A completed coreless product 104 and mandrel 100 are at the mandrel extractor 124. The coreless product 104 will be held by a log stop 129 as the mandrel extractor 124 pulls the mandrel 100 out of the coreless product 104 and outboard of the frame 122. Two mandrels 100 are on the cross conveyor 132 which moves the empty mandrels 100 from the mandrel extractor 124 back to the mandrel insert conveyor 126.

Figure 19:
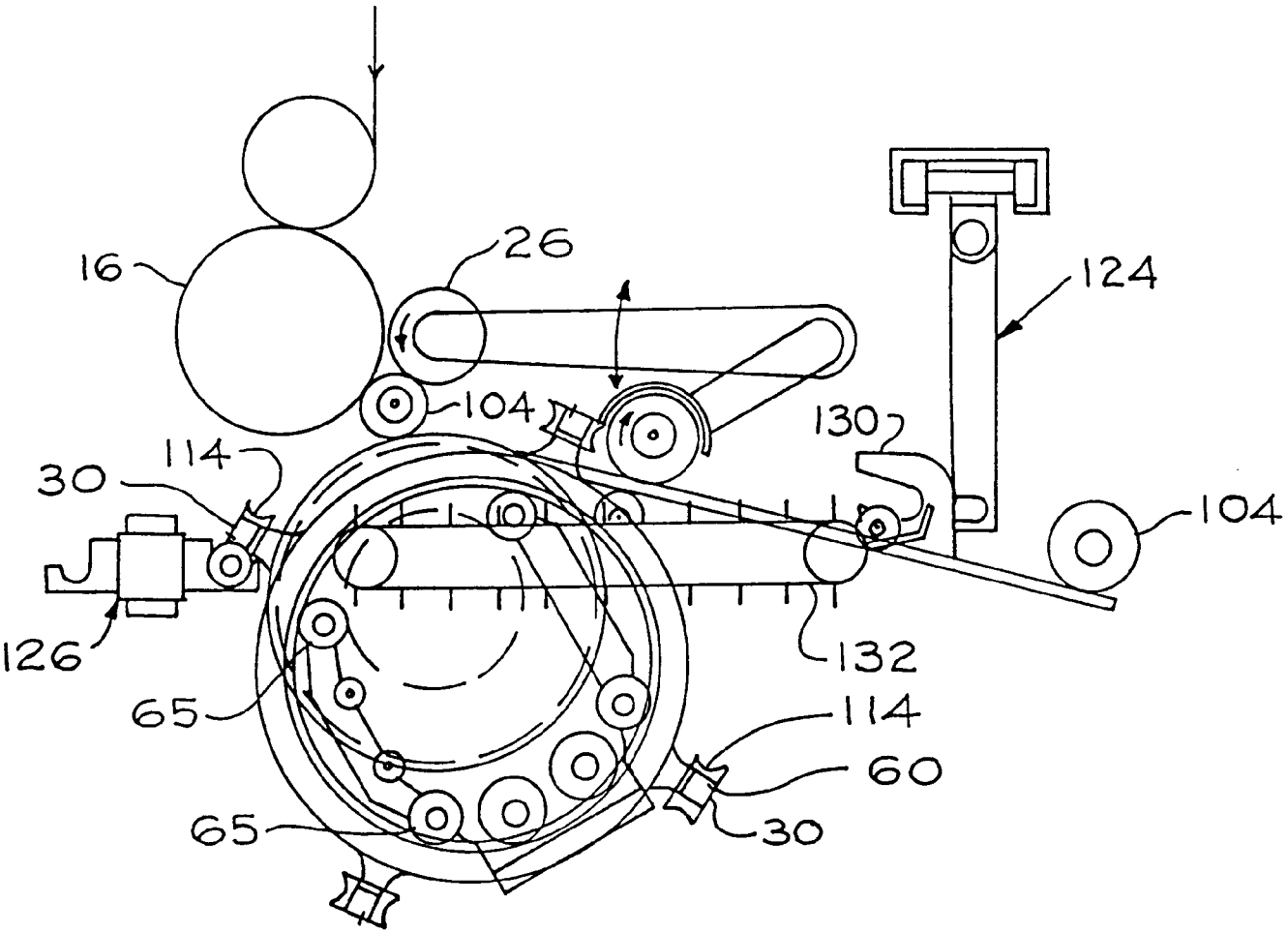
FIG. 19 illustrates a side view of the rewinder shown in FIG. 17 after rewinding has started on the new mandrel.

As shown in FIG. 19, the mandrel insert conveyor 126 is moving the mandrel 100 picked up off the cross conveyor 132 back inside the frame 122 and positioning the mandrel 100 for the winding control fingers 30 to pick it up. Another coreless product 104 is winding in the nip 56 between the two winding rolls 16, 20 and the rider roll 26. A completed coreless product 104 is in the deceleration area. The mandrel extractor 124 has completed pulling a mandrel 100 out of a coreless product 104 and left it for the cross conveyor 132 to pick up. One mandrel 100 is located on the cross conveyor 132 and a completed coreless product 104 is rolling out of the rewinder 10.

Figure 20:
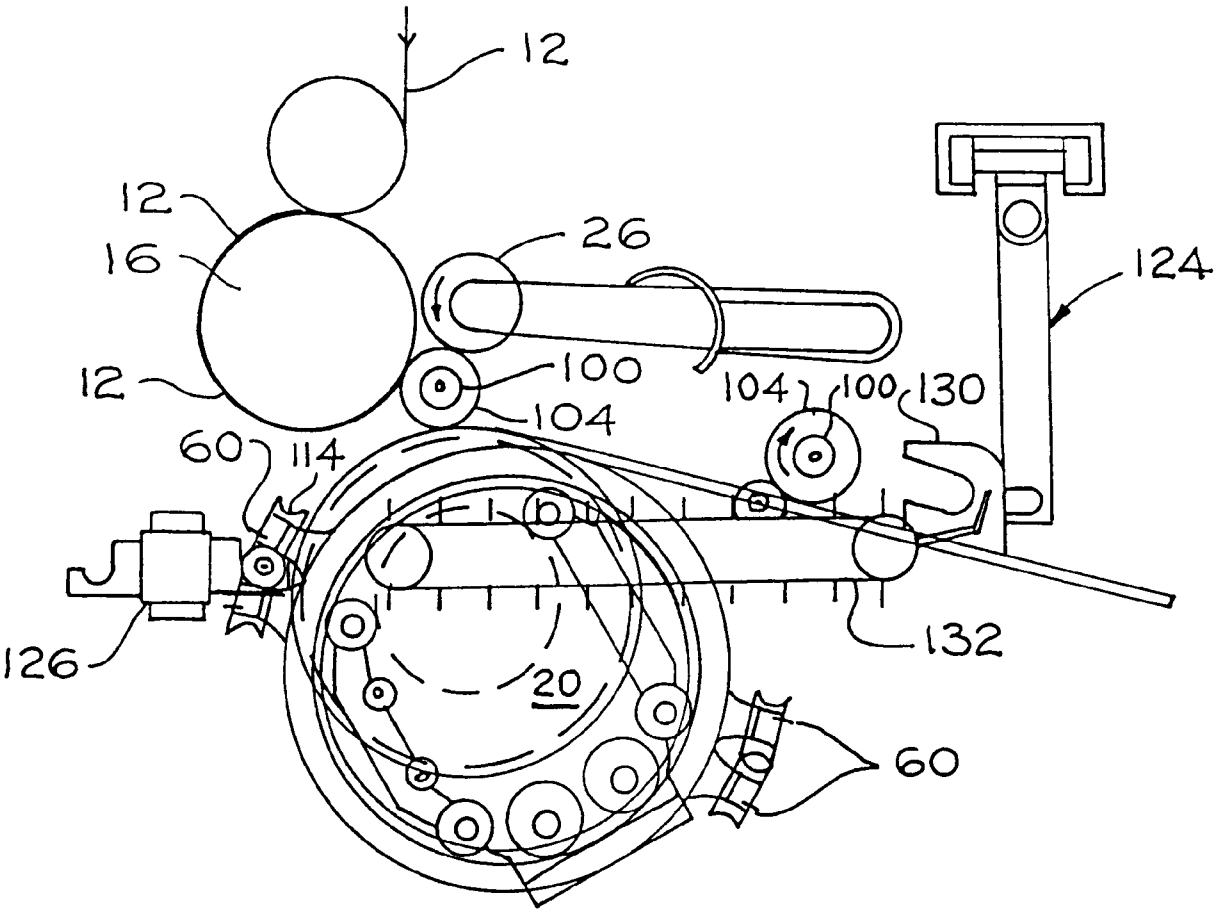
FIG. 20 shows a side view of the release of a wound log from the rewinder shown in FIG. 17.

Referring next to FIG. 20, a mandrel 100 is being taken off the mandrel insert conveyor 126 by the winding control fingers 30. A coreless product 104 is winding in the nip 56 between the upper winding roll 16, the lower winding roll 20 and the rider roll 26. A coreless product 104 is rolling from the deceleration device 70 to the log stop 129 to start the mandrel extraction process. Two mandrels 100 are on the cross conveyor 132.

Another method of producing coreless product 104 using mandrels 100 in rewinder 10 mounts the mandrels 100 permanently in the rewinder 10 on a ring, track or turret type system. The coreless product 104 is stripped off the mandrels 100 and moved out through the frame 122 while the mandrels 100 remain inside the frames 122. Empty mandrels 100 return to the insert area by passing under the lower winding roll 20.

Mandrel rewinders and systems of handling mandrels are well known to one of ordinary skill in the art. The illustrated preferred embodiment for rewinding coreless product 104 is unique in that it uses mandrels 100 without cores or glue in a continuous winding system based on the three roll surface winding concept. One reason this rewinder 10 is better at winding coreless product 104 than other winders is in the use of the winding control fingers 30 to control the mandrel insertion process. The two winding control fingers 30 and the upper and lower winding rolls 16, 20 trap the mandrel 100 on all sides. The bearing supports 114 on the winding control fingers 30 hold the mandrel 100 centered with a small gap between the winding control fingers 30 and the mandrel 100, and between the winding rolls 16, 20 and the mandrel 100. The contact between the friction drive area 118 on one end of the mandrel 100 and the lower winding roll 20 positively spins the mandrel 100 up to roll speed as the mandrel 100 reaches the nip 56. When the lead winding control finger 30 separates the web 12 just in front of the mandrel 100, the web 12 collects in the area over the mandrel 100 and contact is made between the spinning mandrel 100 and loose web 12. The web 12 follows the only path open to it and wraps the mandrel 100 to start the winding process. Other surface winder designs lack both the control and separation systems to effectively wind coreless product on mandrels reliably at very high speeds up to about 3,000 feet per minute.

EXAMPLE

The following is one illustrative example of rewinding bathroom tissue product on a core 28 using one preferred embodiment of the present invention:

PRODUCT SPECIFICATIONS: 280 sheet count, Roll L diameter 4.25", Core diameter 1.75" O.D., Sheet length 4.5", 105'/roll (log).

PRODUCTION SPEED: 3,000'/minute paper speed, 28.57 logs/minute.

EQUIPMENT GEOMETRY: 8" diameter upper winding roll 16. 4.5" diameter rider roll 26. 15" diameter lower winding roll 20. The nip 56 between the upper and lower winding rolls 16, 20 is adjustable from 1.375" to 2.25" by moving the lower winding roll 20. Other diameters of cores 28 can be used by moving both the lower winding roll 20 and the winding control fingers ring supports, and replacing the winding control fingers 30.

Figure 21:
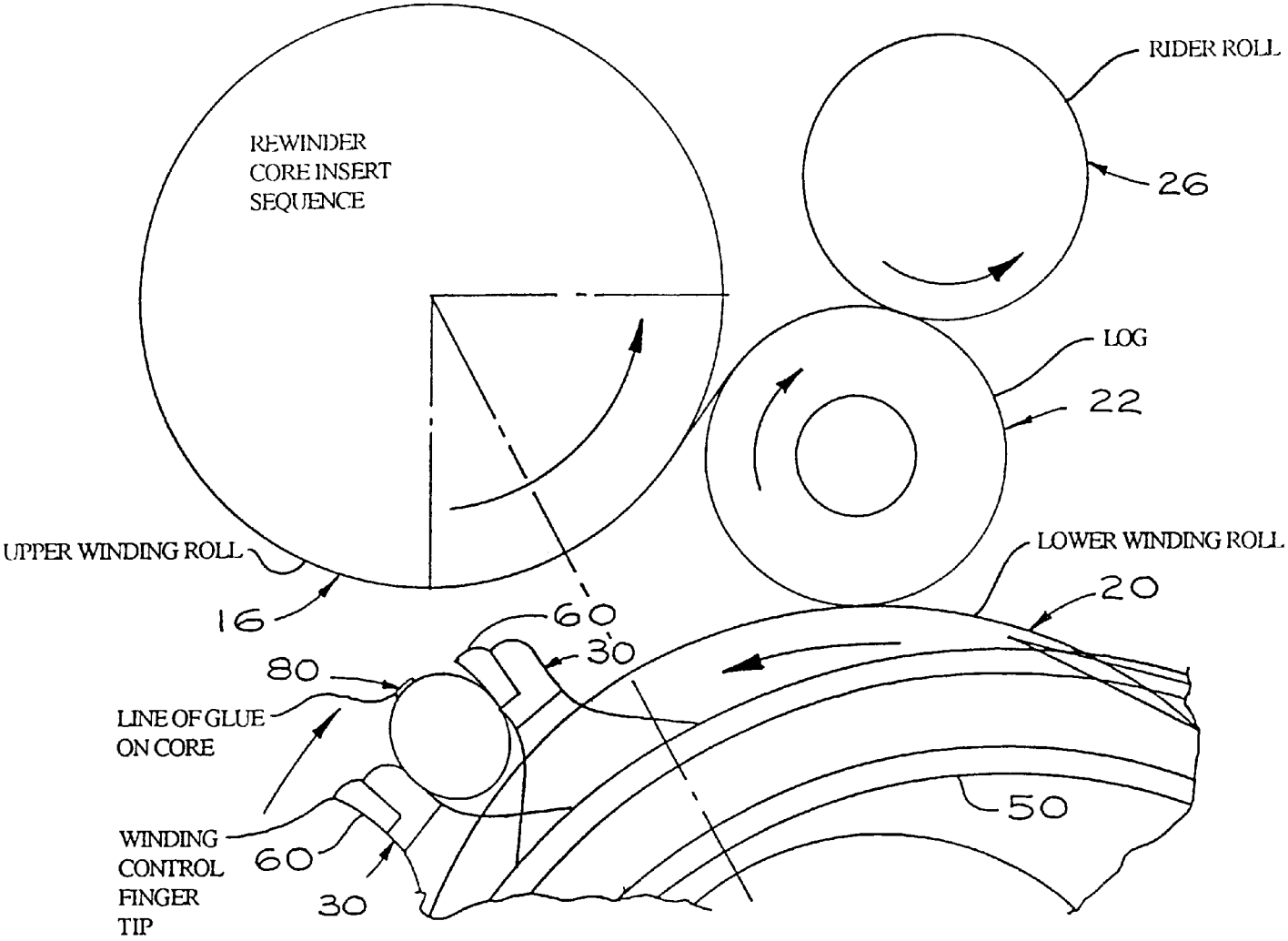
FIG. 21 illustrates an enlarged side view of the rewinder shown in FIGS. 1–10 squeezing and preparing a new core for rewinding and winding a log in accordance with the Example.

FIG. 21: The upper winding roll 16 has a constant surface speed of 3,000'/minute. The lower winding roll 20 has started a rapid deceleration from 3,000'/minute to 2,850'/minute. The core 28 is held between the two winding control fingers 30 by about 0.125" squeeze applied to the core 28 by the winding control fingers 30. The tips 60 of the winding control fingers 30 are moving toward the nip 56 between the winding rolls 16, 20 at 1,000'/minute. The tip 60 of the leading winding control finger 30 will interfere with the upper winding roll 16 by 0.031" over an arc of 1". The nip 56 between the upper and lower winding rolls 16, 20 is 0.062" smaller than the outside diameter of the core 28. The nearly completed log 22 will start to move away from the upper winding roll 16 as the lower winding roll 20 decelerates.

Figure 22:
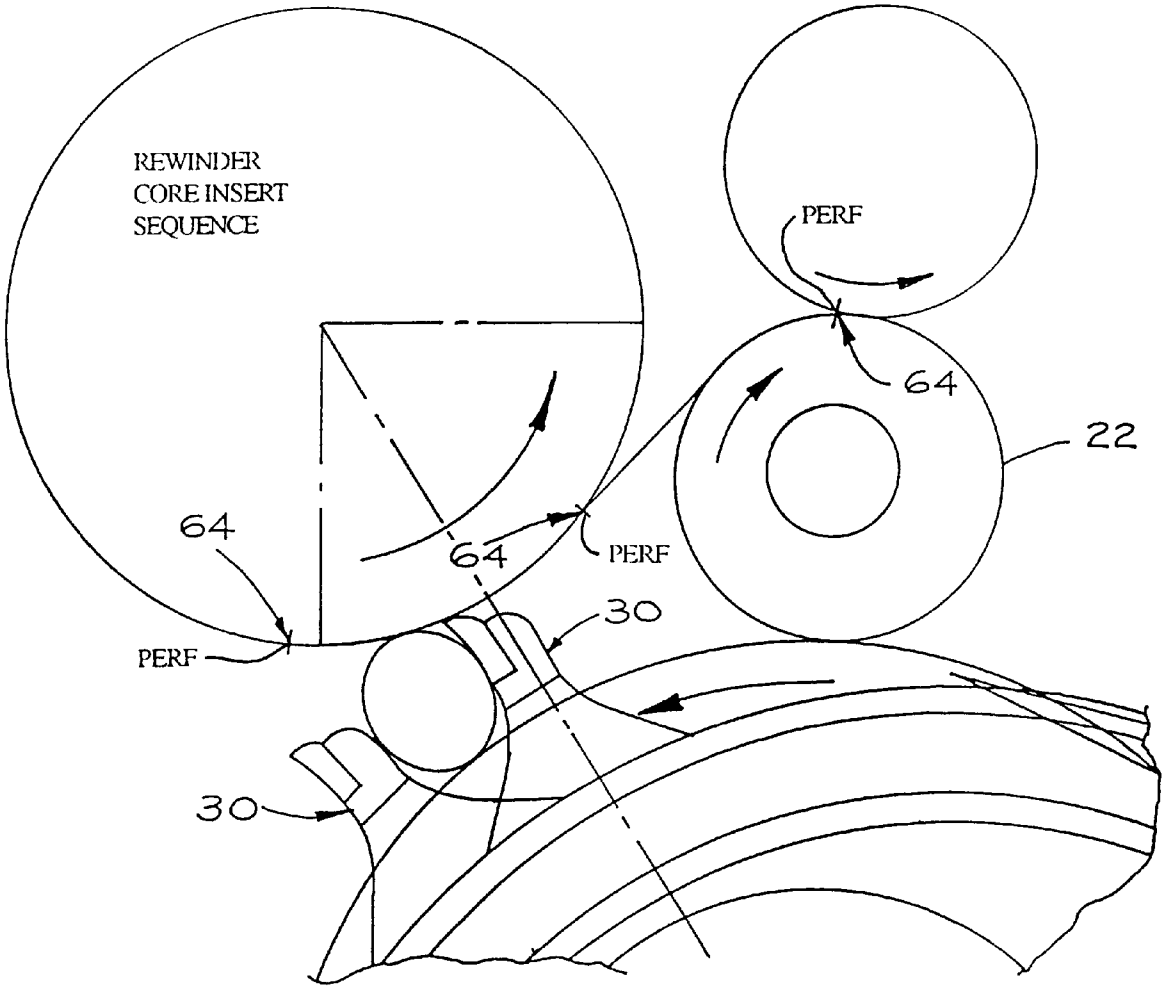
FIG. 22 shows an enlarged side view of the rewinder shown in FIG. 21 prior to web separation when a tip of a winding control has just contacted the upper winding roll and a glued area of the new core is beginning to contact the web.

FIG. 22: The tip 60 of the leading winding control finger 30 first contacts the web 12 on the upper winding roll 16 midway between two perforations 64. The point of contact is 0.5" before the center of the nip 56. The web 12 pinched between the tip 60 of the winding control finger 30 and the upper winding roll 16 will slow to the speed of the winding control finger 30. This slowing is primarily attributable to the higher coefficient of friction between the web 12 and the 75 durometer polyurethane tip 60 as compared to the web 12 and the 32 roughness average surface finish on the upper winding roll 16. The trailing winding control finger 30 rapidly decelerates to a stop as the core 28 is squeezed between the rolls 16, 20.

Figure 23:
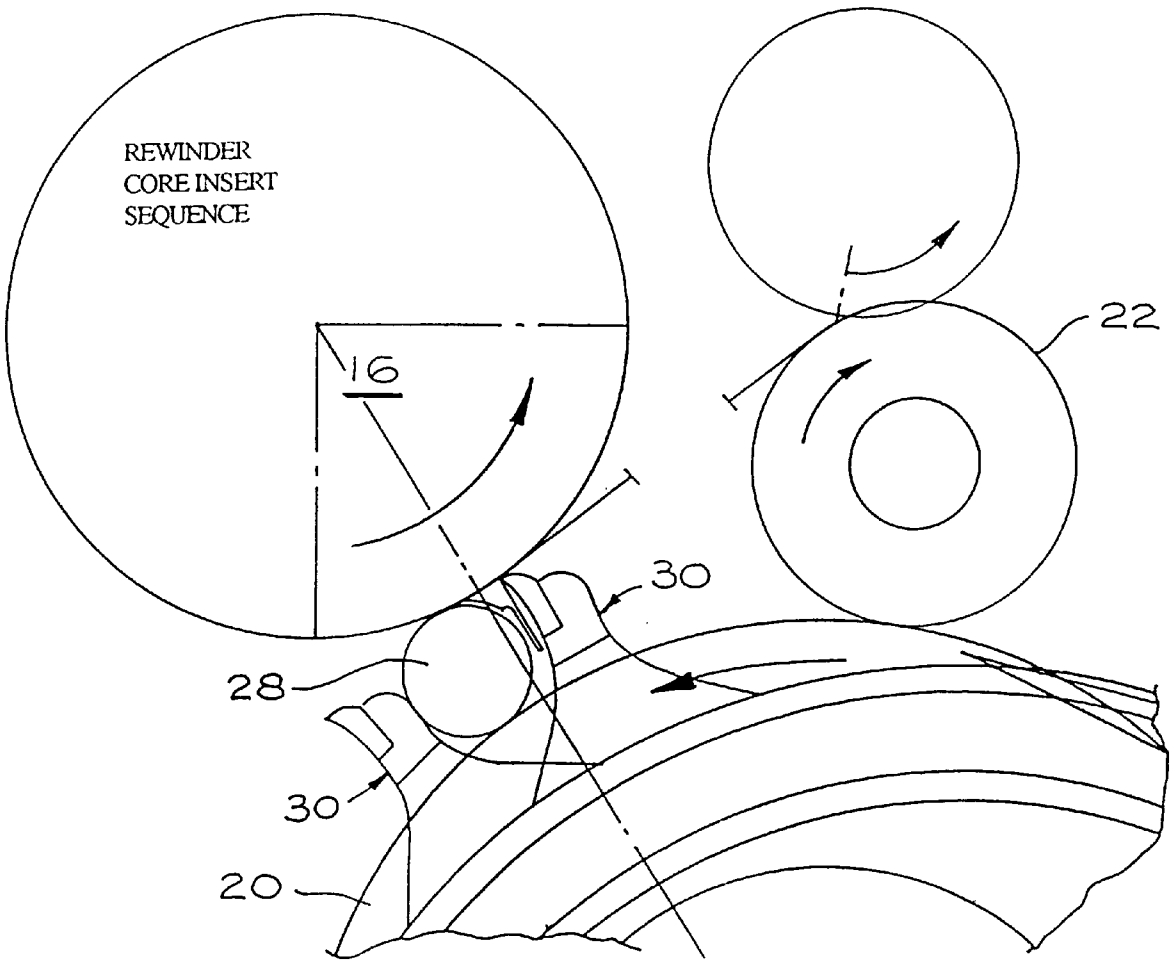
FIG. 23 shows an enlarged side view of the rewinder shown in FIG. 21 after web separation while the leading edge of the web is forming a loop between the core and the winding control finger.

FIG. 23: The tip 60 of the leading winding control finger 30 completes contact with the upper winding roll 16. The peripheral surface of the upper winding roll 16 has moved 3" as the web 12 at the tip 60 of the winding control finger 30 has only moved 1", resulting in 2 inches of web slippage. This slippage tears the web 12 at the one perforation 64 between the winding control finger 30 and the completed log 22. The core 28 is squeezed between the two rolls 16, 20 and is accelerated to 6500 rpm by contact with the rolls 16, 20 along the full length of the core 28. The core 28 will drive the web 12 ahead of it due to the squeeze between the core 28 and the upper winding roll 16. The extra 2" of web 12 will form a loop between the core 28 and the leading winding control finger 30. The combination of the shape of the winding control finger 30, the rotation of the core 28, and the glue attaching the web 12 to the core 28 will cause the web 12 to follow the core 28 down toward the nip 56 between the core 28 and the lower winding roll 20. The core 28 and the completed log 22 will move ahead at a rate of 15"/second due to the 30"/second (150'/minute) difference in surface speed between the upper and lower winding rolls 16, 20.

Figure 24:
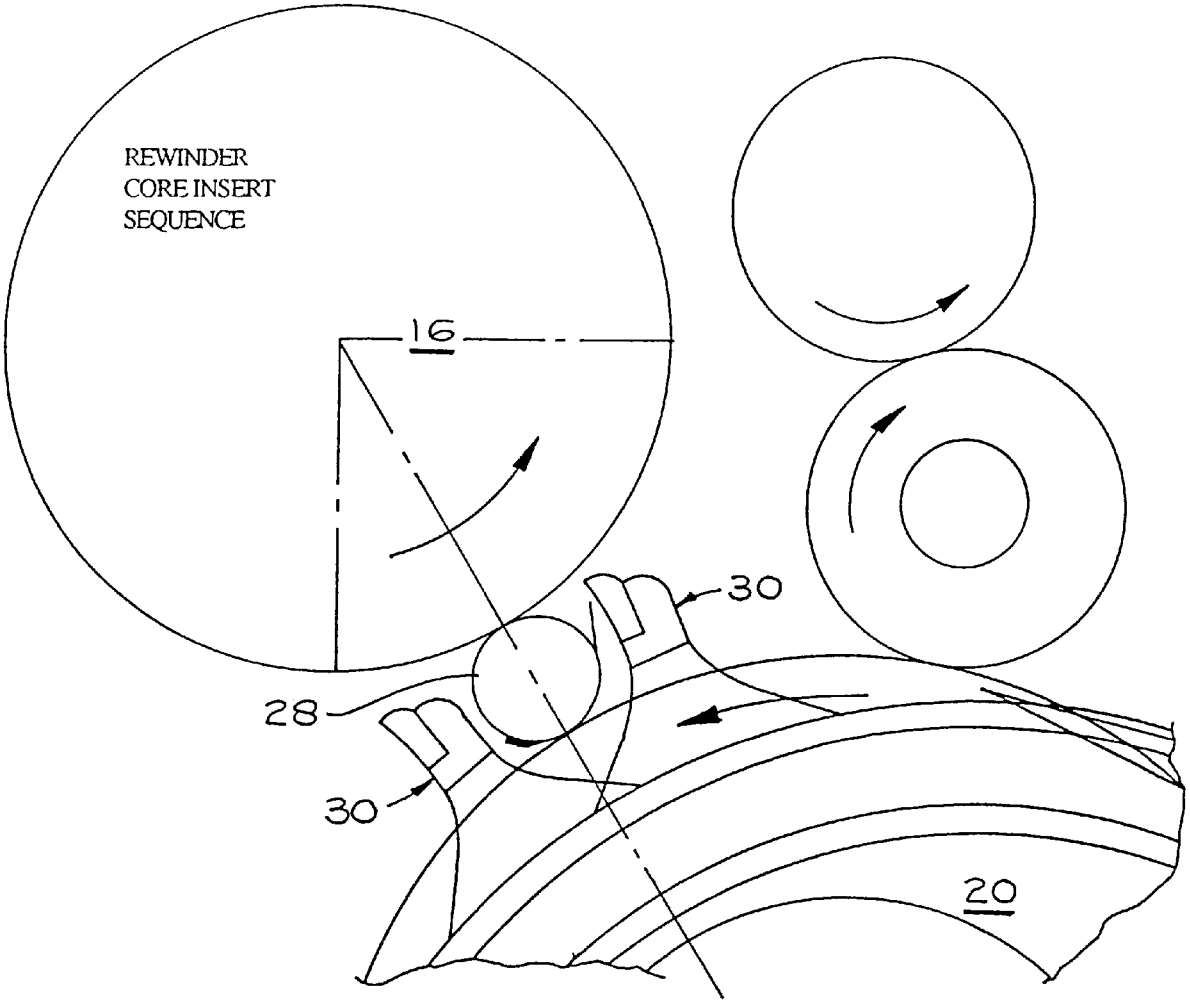
FIG. 24 shows an enlarged side view of the rewinder shown in FIG. 21 after a new log has started rewinding and a wound log is being removed from the rewinding station by a winding control finger.

FIG. 24 The web 12 which was pinched between the lead winding control finger 30 and the upper winding roll 16 is now free to wrap the core 28 because contact is lost between the winding control finger 30 and the upper winding roll 16. The combination of the lead winding control finger 30, the core 28 motion and the lower winding roll 20 motion will cause the web 12 to be drawn through the nip 56 between the lower winding roll 20 and the core 28. If the web 12 is not well attached to the core 28 at this point, the trailing winding control finger 30 will help direct the web 12 up toward the nip 56 between the core 28 and the upper winding roll 16 to complete the first wrap of the web 12 on the core 28.

Figure 25:
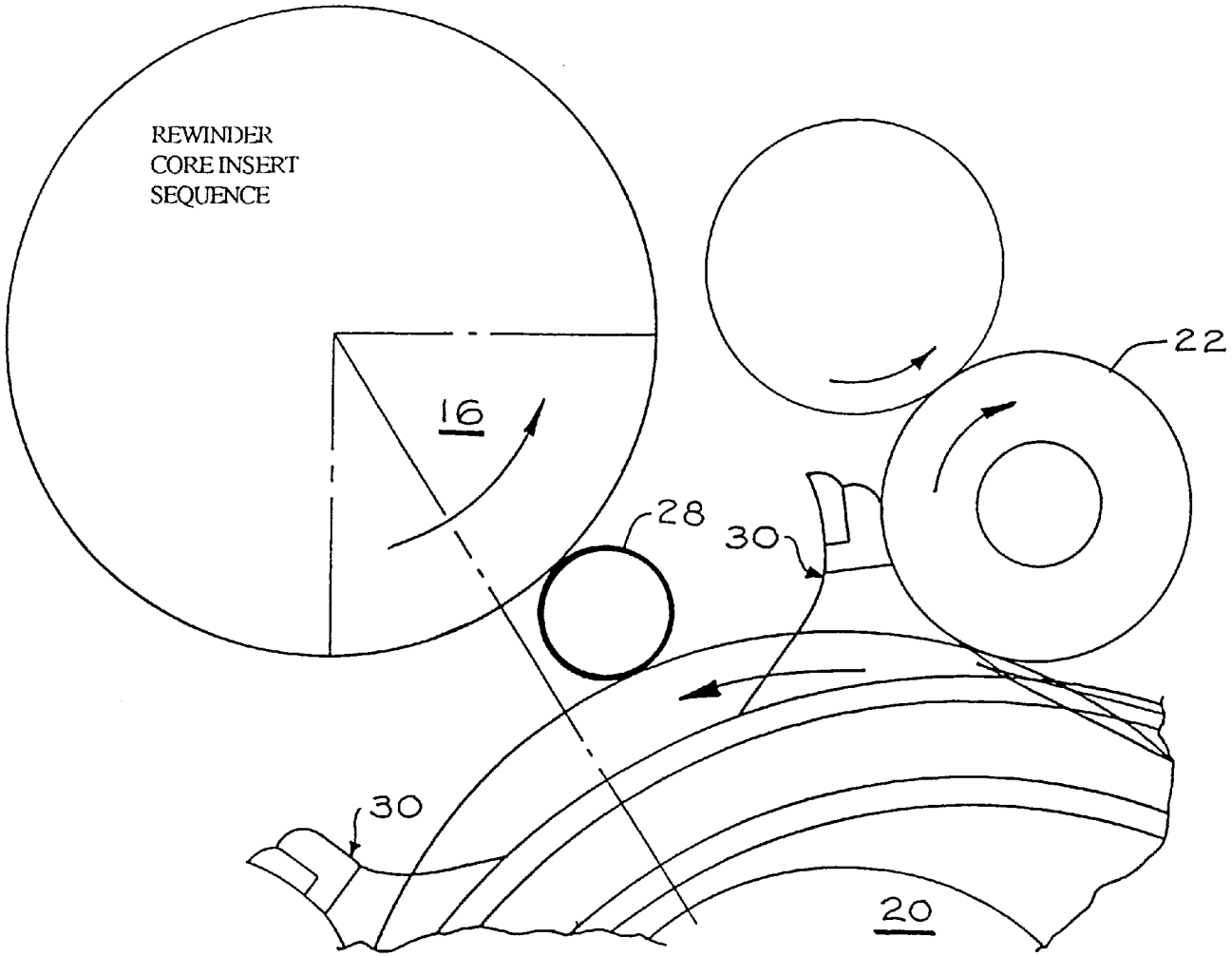
FIG. 25 illustrates an enlarged side view of the rewinder shown in FIG. 21 rewinding the new log and moving the wound log under a deceleration hood with a winding control finger.

FIG. 25: The lead finger decelerates to 15"/second to help push the completed log 22 out of the cradle 24. The trailing wing control finger 30 stops before the tip 60 contacts the upper winding roll 16. This winding control finger 30 then reverses direction and returns for the next core 28.

Figure 26:
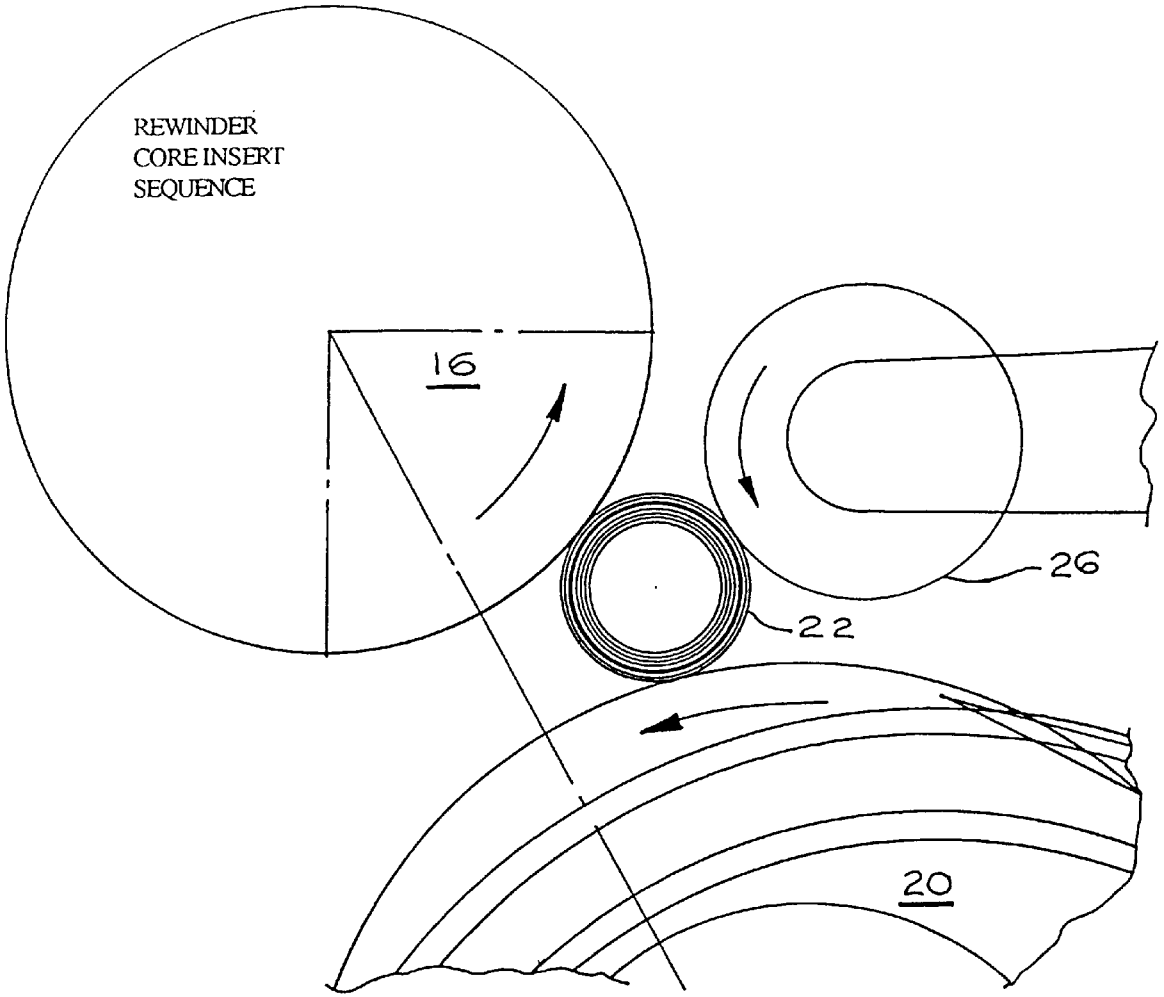
FIG. 26 shows an enlarged side view of the rewinder shown in FIG. 21 after a new log has started rewinding in a step of the process just prior to the step shown in FIG. 21.
Figure 27:
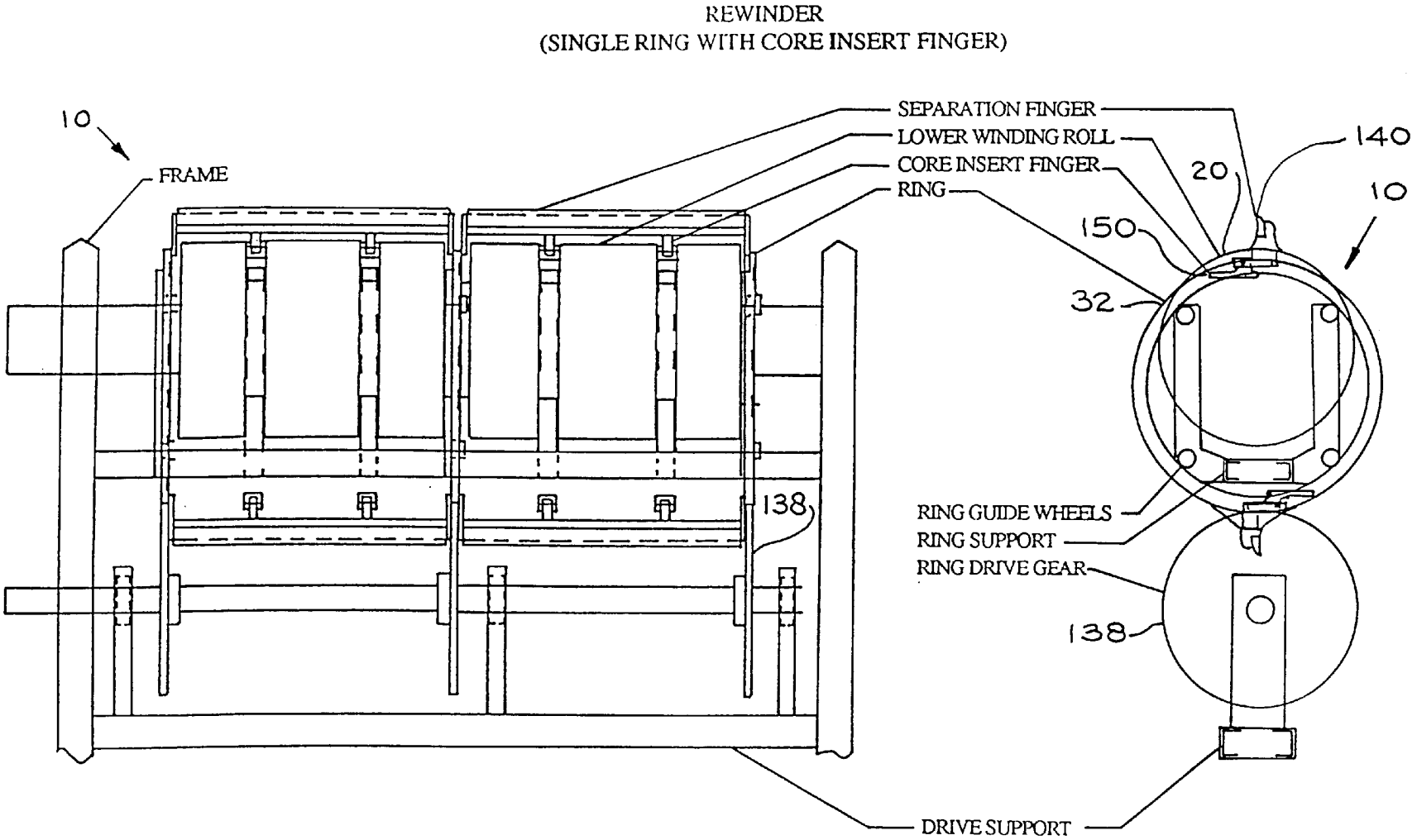
FIG. 27 illustrates a front view and a side view of an alternative embodiment of the present invention comprising winding control fingers each having at least one core insert finger.

FIG. 26: The rider roll 26 is now in contact with the building log 22. The lower winding roll 20 is in the process of accelerating back to the surface speed of the upper winding roll 16.

An alternative embodiment of the present invention is shown in FIGS. 27–40. In this alternative embodiment of the present invention, the winding control fingers 30 are each comprised of a web separation finger 140 and at least one core insert finger 150. The winding control fingers 30 control the insertion of cores 28, the separation of the web 12, and the removal of the log 22 in the rewinder 10. While FIGS. 27–40 illustrate the rewinder 10 winding product using cores 28, it will be apparent that this preferred embodiment of the present invention is useful for winding coreless products using mandrels 100 or other winding initiation devices as well.

In the alternative embodiment of the present invention illustrated in FIGS. 27–40, the winding control fingers 30 run the length of the lower winding roll 20 with some short interruptions and orbit adjacent the lower winding roll 20. Alternatively, the winding control fingers 30 orbit adjacent the upper winding roll 16 and contact the lower winding roll 20 or the rider roll 26. The winding control fingers 30 are preferably supported by the rings 32 comprising steel or other durable material as described above herein.

Further, each ring 32 which supports a winding control finger 30 preferably includes external gear teeth 136 driven by at least one ring drive gear 138 as shown in FIGS. 27–28, 35–40. The external gear teeth 136 mate with one or more ring drive gears 138 which drive the ring 32 in a conventional manner.

Alternatively, each ring 32 can include the internal V-shaped track 38 and internal gear teeth 40 (shown in FIG. 4A), although a variety of mounting configurations for the rings 32 or other suitable support structures can be used. The track 38 supports each ring 32, preferably on a set of V-shaped wheels 42 as shown in FIGS. 4C–F. The internal gear teeth 40 mate with one or more drive gears 44 which drive the ring 32 in a conventional manner. In this alternative embodiment, the track 38 supports each ring 32 and is preferably on a set of V-shaped wheels 42 as shown in FIGS. 4C–F.

A variety of conventional drives can be used, but preferably the rings 32 are driven by a servo motors 52 or other conventional drive mechanism. One preferred embodiment of the present invention has two winding control fingers 30 separated by 180 degrees on each ring 32. One of the advantages of this preferred embodiment of the present invention comprising winding control fingers 30 with web separation fingers 140 and core insert fingers 150 is the elimination of the need for multiple rings 32. Some of the benefits of eliminating multiple rings 32 include a substantial decrease in finger deceleration rate, a fifty percent reduction of ring 32 inertia, only one servo motor 52 is needed, and using an external ring drive gear 138 can require fewer parts, less maintenance, and a better quality wind.

Figure 28:
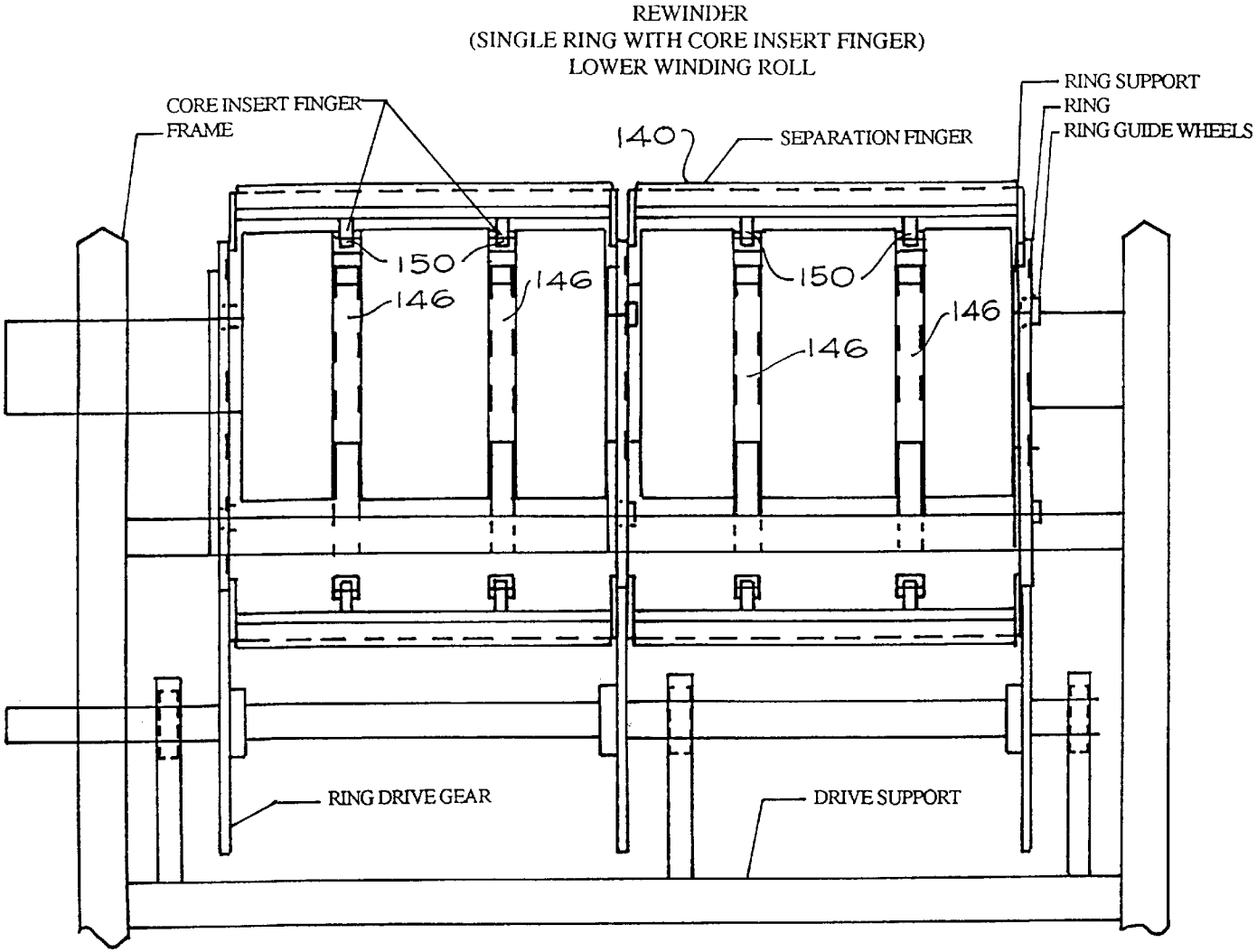
FIG. 28 illustrates an enlarged front view of the rewinder shown in FIG. 27.

Each winding control finger 30 preferably includes one web separation finger 140 and at least one core insert finger 150. As illustrated by FIG. 28, several core insert fingers 150 are preferably located along each of the winding control fingers 30. The web separation finger 140 is preferably substantially rigidly mounted on the lead side of the winding control finger 30, and the core insert fingers 150 are preferably movably mounted on the trailing side of the winding control finger 30.

The core insert finger 150 is preferably coupled to the base 61 of the winding control finger 30, although the core insert finger 150 can also be coupled directly to the ring 32 or coupled to another mounting independent of the winding control finger 30. Together the web separation fingers 140 and the core insert fingers 150 perform the functions of the winding control fingers 30 described previously for other embodiments of the present invention.

Figure 29:
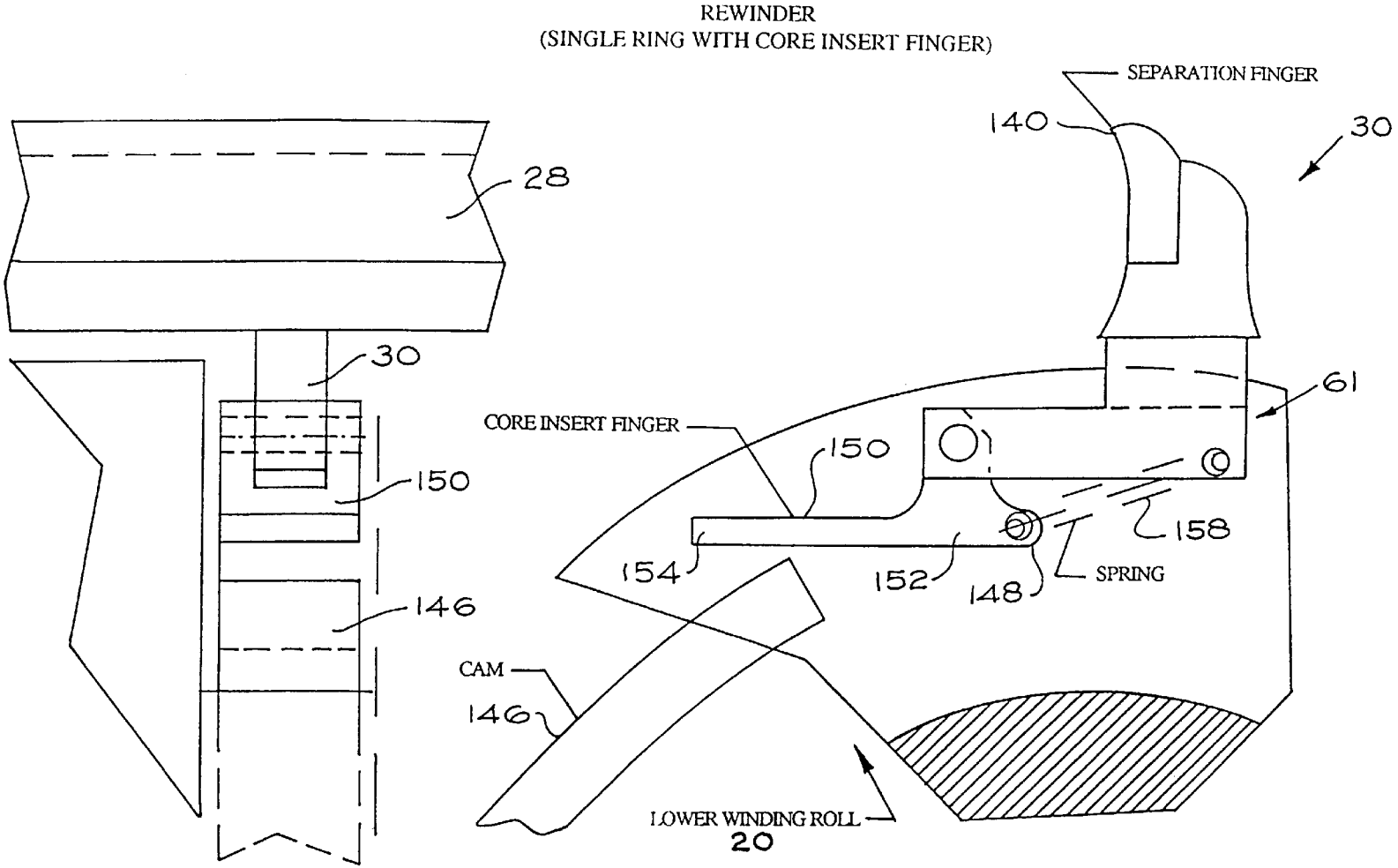
FIG. 29 shows one preferred embodiment of a winding control finger with a web separation finger and a core insert finger and a sectional view of the same.
Figure 30:
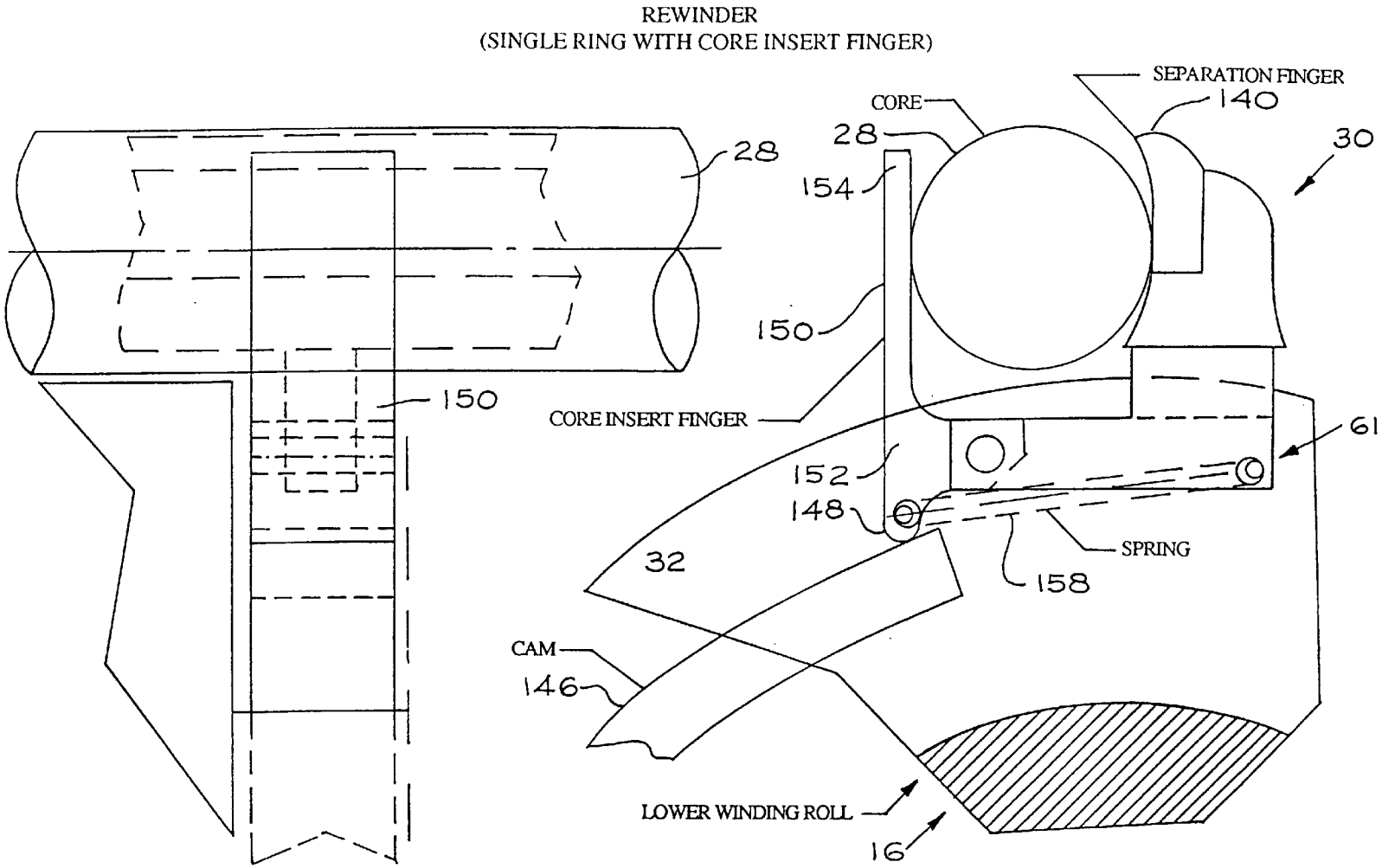
FIG. 30 illustrates the winding control finger of FIG. 29, wherein the core insert finger is in the retracted position.

One preferred embodiment of the present invention includes at least one core insert finger 150 preferably constructed of a substantially rigid material and pivotably mounted to the winding control finger 30 as shown in FIGS. 29–30. This movement allows the core insert finger 150 to have two primary positions: (1) a retracted position when the core insert finger 150 is not receiving, transporting, or depositing the cores 28 or mandrels 100; and (2) an active position when the core insert finger 150 is engaged in the processes of receiving, transporting, or depositing cores 28 or mandrels 100.

The core insert finger 150 shown in FIGS. 29–30 comprises a proximal end 152 and a distal end 154. The proximal end 152 of the core insert finger 150 preferably further comprises a cam follower 148 coupled to the base 61 of the winding control finger 30. The distal end 154 preferably includes a substantially rectangular portion 160. While these configurations are preferred, it will be apparent to one of ordinary skill in the art that a variety of shapes can be satisfactorily used.

A cam 146 rigidly positioned adjacent the ring 32 preferably contacts the cam follower 148 and actuates the core insert finger 150. The cam 146 actuates the cam follower 148 on the proximal end 152 of the core insert finger 150, thereby causing the distal end 154 of the core insert finger 150 to pivot into the active position and to manipulate the cores 28 through the winding processes. The core insert finger 150 receives, transports, and, finally, deposits cores 28 into the position where the web 12 can be wound onto the core 28. Therefore, the cam 146 preferably contacts and actuates the cam follower 148 from the time each core 28 is received until each core 28 is deposited into the nip 56 between the upper winding roll 16 and the lower winding roll 20. One preferred embodiment of the cam 146 and cam follower 148 is best shown in FIGS. 29–30.

The core insert finger 150 is preferably held in the retracted position when not actuated by the cam 146 with a spring 158 coupled at one end to the cam follower 148 and at the other end to a point on the base 61 of the leading side of the winding control finger 30. In accordance with this embodiment of the present invention, the core insert finger 150 remains retracted due to the force applied by the spring 158, until the cam 146 contacts and actuates the cam follower 148. The default position of the core insert finger 150 of this embodiment of the present invention is the retracted position. The cam 146 contacts the cam follower 148 and pivots the core insert finger 150 into the active position to receive a core 28, holds the core insert finger 150 in the active position while the core 28 is transported, and then allows the spring 158 to pull the core insert finger 150 back into the retracted position after the core 28 is deposited for winding.

Alternatively, the cam 146 can actuate the cam follower 148 and force the core insert finger 150 into the retracted position when the core insert finger 150 is not receiving, transporting, or depositing the cores 28. In such an embodiment, the default position of the core insert finger 150 is the active position. The core insert finger 150 is held in the active position by a spring 158 until the cam 146 actuates the cam follower 148. In this embodiment of the invention, the cam 146 is positioned around the circumferential portions of the ring 32 where the core insert finger 150 is not receiving, transporting, or depositing the core 28.

Yet another alternative embodiment of the present invention (not shown) comprises core insert fingers 150 which are not pivotably affixed to the winding control fingers 30, but radially spring loaded to perform the key functions of the core insert finger 150 (receive, transport, and deposit cores 28) as dictated by the location of the cam 146 relative to the cam follower 148. As described above, this embodiment can be configured so that the cam 146 actuates the core insert finger 150 into the active position or, alternatively, so that the cam 146 interacts with the cam follower 148 to take the core insert finger 150 into the retracted position.

The grooves 50 in the lower winding roll 20 preferably provide room for the core insert fingers 150 to rest when the core insert fingers 150 are not receiving, transporting, or depositing the cores 28. These grooves 50 also accommodate core insert fingers 150 which are either pivotably affixed to the winding control fingers 30 or vertically spring loaded as described above. Each of the core insert fingers 150 on the plurality of winding control fingers 30 drops into the grooves 50 in the lower winding roll 20 after the cores 28 have been deposited so that the web 12 can be affixed to the core 28. The core insert fingers 150 rest in the grooves 50 within the lower winding roll 20 when the core insert fingers are in the inactive position. The core insert finger 150 squeezes the core 28 between the web separation finger 140 and the core insert finger 150 until moved into the inactive position. By adjusting the location of the cam 146 adjacent the lower winding roll 20, adjustments can be made for both the core 28 diameter and insertion point.

Figure 31:
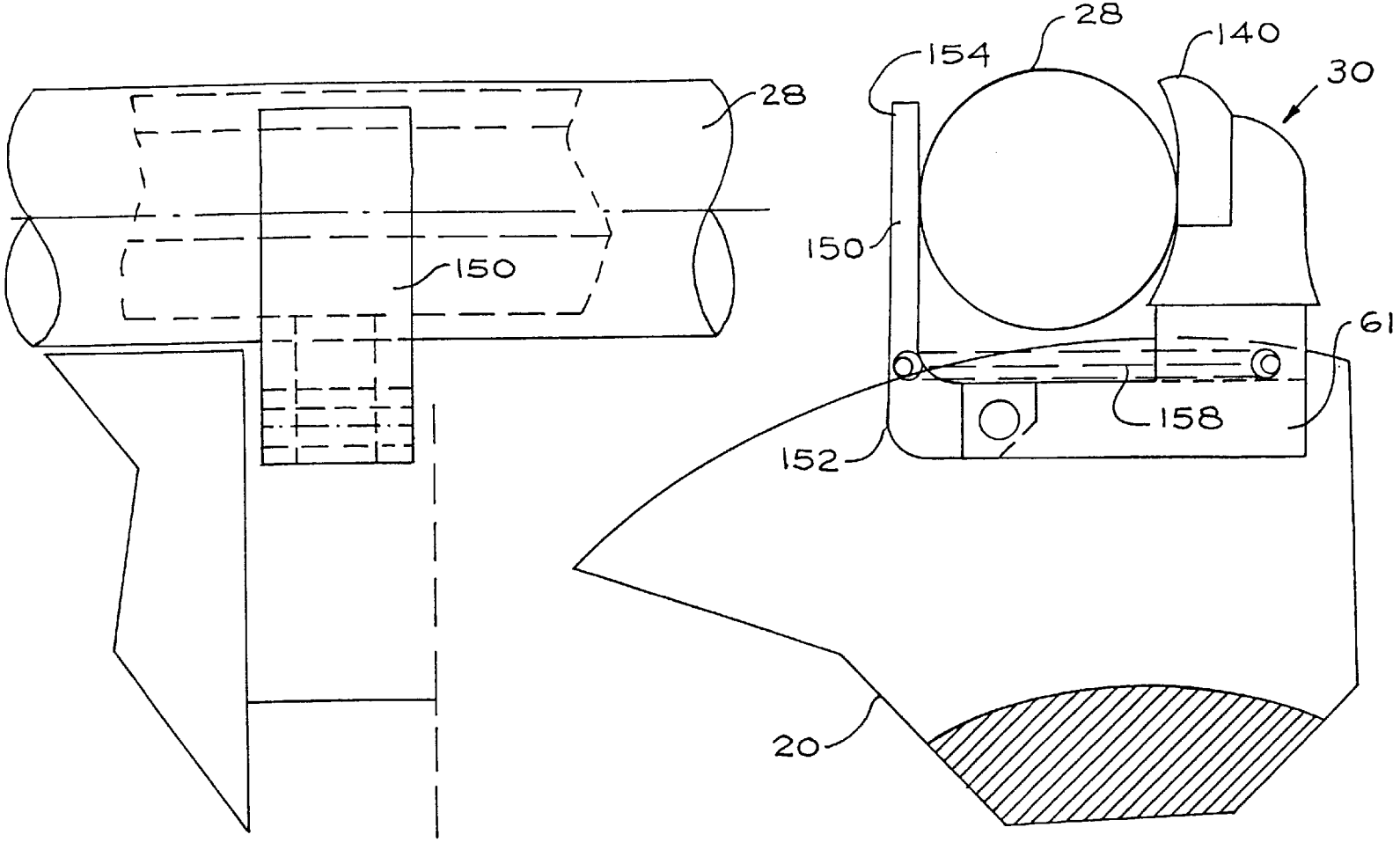
FIG. 31 shows another alternative embodiment of a winding control finger having a web separation finger and a core insert finger.
Figure 32:
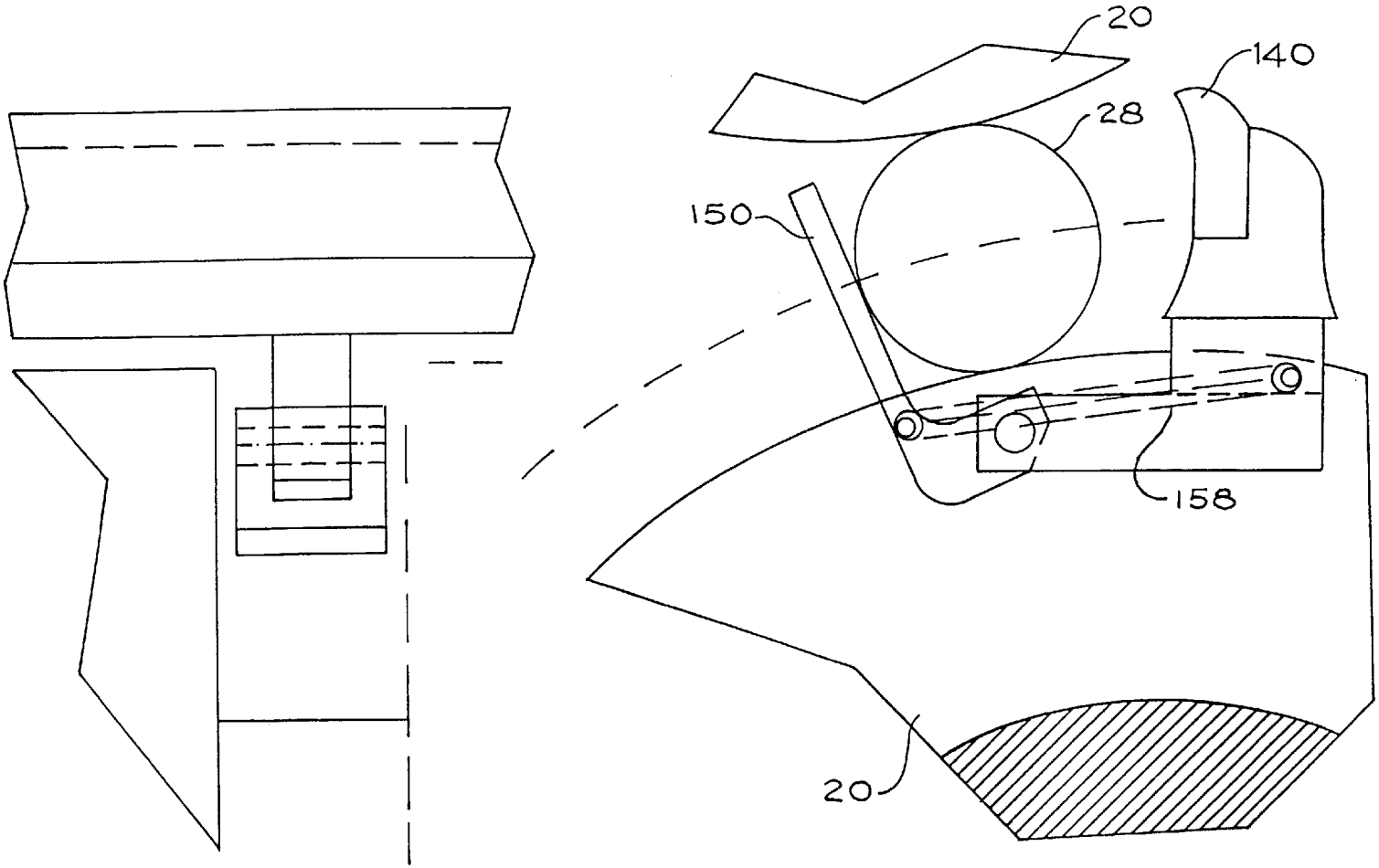
FIG. 32 illustrates the core insert finger of FIG. 31 moving to a retracted position to pass under a core.
Figure 33:
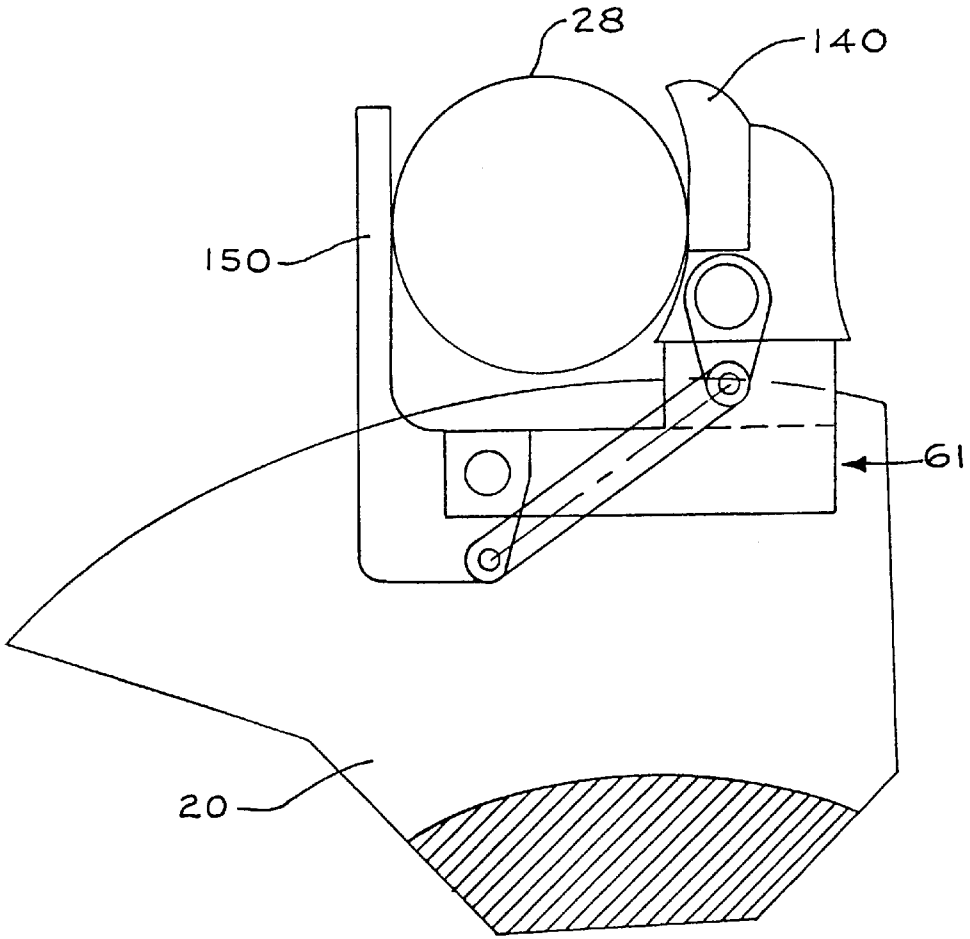
FIG. 33 shows yet another alternative embodiment of a winding control finger.
Figure 34:
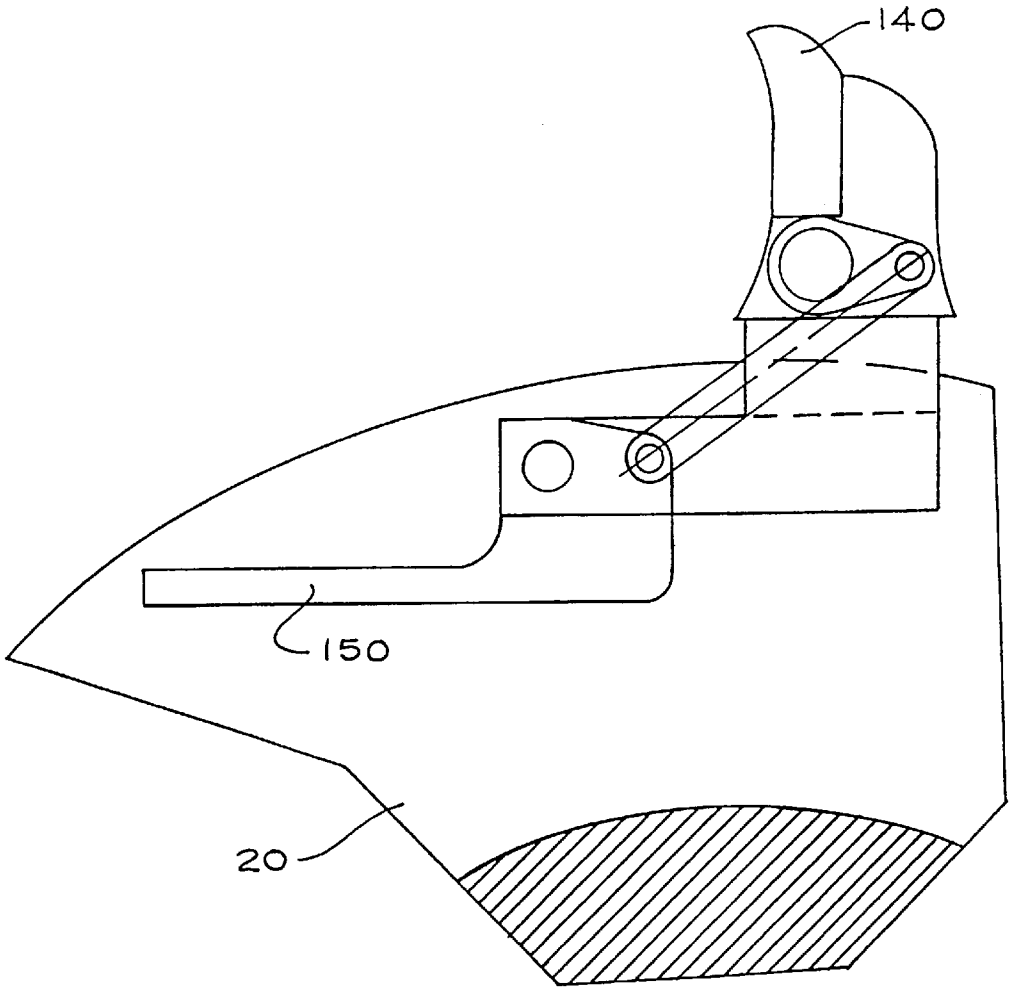
FIG. 34 illustrates the core insert finger of FIG. 33 moving to the retracted position.

An alternative embodiment of the present invention shown in FIGS. 31 and 32 eliminates the cam 146 and the cam follower 148 of the core insert finger 150. In this preferred embodiment, the proximal end 152 of the core insert finger 150 is pivotably affixed to the base 61 of the winding control finger 30. The core insert finger 150 is spring loaded to squeeze the core 28 against the web separation finger 140. The upper and lower winding rolls 16, 20 are positioned so that the distance at the nip 56 between the rolls 16, 20 is about a sixteenth less than the diameter of the core 28 being prepared for rewinding. The force applied on the core 28 when the core 28 is located in the nip 56 is transferred to the core insert finger 150, overcomes the spring 158 holding the core 28 in the active position, and causes the core insert finger 150 to retract and pass below the core 28 in the groove 50 in the ring 32. After passing below the core 28 within the groove 50, the spring 158 pulls the core insert finger 150 back into the active position. The core insert finger 150 rotates around the ring 32 in this manner and receives, transports, and deposits another core 28 because the core insert finger 150 is again retracted by the force placed on the core 28 by the upper and lower winding rolls 16, 20.

Yet another alternative embodiment of the present invention comprises a core insert finger 150 which is equipped with a system of latches (not shown). Each core insert finger 150 of this preferred embodiment has a corresponding latch which holds the core insert finger 150 in a position to receive, transport, and deposit the cores 28 for winding. A trigger (not shown) is preferably placed in the groove 50 of the ring 32 which trips the latch after the core 28 is deposited thereby releasing the core insert finger 150. After the core insert finger 150 retracts and passes below the deposited core 28, the trigger resets, and the core insert finger 150 returns to the active position and prepares to receive another core 28.

Still another alternative embodiment of the core insert finger 150 of the present invention comprises a common control system. The control system comprises a shaft extending the length of the web separation finger 140 of the winding control fingers 30. The shaft is preferably located at the pivot point of the core insert fingers 150. A linkage extends from the shaft to each of the individual core insert fingers 150. The side frame of the rewinder 10 preferably has a cam controlling a cam follower coupled to a lever arm located on the end of the shaft.

Figure 35:
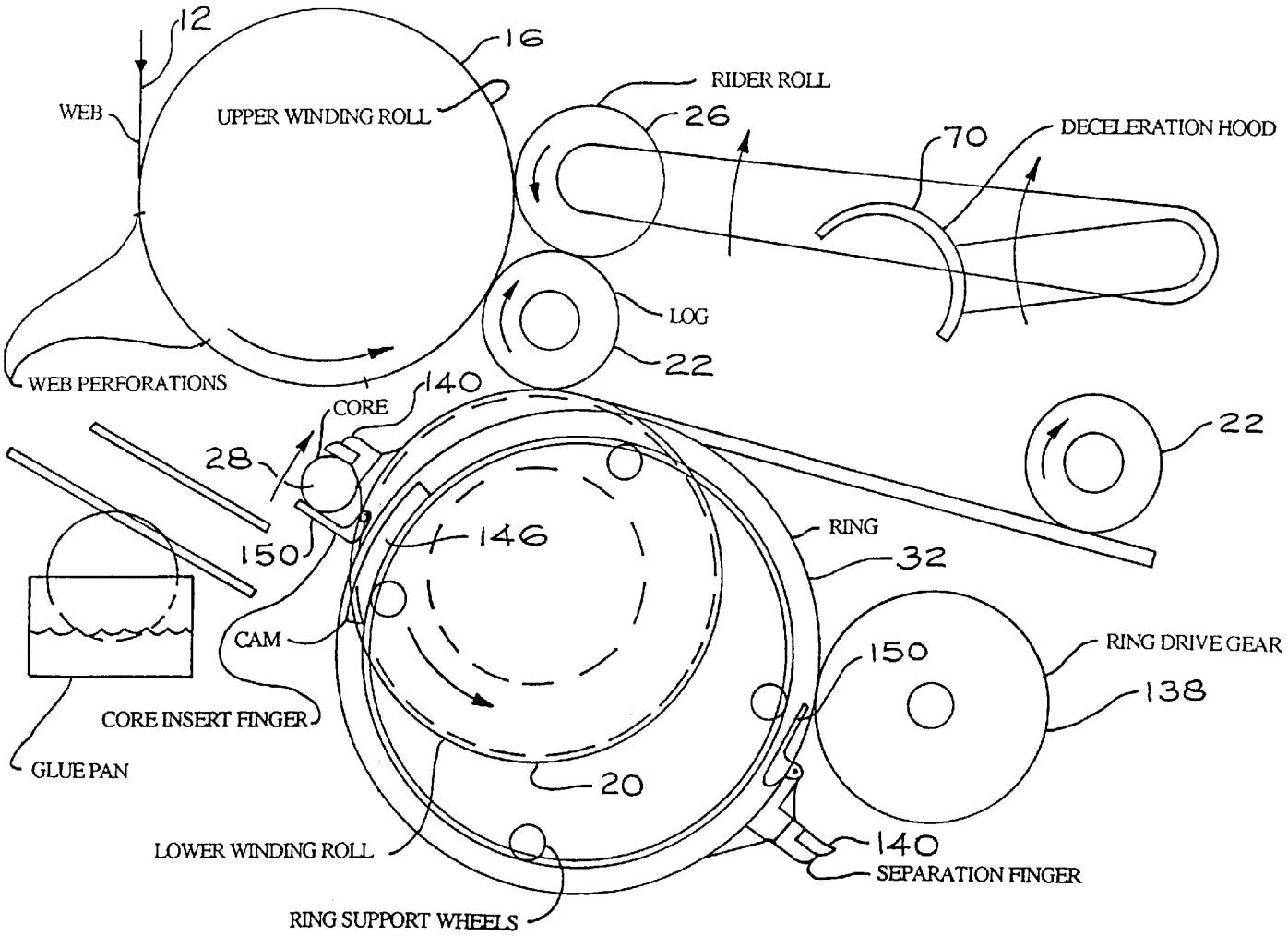
FIG. 35 illustrates an enlarged side view of the rewinder shown in FIGS. 27–29 prior to web separation.

Referring now to FIG. 35, a log 22 is shown nearing completion of winding in the cradle 24 formed by the two winding rolls 16, 20 and the rider roll 26. The core 28 is held in place between the web separation finger 140 and the core insert finger 150, preferably by lightly squeezing the core 28. FIG. 35 demonstrates the interaction between the core insert finger 150 as actuated by contact with the cam 146. The web separation finger 140 and the core insert finger 150, which are pulled by the movement of the winding control finger 30 on the ring 32, accelerate the core 28 toward the nip 56 between the winding rolls 16, 20. The winding control finger 30 (comprised of the web separation finger 140 and the core insert finger 150) and the core 28 preferably reach a speed somewhat less than the speed of the circumference 54 of the upper winding roll 16.

Figure 36:
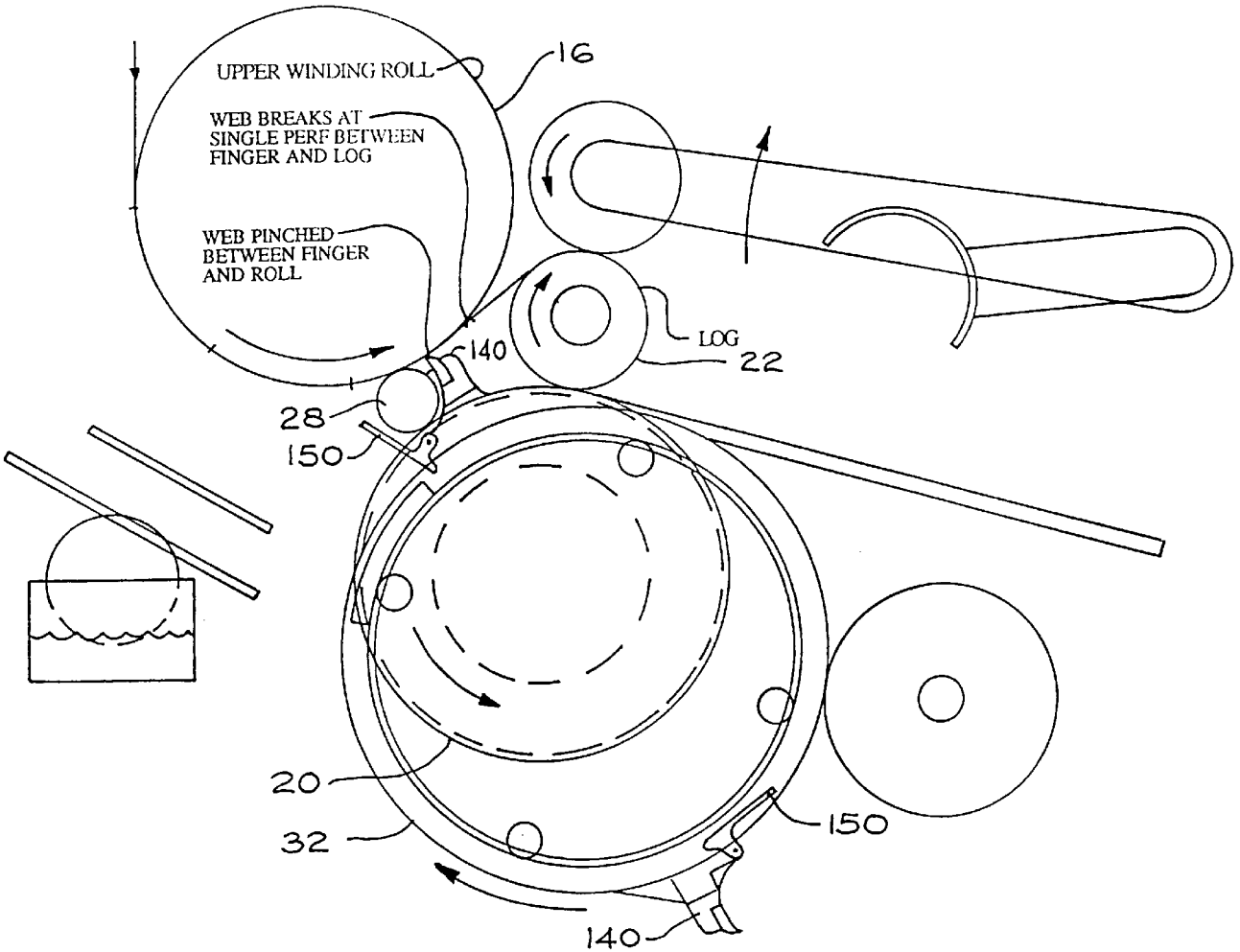
FIG. 36 shows an enlarged side view of the rewinder shown in FIG. 35 during web separation.

Referring now to FIG. 36, the resilient tip 60 on the web separation finger 140 pinches the web 12 between the web separation finger 140 and the upper winding roll 16 at the nip 56 between the two winding rolls 16, 20. The tip 60 can comprise a variety of resilient or rigid materials and be mounted to a base of the winding control finger 30 in various ways. Preferably, the tip 60 comprises polyurethane having a durometer of between sixty and one hundred, and is held adjacent a metal base 61 with a metal tab (not shown). Alternatively, the tip 60 can be conventionally mounted directly to the base 61 or even serve as the entire web separation finger 140, provided a sufficiently durable material is used. In another preferred embodiment, the tip 60 is spring mounted to provide resilience. The preferred resilient nature of the tip 60 enables tolerances for the interference between the upper winding roll 16 and the tip 60 to be looser while maintaining product quality and performance.

The interference between the upper winding roll 16 and the tip 60 can be adjusted in a variety of ways. A control system can adjust the interference by varying the ring 32 location in various ways such as moving one or more of the support rollers 65, 66 or a base 69 supporting the support rollers 65, 66. This system can automatically or manually adjust the interference (primarily radially) to compensate for wear of the tip 60.

One preferred adjustment mounting includes resiliently mounting the rings 32 to compensate for the rings 32 not being perfectly round. Preferably, two support rollers 65 which do not bear a majority of the weight of the ring 32 are resiliently mounted, while one or more primary load bearing support rollers 66 are fixed. While a variety of ring system supports can be used to mount the support rollers 65, 66, preferably a yoke-shaped ring system support 67 is used as shown in FIG. 2.

The web separation finger 140 is preferably timed to contact the web 12 at a position between perforations 64. At the point of contact with the web separation finger 140, the web 12 slows to the winding control finger 30 speed, and slips on the upper winding roll 16 due to the high coefficient of friction between the web separation finger 140 and the web 12. Tension in the web 12 between the web separation finger 140 and the log 22 increases above the tensile strength of the perforation 64 in the web 12. Because the web separation finger 140 is so close to the log 22 when the web separation finger 140 contacts the web 12, only one perforation 64 exists between the web separation finger 140 and the nip 56 between the log 22 and the rider roll 26. This single perforation 64 in this area of high tension assures that the web 12 will separate on the desired perforation 64 as compared to winders that must locate several perforations in this area. This highly controlled separation of the web 12 assures that each log 22 has the desired number of sheets, substantially reducing costs of surplus sheets commonly required by prior art devices.

The width of the nip 56 between the winding rolls 16, 20 is preferably set just smaller than the diameter of the core 28 so that the core 28 contacts both winding rolls 16, 20 just as the leading winding control finger 30 pinches the web 12 against the upper winding roll 16. At this point, the core 28 is trapped on all sides with winding rolls 16, 20 above and below the core 28 and the web separation finger 140 ahead and core insert finger 150 behind the core 28.

By trapping the core 28 on all four sides as the core 28 first contacts the surface of the winding rolls 16, 20, the core 28 is positioned straight and in-line with the winding rolls 16, 20 even if the core 28 was not straight to begin with. This solves a problem with prior art rewinders which commonly start the core 28 misaligned due to a lack of control on the fourth side of the core 28.

Slack in the web 12 develops in the small space between the web separation finger 140 and at the core 28 itself. The slack is created because the core 28 is now rotating between the upper and lower winding rolls 16, 20 and driving the web 12 at the surface speed of the upper winding roll 16, and the web separation finger 140 is reducing the speed of the web 12 just in front of the core 28. The slack web 12 is now forced to follow the only path open to it, which is down toward the lower winding roll 20 between the core 28 and the web separation finger 140.

Figure 37:
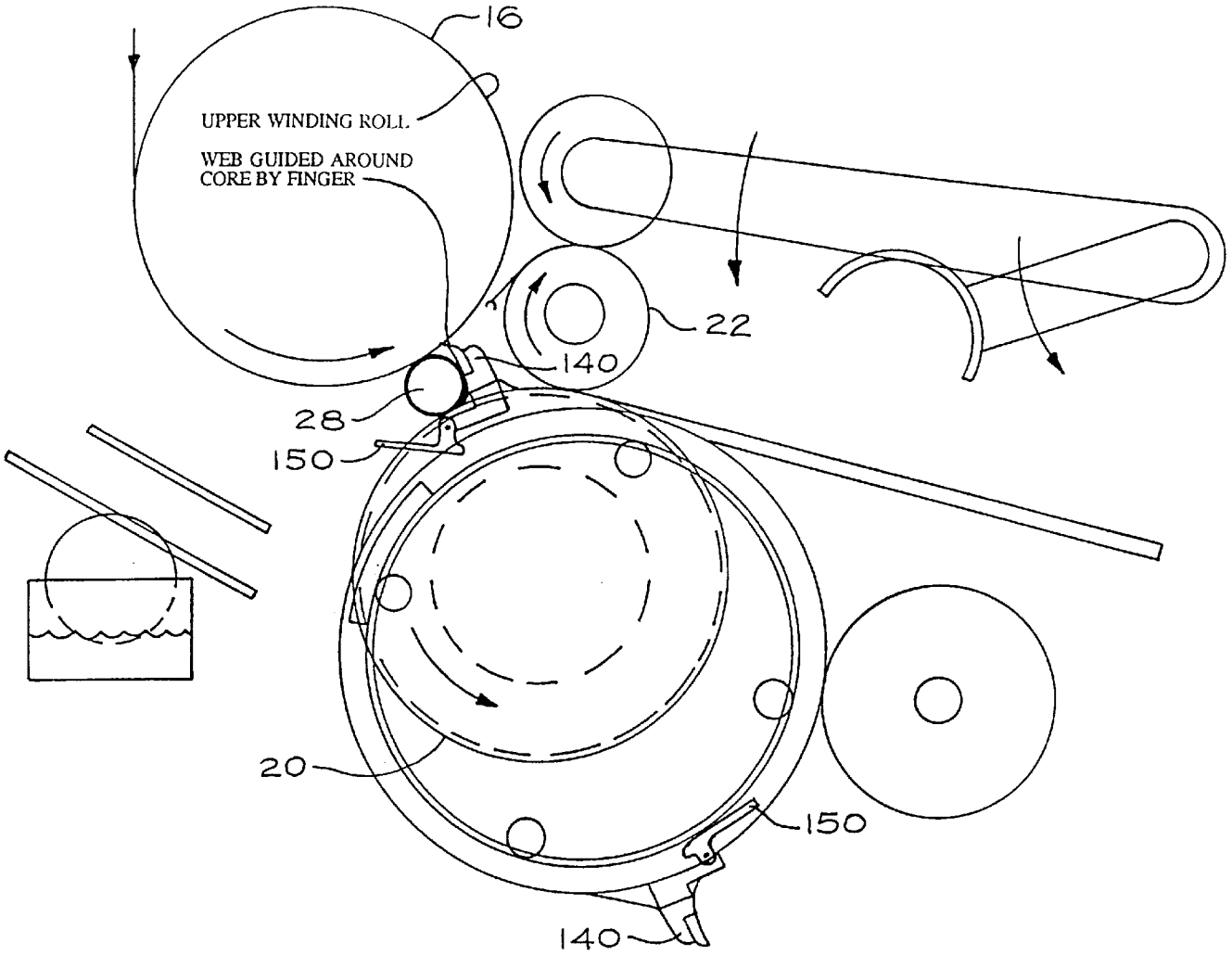
FIG. 37 illustrates an enlarged side view of the rewinder shown in FIGS. 35–36 just after web separation.

Referring now to FIG. 37, when the slack web 12 contacts the lower winding roll 20, its rotation forces the web 12 back between the core 28 and the lower winding roll 20. The web separation finger 140 ahead of the core 28 is now moving past the narrowest point in the throat 18. Contact between the tip 60 of the web separation finger 140 and the upper winding roll 16 now ceases and the end of the web 12 can now be pulled back under the core 28. As the web 12 passes back between the core 28 and the lower winding roll 20, it will contact the core insert finger 150 following the core 28 and be directed back up toward the area between the core 28 and the upper winding roll 16 to start the winding process. This process of starting the web 12 around the core 28 is made more reliable by the way the core 28 is trapped by the web separation finger 140 and the core insert finger 150, and the way the web separation finger 140 and the core insert finger 150 guide the web 12 around the core 28. The present invention will work without transfer adhesive 80 on the core 28. However, a higher maximum rewinding speed can be achieved by depositing a line (not shown) of conventional adhesive 80 along the length of the core 28, rings of adhesive 80 on the circumference of the core 28, or other conventional adhesive configurations.

Figure 38:
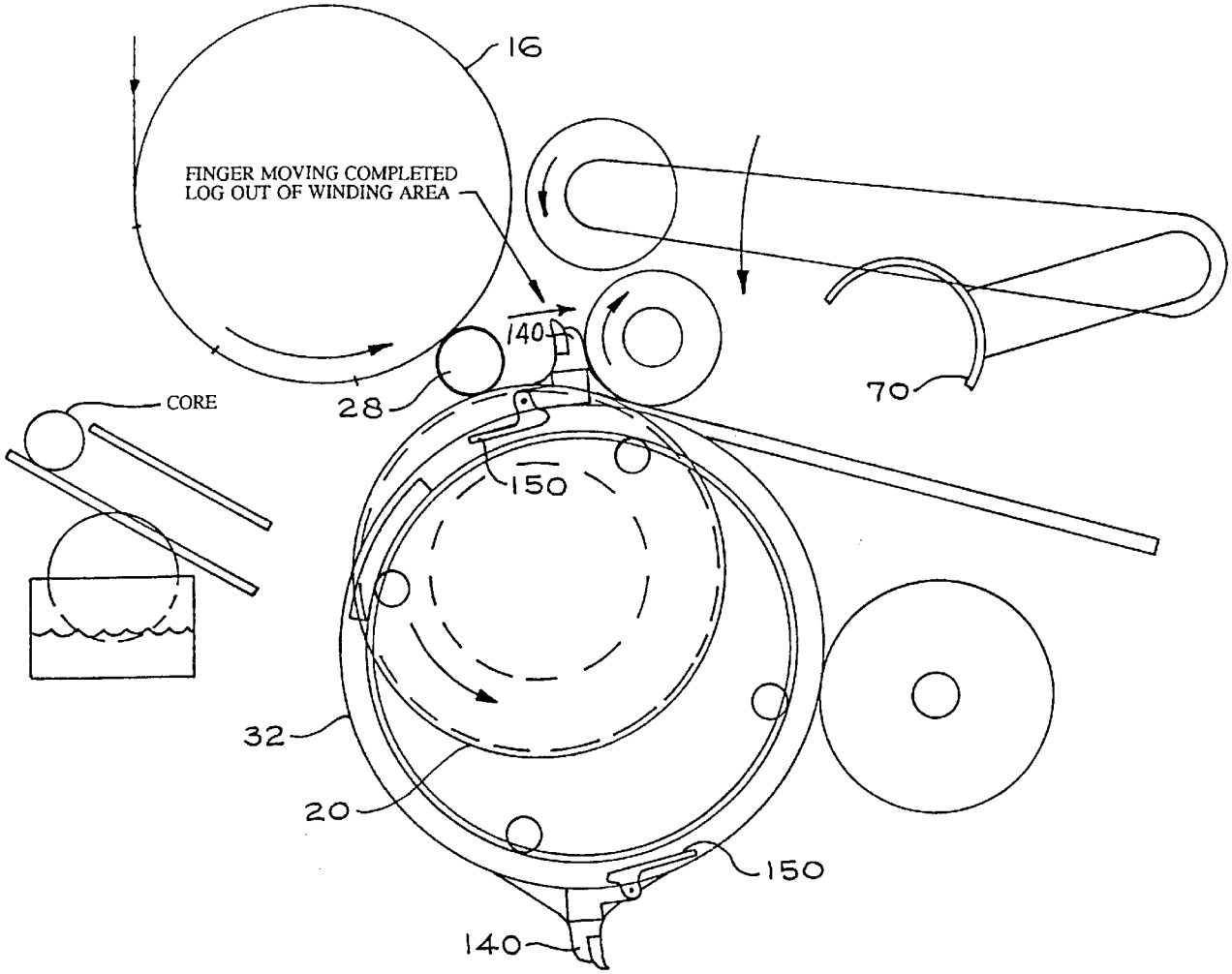
FIG. 38 shows an enlarged side view of the rewinder shown in FIGS. 35–37 after a new log has started rewinding and a wound log is being removed from the rewinding station by a winding control finger.

Referring now to FIG. 38, it is common practice in bathroom tissue and kitchen towel winding to run product as soft (low density) as possible at as high a speed as possible. The soft log 22 rotating at a high speed is unstable and its behavior is unpredictable when released from a conventional three-roll winding cradle 24. In prior reminders, the maximum speed that the soft products can run is often limited by this unpredictable behavior of the log 22 as it exits the rewinder 10. In the present invention, this control problem is solved by the web separation finger 140 which is positively located between the new core 28 and the completed log 22. The web separation finger 140 continues through the throat 18 between the winding rolls 16, 20, contacts the completed log 22 and then guides the completed log 22 out of the three-roll cradle 24 and into a suitable conventional deceleration device 70.

Around this point in time, the web 12 is wrapping the new core 28 in the throat 18 between the winding rolls 16, 20 and the diameter of the new log 22 is increasing. To prevent crushing the core 28, the lower winding roll 20 can be slowed down momentarily to move the core 28 through the throat 18 between the winding rolls 16, 20 toward the cradle 24. Because the web separation finger 140 moves the completed log 22 out of the three-roll cradle 24 rapidly, the rider roll 26 can quickly move down toward the log 22 emerging from the throat 18 between the winding rolls 16, 20 (see FIG. 38). This minimizes the time the log 22 is balancing between the upper winding roll 16, 20 and lower winding roll 20 by quickly getting the log 22 into the three-roll cradle 24. By reducing the time the log 22 is balanced between winding rolls 16, 20 and increasing the time the log 22 is in the three-roll cradle 24, the log 22 is better controlled and the speed change in the lower winding roll 20 is less critical than in previous rewinders.

Figure 39:
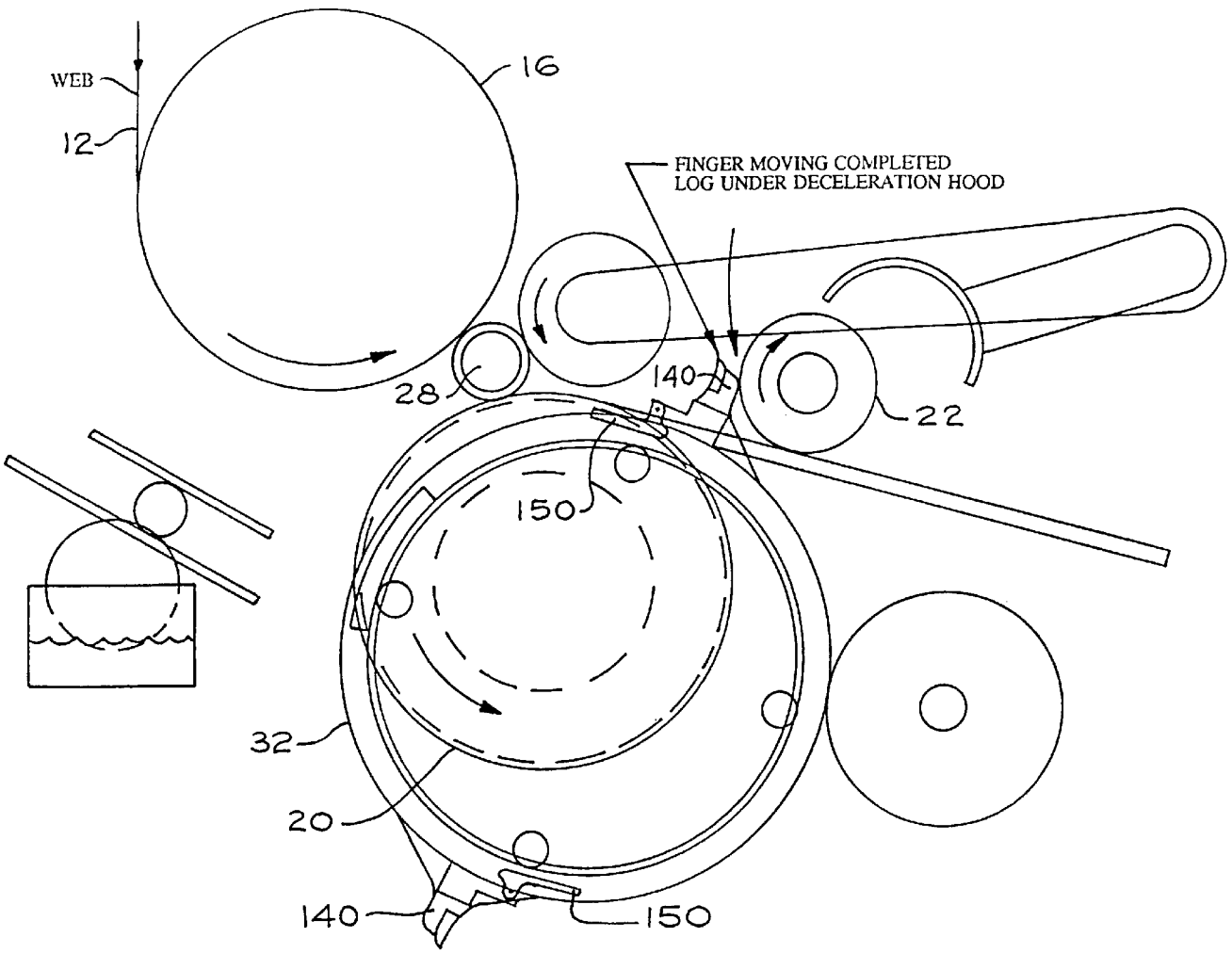
FIG. 39 illustrates an enlarged side view of the rewinder shown in FIGS. 35–38 preparing a new core for rewinding, winding a log, and decelerating and moving a wound log in under a deceleration hood with a winding control finger.
Figure 40:
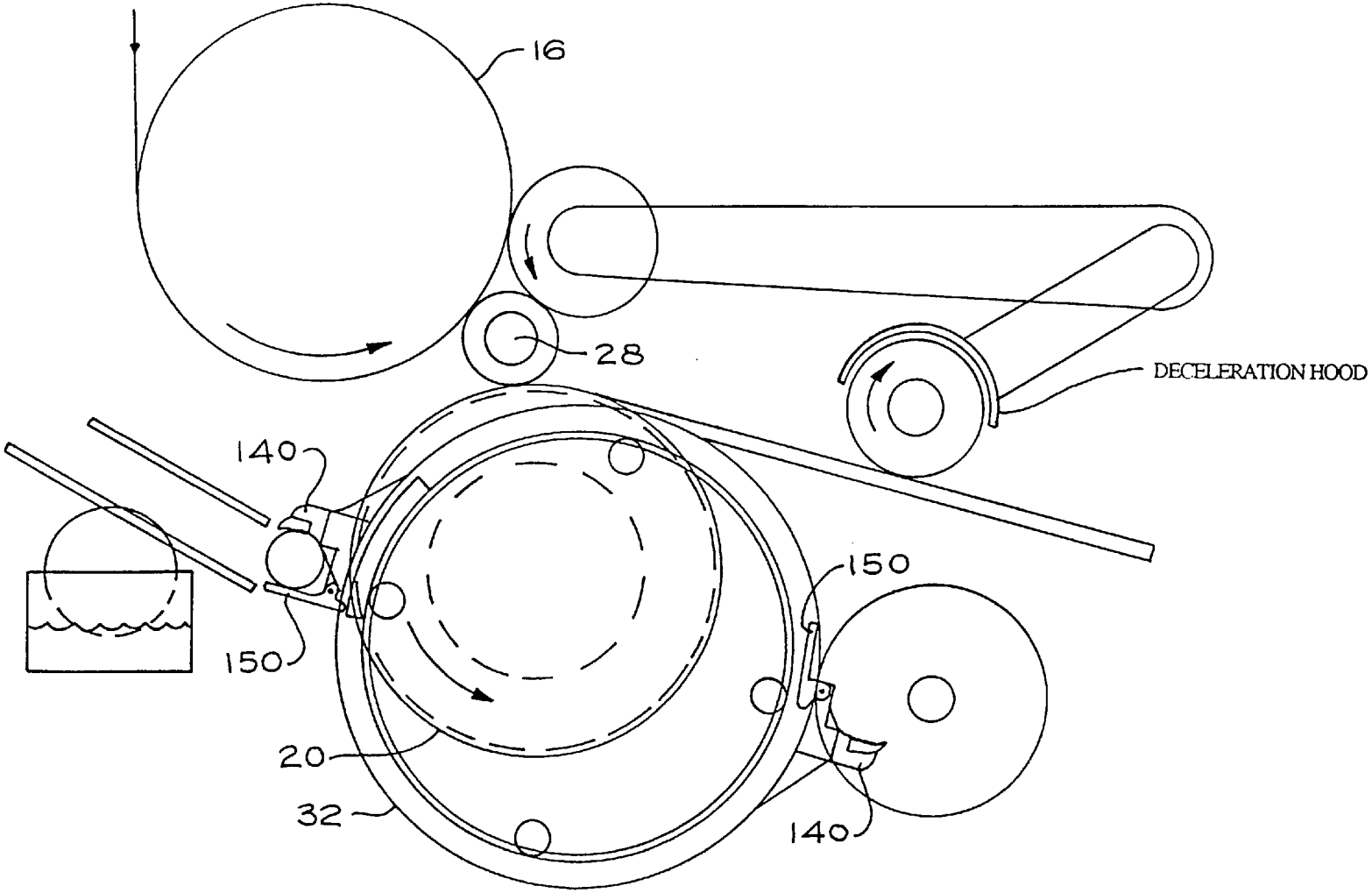
FIG. 40 shows an enlarged side view of the rewinder shown in FIGS. 35–39 receiving a new core for rewinding, in the process of winding a core, and a wound log in the deceleration hood.

Referring now to FIG. 39, the web separation finger 140 which was guiding the completed log 22 to the deceleration device 70 has completed its cycle in the winding process. The winding control finger 30 continues to move until the winding control finger 30 mounted about 180 degrees from the first on the same support ring 32 is at the core pick-up point to permit the core insert finger 150 to receive the next core 28. When the core 28 arrives, the core insert finger 150 can be actuated by the cam 146 as shown in FIG. 40 to receive the next core 28. After receiving the core 28, the web separation finger 140 and the core insert finger 150 can squeeze the core 28 and move the core 28 toward the nip 56 between the winding rolls 16, 20 which completes the steps of the process. After this step, the process can continue starting with the step shown in FIG. 35.

FIG. 16 shows a rewinder 10 with a system of winding control fingers 30 mounted on cam follower 148 and driven by roller chains 79. This system was described above, but can also be adapted to accommodate winding control fingers 30 equipped with core insert fingers 150. One preferred embodiment of the present invention incorporates the winding control fingers 30 having web separation fingers 140 and core insert fingers 150 as shown in FIGS. 35–40 onto a rewinder 10 wherein the winding control fingers 30 are mounted on cam followers 78 and driven by roller chains 79.

In another preferred embodiment of the invention, the idler roll 84 above the upper winding roll 16 irons the web 12 down onto the upper winding roll 16 as shown in FIG. 2. The idler roll 84 is useful at high speeds to drive air out from between the web 12 and the upper winding roll 16. The idler roll 84 can also be used to sense tension in the web 12. The web tension signal can feed a tension control system 86 which adjusts the speed of a set of pull rolls 88 which are located above the conventional perforation station 14. The embodiment of the present invention incorporating an idler roll 84 can be designed using winding control fingers 30 as designed with web separation fingers 140 and core insert fingers 150.

Other preferred embodiments of the present invention include an upper winding roll 16 that is reduced in diameter to reduce the distance the core 28 needs to move as it passes through the nip 56 between the winding rolls 16, 20. The lower winding roll 20 can be increased in diameter to provide more space in the grooves 50 that the rings 32 ride in. This space is useful to allow the lower winding roll 20 to adjust to a larger range of core 28 diameters without exposing the rings 32 in the cradle 24. The rings 32 were made larger to provide room for the ring support system 67.

A variety of methods and apparatus for supplying and gluing cores 28 can be used, although one method and apparatus is shown for illustrative purposes. The illustrated design significantly reduces the number of core handling parts common to these systems by using the winding control finger 30 to perform multiple functions.

In accordance with another preferred embodiment of the invention shown in FIGS. 17–20, the winding control finger rewinder 10 can be used to rewind coreless products 104 reliably at high speeds. The rewinder 10 uses a number of mandrels 100 which cycle through the rewinder 10 and are returned by a mandrel handling system 102 to the starting point.

The coreless product 104 is wound on one of the mandrels 100 and then the mandrel 100 is removed from the center of the coreless product 104, leaving a hole 106 at the center. The center hole 106 ensures coreless product 104 compatibility with conventional wound product dispensers. Each mandrel 100 preferably includes bearings 110 on each end as shown in FIG. 17B. The outside diameter of the bearings 110 is preferably less than the diameter of the mandrel 100. One end of the mandrel 100 preferably includes the flange 112 that is larger in diameter than the mandrel 100. The flange 1 12 is used to pull the mandrel 100 out of the coreless product 104.

The web separation fingers 140 and core insert fingers 150 each include mandrel bearing supports 114, 115. The mandrel bearing supports 114, 115 interact with each other to trap the bearings 110 on the mandrel 100, support the mandrel 100 with a small gap between the mandrel 100 and the web separation finger 140 and core insert finger 150. The nip 56 between the upper and lower winding rolls 16, 20 is dimensioned slightly larger than the diameter of the mandrel 100. The bearing supports 114, 115 on the web separation finger 140 and core insert fingers 150 also guide the mandrel 100 through the nip 56 centered between the winding rolls 16, 20. The mandrel 100 preferably includes a friction drive area 118 near the flange 112 that contacts the lower winding roll 20 just before the nip 56 and drives the mandrel 100 during mandrel insertion.

The tip 60 of the web separation finger 140 separates the web 12 as described previously for other preferred embodiments of the invention. The web 12 is trapped between the two winding rolls 16, 20, the web separation finger 140, and the core insert finger 150. As the web 12 collects behind the web separation finger 140, it contacts the spinning mandrel 100 and wraps the mandrel 100 to start the winding process. The remainder of the winding process is similar to that of the rewinder 10 with the core 28 at the center.

The coreless product 104 stops at the mandrel extraction area 120 after leaving the deceleration device 70 of the rewinder 10. The mandrel 100 is pulled out of the coreless product 104 and outside of a machine frame 122 by a mandrel extractor 124. Once outside the frame 122, the mandrel 100 is picked up by a cross conveyor 132 that moves the mandrel 100 back to the area upstream of the lower winding roll 20. At this point, the mandrel 100 is moved back inside the frame 122 by the mandrel insert conveyor 126. The mandrel insert conveyor 126 holds the mandrel 100 in place for the core insert finger 150 coupled to the winding control finger 30 to pick up the mandrel 100 for insertion, completing the process for one mandrel 100. The rewinder 10 preferably uses five mandrels 100 at different stages in the winding process at all times.

Referring to FIG. 18, one coreless product 104 is completing the winding process between the upper winding roll 16, the lower winding roll 20 and the rider roll 26. A mandrel 100 is about to be inserted into nip 56 between the upper and lower winding rolls 16, 20 by the core insert finger 31. A completed coreless product 104 and mandrel 100 are at the mandrel extractor 124. The coreless product 104 will be held by a product stop 130 as the mandrel extractor 124 pulls the mandrel 100 out of the coreless product 104 and outboard of the frame 122. Two mandrels 100 are on the cross conveyor 132 which moves the empty mandrels 100 from the mandrel extractor 124 back to the mandrel insert conveyor 126.

As shown in FIG. 19, the mandrel insert conveyor 126 is moving the mandrel 100 picked up off the cross conveyor 132 back inside the frame 122 and positioning the mandrel 100 for the core insert fingers of the winding control fingers to pick it up. Another coreless product 104 is winding in the nip 56 between the two winding rolls 16, 20 and the rider roll 26. A completed coreless product 104 is in the deceleration area. The mandrel extractor 124 has completed pulling a mandrel 100 out of a coreless product 104 and left it for the cross conveyor 132 to pick up. One mandrel 100 is located on the cross conveyor 132 and a completed coreless product 104 is rolling out of the rewinder 10.

Referring to FIG. 20, a mandrel 100 is being taken off the mandrel insert conveyor 126 by the web separation finger 140 of the winding control finger 30. A coreless product 104 is winding in the nip 56 between the upper winding roll 16, the lower windings roll 20 and the rider roll 26. A coreless product 104 is rolling from the deceleration device 70 to the log stop to start the mandrel extraction process. Two mandrels 100 are on the cross conveyor 132.

Another method of producing coreless product 104 using mandrels 100 in rewinder 10 mounts the mandrels 100 permanently in the rewinder 10 on a ring, track or turret type system. The coreless product 104 is stripped off the mandrels 100 and moved out through the frame 122 while the mandrels 100 remain inside the frames 122. Empty mandrels 100 return to the insert area by passing under the lower winding roll 20.

Mandrel rewinders and systems of handling mandrels are well known to one of ordinary skill in the art. The illustrated preferred embodiment for rewinding coreless product 104 is unique in that it uses mandrels 100 without cores or glue in a continuous winding system based on the three roll surface winding concept. One reason this rewinder 10 is better at winding coreless product than other winders is in the use of the winding control fingers 30, particularly the core insert fingers 150, to control the mandrel insertion process. The web separation fingers 140 and the core insert fingers 150 of the winding control fingers 30 and the upper and lower winding rolls 16, 20 trap the mandrel 100 on all sides. The bearing supports 114 on the two parts of the winding control fingers 30 hold the mandrel 100 centered with a small gap between the winding control fingers 30 and the mandrel 100, and between the winding rolls 16, 20 and the mandrel 100. The contact between the friction drive area 118 on one end of the mandrel 100 and the lower winding roll 20 positively spins the mandrel 100 up to roll speed as the mandrel 100 reaches the nip 56. When the web separation finger 140 separates the web 12 just in front of the mandrel 100, the web 12 collects in the area over the mandrel 100 and contact is made between the spinning mandrel 100 and loose web 12. The web 12 follows the only path available to it and wraps the mandrel 100 to start the winding process. Other surface winder designs lack both the control and separation systems to effectively wind coreless product on mandrels 100 reliably at very high speeds up to about 3,000 feet per minute.

While preferred embodiments have been illustrated and described, it should be understood that changes and modifications can be made thereto without departing from the invention in its broader aspects. Various features of the invention are defined in the following claims.

I claim:

1. A core insert mechanism for inserting cores into a nip defined between a first winding roll and a second winding roll in a rewinder, the core insert mechanism comprising:

a first winding control finger mounted for movement with respect to the first winding roll; and a second winding control finger mounted for movement with respect to the first winding roll and the first winding control finger and positionable a distance from the first winding control finger to hold a core therebetween, the first winding control finger and the second winding control finger positionable between the first winding roll and the second winding roll to define at least one position in which the core is restrained against movement substantially outside of the at least one position.

2. The core insert mechanism as claimed in claim 1, wherein the first winding control finger is mounted for rotation.

3. The core insert mechanism as claimed in claim 2, wherein the second winding control finger is mounted for rotation.

4. The core insert mechanism as claimed in claim 2, wherein the first winding control finger is located on a ring which is itself mounted for rotation.

5. The core insert mechanism as claimed in claim 4, wherein the second winding control finger is mounted for rotation.

6. The core insert mechanism as claimed in claim 5, wherein the second winding control finger is located on a ring which is itself mounted for rotation.

7. The core insert mechanism as claimed in claim 4, wherein the second winding control finger is located on an arm which is pivotably mounted.

8. The core insert mechanism as claimed in claim 4, wherein the first winding control finger and the second winding control finger are independently driven.

9. The core insert mechanism as claimed in claim 2, wherein the first winding control finger and the second winding control finger are independently driven.

10. The core insert mechanism as claimed in claim 1, wherein the first winding control finger is located on an arm which is pivotably mounted.

11. The core insert mechanism as claimed in claim 10, wherein the second winding control finger is mounted for rotation.

12. The core insert mechanism as claimed in claim 1, wherein the first winding control finger and the second winding control finger are independently driven.

13. The core insert mechanism as claimed in claim 1, wherein the at least one position is bounded on a first set of opposing sides by the first winding roll and the second winding roll.

14. The core insert mechanism as claimed in claim 13, wherein the at least one position is bounded on a second set of opposing sides by the first winding control finger and the second winding control finger.

15. The core insert mechanism as claimed in claim 1, wherein the first winding control finger and the second winding control finger have a first orientation in which the first winding control finger and the second winding control finger are distal from one another and a second orientation in which the first winding control finger and the second winding control finger are closer to one another than in the first orientation.

16. The core insert mechanism as claimed in claim 1, wherein the first winding control finger and the second winding control finger have a first orientation in which the first winding control finger and the second winding control finger are positioned apart a distance which is substantially a diameter of the core.

17. A core insert mechanism for inserting cores into a rewinder having a first winding roll and a second winding roll separated apart from one another to define a nip therebetween, the core insert mechanism comprising:

a first winding control finger mounted for movement with respect to the first winding roll; and a second winding control finger mounted for movement with respect to the first winding roll and spaced from the first winding control finger a distance sufficient to hold a core therebetween;

the first winding control finger and the second winding control finger having portions passing into the nip along at least one path.

18. The core insert mechanism as claimed in claim 17, wherein at least one of the winding control fingers is mounted for rotation with respect to the first winding roll.

19. The core insert mechanism as claimed in claim 18, wherein at least one of the winding control fingers is located on a substantially ring-shaped member mounted for rotation with respect to the first winding roll.

20. The core insert mechanism as claimed in claim 19, wherein at least one of the winding control fingers is located on an arm which is mounted for rotation with respect to the first winding roll.

21. The core insert mechanism as claimed in claim 17, wherein at least one of the winding control fingers is located on an arm which is mounted for rotation with respect to the first winding roll.

22. The core insert mechanism as claimed in claim 17, wherein the first winding control finger and the second winding control finger are mounted on separate substantially ring-shaped members which are rotatable with respect to one another and with respect to the first winding roll.

23. The core insert mechanism as claimed in claim 17, wherein at least a part of the at least one path is arcuate in shape.

24. The core insert mechanism as claimed in claim 17, wherein at least a part of the at least one path is arcuate in shape around at least part of the second winding roll.

25. The core insert mechanism as claimed in claim 17, wherein the first winding control finger and the second winding control finger are positionable in range of positions from a widely spaced relationship to an adjacent relationship.

26. The core insert mechanism as claimed in claim 17, wherein the first winding control finger and the second winding control finger have a position between the first winding roll and the second winding roll, the position being flanked on two substantially opposing sides by the winding control fingers and flanked on another two substantially opposing sides by the first winding roll and the second winding roll.

27. A method for inserting cores between a first winding roll and a second winding roll in a rewinder, the method comprising the steps of:

placing the core between two winding control fingers, both of which are mounted for movement with respect to the first winding roll; and moving the winding control fingers with the core held therebetween into a position substantially between the first winding roll and the second winding roll.

28. The method as claimed in claim 27, wherein at least one of the winding control fingers is mounted for rotation with respect to the first winding roll, at least part of the movement of the at least one of the winding control fingers being rotational with respect to the first winding roll.

29. The method as claimed in claim 28, wherein both winding control fingers are mounted for rotation about an axis, at least part of the movement of the winding control fingers being rotational with respect to the first winding roll.

30. The method as claimed in claim 28, wherein both winding control fingers are mounted for rotation about different axes.

31. The method as claimed in claim 28, wherein the at least one of the winding control fingers is located upon a ring which is itself rotatably mounted with respect to the first winding roll.

32. The method as claimed in claim 28, wherein the winding control fingers are located upon respective first and second rings, the first ring being rotatable independent of the second ring.

33. The method as claimed in claim 32, further including the step of moving the two winding control fingers closer together prior to the step of placing the core between the two winding control fingers.

34. The method as claimed in claim 32, further including the step of moving the two winding control fingers apart after the step of moving the winding control fingers into position substantially between the first winding roll and the second winding roll.

35. The method as claimed in claim 28, wherein one of the winding control fingers is mounted on an arm which is itself rotatably mounted with respect to the first winding roll.

36. The method as claimed in claim 35, further including the step of moving the two winding control fingers closer together prior to the step of placing the core between the two winding control fingers.

37. The method as claimed in claim 35, further including the step of moving the two winding control fingers apart after the step of moving the winding control fingers into position substantially between the first winding roll and the second winding roll.

38. The method as claimed in claim 27, further including the step of moving the two winding control fingers closer together prior to the step of placing the core between the two winding control fingers.

39. The method as claimed in claim 27, further including the step of moving the two winding control fingers apart after the step of moving the winding control fingers into position substantially between the first winding roll and the second winding roll.

40. A method for inserting cores between a first winding roll and a second winding roll in a rewinder, including the steps of:

receiving a core adjacent a winding control finger; and moving the winding control finger and the core into a position between the first winding roll and the second winding roll with the core behind and following the winding control finger.

41. The method as claimed in claim 40, further including the step of passing the winding control finger and the core through the position between the first winding roll and the second winding roll.

* * * * *